US010575576B2

(12) United States Patent
Hayes

(10) Patent No.: US 10,575,576 B2
(45) Date of Patent: Mar. 3, 2020

(54) APPARATUS FOR CLIP-IN HAIR EXTENSION

(71) Applicant: Crystal Hayes, Springfield Gardens, NY (US)

(72) Inventor: Crystal Hayes, Springfield Gardens, NY (US)

( * ) Notice: Subject to any disclaimer, the term of this patent is extended or adjusted under 35 U.S.C. 154(b) by 0 days.

(21) Appl. No.: 15/229,316

(22) Filed: Aug. 5, 2016

(65) Prior Publication Data

US 2018/0035738 A1 Feb. 8, 2018

(51) Int. Cl.
*A41G 5/00* (2006.01)

(52) U.S. Cl.
CPC ..... *A41G 5/0073* (2013.01); *A41G 5/0046* (2013.01)

(58) Field of Classification Search
CPC .. A41G 3/0033; A41G 5/0046; A41G 5/0053; A41G 5/0073; A41G 5/00; A41G 5/0013; A41G 5/0026; A41G 5/004
USPC ..... 132/53, 54
See application file for complete search history.

(56) References Cited

U.S. PATENT DOCUMENTS

| | | | | |
|---|---|---|---|---|
| 7,735,495 | B2 * | 6/2010 | Lane | A45D 8/00 132/201 |
| 2008/0017210 | A1 * | 1/2008 | Eaton | A41G 5/0073 132/105 |
| 2011/0005544 | A1 * | 1/2011 | Lane | A41G 5/0073 132/201 |
| 2011/0253165 | A1 | 10/2011 | Kenna | |
| 2012/0145174 | A1 | 6/2012 | Frazier | |
| 2015/0223538 | A1 * | 8/2015 | Yanniello | A41G 5/0073 132/53 |
| 2015/0327611 | A1 * | 11/2015 | Kleinman | A41G 5/0046 132/201 |
| 2016/0015107 | A1 * | 1/2016 | Sehovic | A41G 5/0073 132/201 |
| 2017/0065014 | A1 * | 3/2017 | Kenna | A41G 5/0046 |

* cited by examiner

*Primary Examiner* — William V Gilbert
(74) *Attorney, Agent, or Firm* — Ariel S. Bentolila; Bay Area IP Group, LLC

(57) ABSTRACT

An apparatus includes a strip of a polymer material having a front side and a back side. A plurality of hair strands are inserted into the front side, where the hair strands are secured to the strip and substantially cover the front side. At least one hair clip is joined to the back side. The at least one hair clip is operable for removably attaching to a user's hair.

16 Claims, 27 Drawing Sheets

APPARATUS FOR CLIP-IN HAIR EXTENSION

CROSS-REFERENCE TO RELATED APPLICATIONS

Not applicable.

RELATED CO-PENDING U.S. PATENT APPLICATIONS

Not applicable.

FEDERALLY SPONSORED RESEARCH OR DEVELOPMENT

Not applicable.

REFERENCE TO SEQUENCE LISTING, A TABLE, OR A COMPUTER LISTING APPENDIX

Not applicable.

COPYRIGHT NOTICE

A portion of the disclosure of this patent document contains material that is subject to copyright protection by the author thereof. The copyright owner has no objection to the facsimile reproduction by anyone of the patent document or patent disclosure for the purposes of referencing as patent prior art, as it appears in the Patent and Trademark Office, patent file or records, but otherwise reserves all copyright rights whatsoever.

FIELD OF THE INVENTION

One or more embodiments of the invention generally relate to hair accessories. More particularly, the invention relates to a temporary, clip-in hair extension system that may be installed by the wearer.

BACKGROUND OF THE INVENTION

The following background information may present examples of specific aspects of the prior art (e.g., without limitation, approaches, facts, or common wisdom) that, while expected to be helpful to further educate the reader as to additional aspects of the prior art, is not to be construed as limiting the present invention, or any embodiments thereof, to anything stated or implied therein or inferred thereupon. It is believed that many people may incorporate hair extensions into their hair. Some individuals may place hair extensions in their hair in order to add length or fullness to their natural hair. Some individuals may use hair extensions to change or enhance the style of their hair. These extensions may be made of real human hair or artificial hair.

By way of educational background, an aspect of the prior art generally useful to be aware of is that there are currently a variety of different types of hair extensions available including, without limitation, clip-in hair extensions, hair extensions that use adhesive as the point of attachment, hair extensions that use micro beads or micro rings as the point of attachment, and braid-on wig hair extensions. Current clip-in hair extensions on the market are typically created by aligning individual strands of hair and sewing the hair strands with thread to form a weft, which may hold the strands of hair together to form a hair extension. Other current clip in hair enhancement systems may be used to install larger hair pieces such as wigs or toupees. Clips may then be sewn onto the weft to serve as the point of attachment of the hair extension to the user's natural hair. It is believed that the sewn construction of some of these extensions may provide a thick and bulky weft, which may cause the top edge and/or the thread of such extensions to become visible when the user's natural hair moves intentionally or involuntarily or if the weft is placed too near the crown of the user's head or too close to the hair line of the user's natural hair. In some instances the clips used to hold these extensions in place may be visible above the top portion of the weft. One may expect that the visibility of portions of current clip-in hair extensions may be particularly apparent if the user has thin or short hair. As a result, those with thin or short hair may be limited in the volume they can experience with such clip-in hair extensions. Furthermore, these extensions may be easily felt by the user if they run their fingers through their hair due to the thickness and bulkiness of the top portion of the wefts, and the extensions may be even more easily felt if the user has thin or short hair. Some solutions may provide options for clipping in hair extensions to natural hair with a single or dual clip member in the device with the usage of upward facing combs. The multiple application options for these clip in devices may require the user and/or hairstylist to be educated in the usage options of the devices, which may be time consuming and costly.

When several of these typically thick and bulky wefts are attached to a user's natural hair, it is believed that this may be uncomfortable for the user as they may experience pulling from the weight of the hair extensions. Often, current clip-in hair extensions may be created with multiple individual wefts sewn together to form a combination weft for more volume. One may expect that the use of combination wefts may increase the heavy feel of the extensions when attached to a user's hair, may increase the visibility of the wefts when the user's natural hair moves, and may be easily felt when the user runs their fingers through their hair. In addition, as a result of sewing multiple wefts together with thread, it is believed that the wefts may become misaligned, which may further increase the thickness and bulkiness of the wefts. This misalignment may also typically prevent the weft from lying flat to the head and may not allow the user to match the top edge of the weft with the part created in their natural hair to guide the installation of the clip-ins. It is believed that shedding of hair strands may be experienced with current clip-in hair extensions. Often adhesive may be added to the top portion of the weft in some current clip-in hair extensions to reduce the shedding of the hair strands which may occur during daily brushing, combing, washing, styling, and activities. As a result it is believed that the adhesive may make the wefts feel stiff in addition to thick and bulky. The feature of stiffness caused by adhesive applied to current clip-in hair extensions may be applicable to both individual and combination wefts. Moreover, the adhesive may degrade over time with exposure to oils and wear and tear from washing, styling, and repeat installations.

Currently, some clip-in hair extensions may be handmade by the user or a hairstylist by sewing clips to individual sewn wefts for sale on the market. It is believed that this may be an intimidating or time consuming experience for the user or for hairstylists. One may expect that if the clip-in hair extensions are not made correctly and securely the user may face an embarrassing situation where the hair extension system may be visibly exposed to others or may shift or fall out unexpectedly. Furthermore, such approaches may require specific sewing equipment in order to combine more than one weft, which may be expensive and/or difficult to use. One may expect that this may discourage the user or hairstylist to combine wefts in these types of extensions thereby typically limiting the amount of volume that may be achieved.

In one currently available system for hair addition, a hair extension comprises a plurality of hair strands that are grouped together with thread and sandwiched between two strips of polyurethane. The two layers of polyurethane are then cured, and clips may be added to the cured polyurethane. One may expect that the cured polyurethane may result in a solid strip that runs along the top portion of the hair extension, which may prevent the top portion of the strands from blending with the user's natural hair near the roots. Furthermore, it is believed that if the user's natural hair moves, the strip of cured polyurethane may be visible. Moreover, a user may be able to feel the strip of solid cured polyurethane as they run their fingers through their hair.

By way of educational background, an aspect of the prior art generally useful to be aware of is that there are a number of currently available systems and methods of providing hair extensions that involve the attachment of the wefts to the user's natural hair or scalp with adhesives. These systems may incorporate a variety of different types of adhesives including, without limitation, double sided adhesive tape, double sided adhesive tape and extended wings, single sided adhesive strips, liquid adhesive, hot melt adhesive, gel adhesives, paste adhesives, glue sticks, glue pebbles or granules, etc. Some of these systems may involve applying a non-weft device, individual hairs, or a lace base to the user's hair or scalp via adhesive. It is believed that the use adhesive as the point of attachment to the user's natural hair or scalp may result in premature loosening and detachment of the extensions if the adhesive comes into contact with oil, for example, without limitation, oil secreted from the user's scalp or oil ingredients in hair care or hair styling products. Therefore it is believed that users may often avoid applying hair care and hair styling products on or near the roots of their natural hair or scalp that may contain oil ingredients to prevent the aforementioned effect of premature loosening or detachment. This may lead to the effect of neglecting to maintain the health of the user's natural hair near the roots or scalp, which may cause long term damage to the user's natural hair in the form of dryness and hair breakage. Furthermore, systems that may require the placement of the adhesive on the user's scalp may risk damage to the roots of the user's natural hair by blocking the breathability of their scalp where the adhesive is applied. One may expect that root damage from lack of breathability along with improper removal of adhesive may result in the appearance of bald spots on the user's scalp.

Hair extension systems and methods that utilize adhesive as the point of attachment to the consumer's natural hair or scalp may require the employment of a licensed hairstylist for proper application and/or removal of the extensions. For example, if the adhesive tape is not secured correctly to the extension or to the user's natural hair, the hair extension may loosen or detach prematurely. Moreover, the stylist would typically have a clear view of all angles of the user's head as well as the moving parts of the hair extensions such as extended wings or overlapping double sided adhesive tape as they are applied to the user's head, which may aid in the accurate positioning of the extension and the adhesive. A hairstylist who has a clear view of all angles of the user's head would typically be able to consistently apply the pressure necessary for maximum adhesion along the entire length of the extension for consistent application. It is believed that if a portion of the adhesive is not properly attached to the extension or the user's natural hair or scalp, the adhesive may be left exposed to catch hold of free strands of the user's natural hair, which may be frustrating and uncomfortable and may also lead to premature loosening and detachment of the extensions and/or damage to the user's natural hair. In addition, if extensions comprising adhesive strips are not carefully applied, the adhesive portion can be twisted or wrinkled out of shape. If this happens, the adhesive may typically make it challenging to unravel the distorted shape for smooth application and may reduce the strength of the adhesive. It is often necessary to use an oil-based product such as citrus oil, olive oil, or baby oil as a solvent to remove the adhesive or adhesive tape from the extensions and/or the user's natural hair, and this removal process can be messy and time consuming as all adhesive and oil typically must be removed from the extensions and the user's natural hair prior to re-application. Therefore, a clear view of the amount and location of adhesive and oil on the user's head, which may be acquired by a hairstylist, typically may be desired to effectively remove the adhesive and oils from the user's natural hair and scalp and the extension system. Removal of the adhesive and oils may be particularly important prior to re-application of an extension system as oil remaining on the user's natural hair or scalp or on the extension system can prematurely loosen or detach the new application of adhesive to the system and the user's hair or scalp. In some current hair extension systems, an adhesive strip may be sewn to the weft and cannot be removed after the adhesive has weakened or detached. Therefore, this system is not reusable, and a new system must typically be applied to the consumer's scalp or natural hair after the adhesive has lost its ability to function as such which could be costly and time consuming as a professional hairstylist would need to be employed. Furthermore, once applied, these systems often cannot be repositioned.

By way of educational background, an aspect of the prior art generally useful to be aware of is that other current hair extension systems and methods may involve the attachment of hair extension wefts or hair strands to a user's natural hair with micro beads, also known as micro rings or micro tubes. These systems include, without limitation, a method for attaching hair extensions with a crimp able anchor device or micro beads which are attached to a hair weft and systems that may utilize a skin weft with micro rings to serve as an anchor for the user's natural hair to the skin weft. In some of these systems the micro beads may be layered under the hair weft, typically causing the system to be bulky and easily felt by the consumer. Furthermore, these systems may often become visible when the user's natural hair moves voluntarily or involuntarily. In other such systems, the micro beads may be positioned on the outside of the hair weft. The micro beads in these systems may typically be easily felt if the user runs their fingers through their hair and may often be visible to others due to their position on the outside of the weft. Similarly to aforementioned systems, the ability to feel the micro beads as the user runs their fingers through their hair or the visibility of the micro beads may be amplified if the user has thin or short hair. In some instances, the user may be bothered by the weight and bulk of the wefts and micro beads when one or more extensions comprising wefts and micro beads are connected to the user's natural hair.

Multiple visits to a professional hairstylist may be required to install, re-adjust, and remove the aforementioned systems that employ micro beads as the point of attachment to a consumer's natural hair for the duration of the hair system installation which can be costly monetarily and in time. Also, if such systems are not installed, adjusted or removed correctly, a user may risk damage to their natural hair or premature loosening or detachment of the system. A hairstylist would typically have a clear view of all angles of the user's head and may therefore determine and select a suitable location to attach the system as well as a suitable amount of hair to pull through the micro beads to safely close and re-open the micro beads. Additionally, the hairstylist may be better able to perform the correct and safe application of the tools needed to install, re-adjust, and remove the micro bead system correctly and securely such as crochet needles and clamping devices. In some cases, professional hairstylist may be required to undergo education to learn how to install, re-adjust, and remove such systems correctly which can be costly and time consuming for the hairstylist as their time could be better spent providing income producing services to their clients.

Approaches including adhesive based systems and micro bead, also known as micro ring or micro tube, systems are often worn from 1 month to 3 months. Due to the fixed direction of the initial installation of these current hair extension systems, one may expect that the user may be limited in available style options. For example, if the user chooses to create a style option that requires the hair in the system to lay in a different direction than what is natural for the initial attachment position of the hair system, the user may risk visibility of the hair system. Also, these systems typically cannot be re-adjusted as the user's natural hair grows. Instead, the system would usually need to be removed completely in order to change the position of the extensions as the user's natural hair grows longer. The re-application process can be costly, messy, cumbersome and time-consuming. It is believed that as the user's natural hair grows longer, the system may become increasingly visible to others, and the user may often experience difficulty combing and brushing during daily natural hair maintenance and styling as the hair extension system moves in a downward direction with the incoming new growth of the user's natural hair, which may subject the system to conditions that may lead to premature loosening or detachment of the system.

Hair extensions worn for 1 to 3 months or more are typically considered long term hair extensions. After the long term hair extensions have been worn for an extended time, the add-on hair is typically not in the same shape as it was when initially installed. For example, when the add-on hair that is part of the long-term hair extension system ages, the add-on hair may experience tangling, shedding, color fading, and/or matting. Also, multiple washings may remove protective coatings that may be applied to the hair before use. Furthermore, coloring of the add-on hair may result in the, shortening of the lifespan of the add-on hair itself due to cuticle damage. It is believed that, once the add-on hairs in long-term hair extension methods reach the end of their usability, users typically purchase a new long-term system or explore a new hair extension option with fresh add-on hair rather than re-use the previously worn extensions.

In view of the foregoing, it is clear that these traditional techniques are not perfect and leave room for more optimal approaches.

BRIEF DESCRIPTION OF THE DRAWINGS

The present invention is illustrated by way of example, and not by way of limitation, in the figures of the accompanying drawings and in which like reference numerals refer to similar elements and in which:

FIG. 1A is a diagrammatic front view of an exemplary weft. FIG. 1B is a diagrammatic front view of an exemplary clip, and FIG. 1C is a diagrammatic rear view of weft with clip attached;

FIG. 2A is a diagrammatic rear view of the hair extension prior to application. FIG. 2B is a front perspective view of the hair extension during application. FIG. 2C is a diagrammatic front view of the hair extension after application, and FIG. 2D is a diagrammatic front view of the hair extension blended into the user's natural hair;

FIG. 3A is a diagrammatic rear view of the clip-in bang extension. FIG. 3B is a front perspective view of the bang extension during application, and FIG. 3C is a diagrammatic front view of the bang extension after application;

FIG. 5A is a diagrammatic rear view, and FIG. 5B is a diagrammatic front view;

FIG. 6A is a diagrammatic rear view, and FIG. 6B is a diagrammatic front view;

FIG. 8A is a diagrammatic rear view, and FIG. 8B is a diagrammatic front view;

FIG. 9A is a diagrammatic rear view, and FIG. 9B is a diagrammatic front view;

FIG. 10A is a diagrammatic rear view, and FIG. 10B is a diagrammatic front view; FIG. 11A and FIG. 11C is a diagrammatic front view, and FIG. 11B

FIG. 12A is a diagrammatic rear view, and FIG. 12B is a diagrammatic front view. FIG. 12C illustrates an alternative version of FIG. 12A with woven material. FIG. 12D illustrates an alternative version of FIG. 12A with adjustable straps.

FIG. 13A is a diagrammatic rear view, and FIG. 13B is a diagrammatic front view.

Figure 1A:
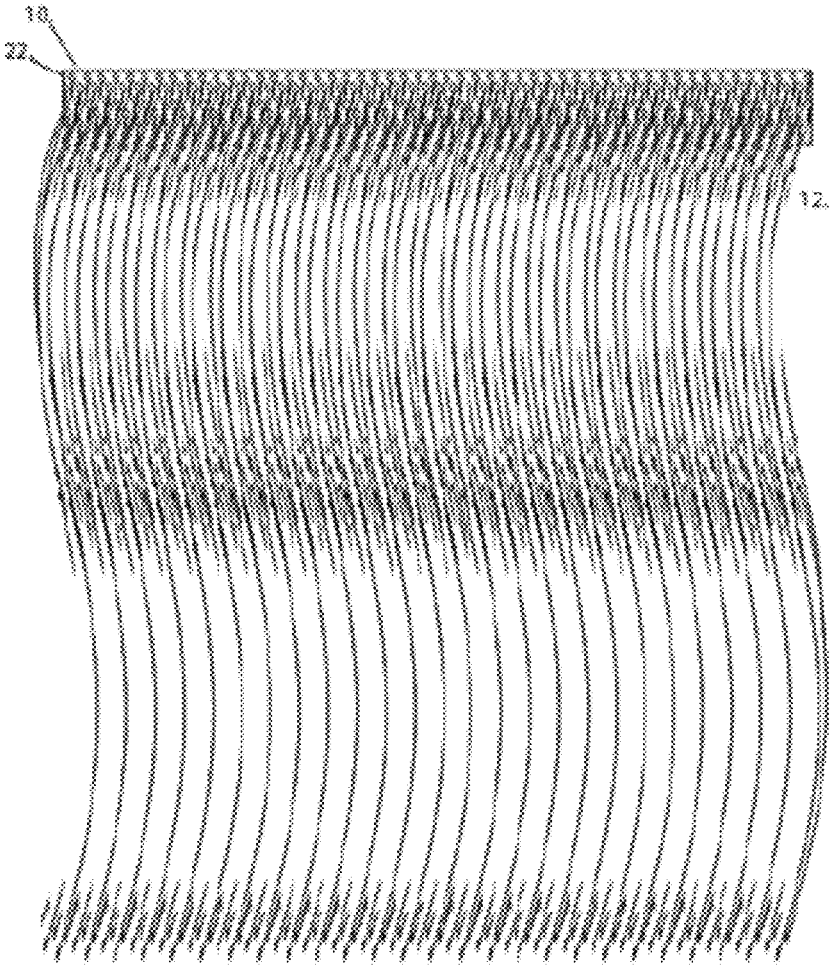
FIGS. 1A, 1B, and 1C illustrate exemplary elements of a temporary clip-in hair extension system, in accordance with an embodiment of the present invention.

Unless otherwise indicated illustrations in the figures are not necessarily drawn to scale.

DETAILED DESCRIPTION OF SOME EMBODIMENTS

The present invention is best understood by reference to the detailed figures and description set forth herein.

Embodiments of the invention are discussed below with reference to the Figures. However, those skilled in the art will readily appreciate that the detailed description given herein with respect to these figures is for explanatory purposes as the invention extends beyond these limited embodiments. For example, it should be appreciated that those skilled in the art will, in light of the teachings of the present invention, recognize a multiplicity of alternate and suitable approaches, depending upon the needs of the particular application, to implement the functionality of any given detail described herein, beyond the particular implementation choices in the following embodiments described and shown. That is, there are modifications and variations of the invention that are too numerous to be listed but that all fit within the scope of the invention. Also, singular words should be read as plural and vice versa and masculine as feminine and vice versa, where appropriate, and alternative embodiments do not necessarily imply that the two are mutually exclusive.

It is to be further understood that the present invention is not limited to the particular methodology, compounds, materials, manufacturing techniques, uses, and applications, described herein, as these may vary. It is also to be understood that the terminology used herein is used for the purpose of describing particular embodiments only, and is not intended to limit the scope of the present invention. It must be noted that as used herein and in the appended claims, the singular forms "a," "an," and "the" include the plural reference unless the context clearly dictates otherwise. Thus, for example, a reference to "an element" is a reference to one or more elements and includes equivalents thereof known to those skilled in the art. Similarly, for another example, a reference to "a step" or "a means" is a reference to one or more steps or means and may include sub-steps and subservient means. All conjunctions used are to be understood in the most inclusive sense possible. Thus, the word "or" should be understood as having the definition of a logical "or" rather than that of a logical "exclusive or" unless the context clearly necessitates otherwise. Structures described herein are to be understood also to refer to functional equivalents of such structures. Language that may be construed to express approximation should be so understood unless the context clearly dictates otherwise.

All words of approximation as used in the present disclosure and claims should be construed to mean "approximate," rather than "perfect," and may accordingly be employed as a meaningful modifier to any other word, specified parameter, quantity, quality, or concept. Words of approximation, include, yet are not limited to terms such as "substantial", "nearly", "almost", "about", "generally", "largely", "essentially", "closely approximate", etc.

As will be established in some detail below, is well settle law, as early as 1939, that words of approximation are not indefinite in the claims even when such limits are not defined or specified in the specification.

For example, see Ex parte Mallory, 52 USPQ 297, 297 (Pat. Off. Bd. App. 1941) where the court said "The examiner has held that most of the claims are inaccurate because apparently the laminar film will not be entirely eliminated. The claims specify that the film is "substantially" eliminated and for the intended purpose, it is believed that the slight portion of the film which may remain is negligible. We are of the view, therefore, that the claims may be regarded as sufficiently accurate."

Note that claims need only "reasonably apprise those skilled in the art" as to their scope to satisfy the definiteness requirement. See Energy Absorption Sys., Inc. v. Roadway Safety Servs., Inc., Civ. App. 96-1264, slip op. at 10 (Fed. Cir. Jul. 3, 1997) (unpublished) Hybridtech v. Monoclonal Antibodies, Inc., 802 F.2d 1367, 1385, 231 USPQ 81, 94 (Fed. Cir. 1986), cert. denied, 480 U.S. 947 (1987). In addition, the use of modifiers in the claim, like "generally" and "substantial," does not by itself render the claims indefinite. See Seattle Box Co. v. Industrial Crating & Packing, Inc., 731 F.2d 818, 828-29, 221 USPQ 568, 575-76 (Fed. Cir. 1984).

Moreover, the ordinary and customary meaning of terms like "substantially" includes "reasonably close to: nearly, almost, about", connoting a term of approximation. See In re Frye, Appeal No. 2009-006013, 94 USPQ2d 1072, 1077, 2010 WL 889747 (B.P.A.I. 2010) Depending on its usage, the word "substantially" can denote either language of approximation or language of magnitude. Deering Precision Instruments, L.L.C. v. Vector Distribution Sys., Inc., 347 F.3d 1314, 1323 (Fed. Cir. 2003) (recognizing the "dual ordinary meaning of th[e] term ["substantially"] as connoting a term of approximation or a term of magnitude"). Here, when referring to the "substantially halfway" limitation, the Specification uses the word "approximately" as a substitute for the word "substantially". (Fact 4). The ordinary meaning of "substantially halfway" is thus reasonably close to or nearly at the midpoint between the forwardmost point of the upper or outsole and the rearwardmost point of the upper or outsole.

Similarly, the term 'substantially' is well recognized in case law to have the dual ordinary meaning of connoting a term of approximation or a term of magnitude. See Dana Corp. v. American Axle & Manufacturing, Inc., Civ. App. 04-1116, 2004 U.S. App. LEXIS 18265, *13-14 (Fed. Cir. Aug. 27, 2004) (unpublished). The term "substantially" is commonly used by claim drafters to indicate approximation. See Cordis Corp. v. Medtronic AVE Inc., 339 F.3d 1352, 1360 (Fed. Cir. 2003) ("The patents do not set out any numerical standard by which to determine whether the thickness of the wall surface is 'substantially uniform.' The term 'substantially,' as used in this context, denotes approximation. Thus, the walls must be of largely or approximately uniform thickness."); see also Deering Precision Instruments, LLC v. Vector Distribution Sys., Inc., 347 F.3d 1314, 1322 (Fed. Cir. 2003); Epcon Gas Sys., Inc. v. Bauer Compressors, Inc., 279 F.3d 1022, 1031 (Fed. Cir. 2002). We find that the term "substantially" was used in just such a manner in the claims of the patents-in-suit: "substantially uniform wall thickness" denotes a wall thickness with approximate uniformity.

It should also be noted that such words of approximation as contemplated in the foregoing clearly limits the scope of claims such as saying 'generally parallel' such that the adverb 'generally' does not broaden the meaning of parallel. Accordingly, it is well settled that such words of approximation as contemplated in the foregoing (e.g., like the phrase 'generally parallel') envisions some amount of deviation from perfection (e.g., not exactly parallel), and that such words of approximation as contemplated in the foregoing are descriptive terms commonly used in patent claims to avoid a strict numerical boundary to the specified parameter. To the extent that the plain language of the claims relying on such words of approximation as contemplated in the foregoing are clear and uncontradicted by anything in the written description herein or the figures thereof, it is improper to rely upon the present written description, the figures, or the prosecution history to add limitations to any of the claim of the present invention with respect to such words of approximation as contemplated in the foregoing. That is, under such circumstances, relying on the written description and prosecution history to reject the ordinary and customary meanings of the words themselves is impermissible. See, for example, Liquid Dynamics Corp. v. Vaughan Co., 355 F.3d 1361, 69 USPQ2d 1595, 1600-01 (Fed. Cir. 2004). The plain language of phrase 2 requires a "substantial helical flow." The term "substantial" is a meaningful modifier implying "approximate," rather than "perfect." In Cordis Corp. v. Medtronic AVE, Inc., 339 F.3d 1352, 1361 (Fed. Cir. 2003), the district court imposed a precise numeric constraint on the term "substantially uniform thickness." We noted that the proper interpretation of this term was "of largely or approximately uniform thickness" unless something in the prosecution history imposed the "clear and unmistakable disclaimer" needed for narrowing beyond this simple-language interpretation. Id. In Anchor Wall Systems v. Rockwood Retaining Walls, Inc., 340 F.3d 1298, 1311 (Fed. Cir. 2003)" Id. at 1311. Similarly, the plain language of Claim 1 requires neither a perfectly helical flow nor a flow that returns precisely to the center after one rotation (a limitation that arises only as a logical consequence of requiring a perfectly helical flow).

The reader should appreciate that case law generally recognizes a dual ordinary meaning of such words of approximation, as contemplated in the foregoing, as connoting a term of approximation or a term of magnitude; e.g., see Deering Precision Instruments, L.L.C. v. Vector Distrib. Sys., Inc., 347 F.3d 1314, 68 USPQ2d 1716, 1721 (Fed. Cir. 2003), cert. denied, 124 S. Ct. 1426 (2004) where the court was asked to construe the meaning of the term "substantially" in a patent claim. Also see Epcon, 279 F.3d at 1031 ("The phrase 'substantially constant' denotes language of approximation, while the phrase 'substantially below' signifies language of magnitude, i.e., not insubstantial."). Also, see, e.g., Epcon Gas Sys., Inc. v. Bauer Compressors, Inc., 279 F.3d 1022 (Fed. Cir. 2002) (construing the terms "substantially constant" and "substantially below"); Zodiac Pool Care, Inc. v. Hoffinger Indus., Inc., 206 F.3d 1408 (Fed. Cir. 2000) (construing the term "substantially inward"); York Prods., Inc. v. Cent. Tractor Farm & Family Ctr., 99 F.3d 1568 (Fed. Cir. 1996) (construing the term "substantially the entire height thereof"); Tex. Instruments Inc. v. Cypress Semiconductor Corp., 90 F.3d 1558 (Fed. Cir. 1996) (construing the term "substantially in the common plane"). In conducting their analysis, the court instructed to begin with the ordinary meaning of the claim terms to one of ordinary skill in the art. Prima Tek, 318 F.3d at 1148. Reference to dictionaries and our cases indicates that the term "substantially" has numerous ordinary meanings. As the district court stated, "substantially" can mean "significantly" or "considerably." The term "substantially" can also mean "largely" or "essentially." Webster's New 20th Century Dictionary 1817 (1983).

Words of approximation, as contemplated in the foregoing, may also be used in phrases establishing approximate ranges or limits, where the end points are inclusive and approximate, not perfect; e.g., see AK Steel Corp. v. Sollac, 344 F.3d 1234, 68 USPQ2d 1280, 1285 (Fed. Cir. 2003) where it where the court said [W]e conclude that the ordinary meaning of the phrase "up to about 10%" includes the "about 10%" endpoint. As pointed out by AK Steel, when an object of the preposition "up to" is nonnumeric, the most natural meaning is to exclude the object (e.g., painting the wall up to the door). On the other hand, as pointed out by Sollac, when the object is a numerical limit, the normal meaning is to include that upper numerical limit (e.g., counting up to ten, seating capacity for up to seven passengers). Because we have here a numerical limit—"about 10%"—the ordinary meaning is that that endpoint is included.

In the present specification and claims, a goal of employment of such words of approximation, as contemplated in the foregoing, is to avoid a strict numerical boundary to the modified specified parameter, as sanctioned by Pall Corp. v. Micron Separations, Inc., 66 F.3d 1211, 1217, 36 USPQ2d 1225, 1229 (Fed. Cir. 1995) where it states "It is well established that when the term "substantially" serves reasonably to describe the subject matter so that its scope would be understood by persons in the field of the invention, and to distinguish the claimed subject matter from the prior art, it is not indefinite." Likewise see Verve LLC v. Crane Cams Inc., 311 F.3d 1116, 65 USPQ2d 1051, 1054 (Fed. Cir. 2002). Expressions such as "substantially" are used in patent documents when warranted by the nature of the invention, in order to accommodate the minor variations that may be appropriate to secure the invention. Such usage may well satisfy the charge to "particularly point out and distinctly claim" the invention, 35 U.S.C. § 112, and indeed may be necessary in order to provide the inventor with the benefit of his invention. In Andrew Corp. v. Gabriel Elecs. Inc., 847 F.2d 819, 821-22, 6 USPQ2d 2010, 2013 (Fed. Cir. 1988) the court explained that usages such as "substantially equal" and "closely approximate" may serve to describe the invention with precision appropriate to the technology and without intruding on the prior art. The court again explained in Ecolab Inc. v. Envirochem, Inc., 264 F.3d 1358, 1367, 60 USPQ2d 1173, 1179 (Fed. Cir. 2001) that "like the term 'about,' the term 'substantially' is a descriptive term commonly used in patent claims to avoid a strict numerical boundary to the specified parameter," see Ecolab Inc. v. Envirochem Inc., 264 F.3d 1358, 60 USPQ2d 1173, 1179 (Fed. Cir. 2001) where the court found that the use of the term "substantially" to modify the term "uniform" does not render this phrase so unclear such that there is no means by which to ascertain the claim scope.

Similarly, other courts have noted that like the term "about," the term "substantially" is a descriptive term commonly used in patent claims to "avoid a strict numerical boundary to the specified parameter."; e.g., see Pall Corp. v. Micron Seps., 66 F.3d 1211, 1217, 36 USPQ2d 1225, 1229 (Fed. Cir. 1995); see, e.g., Andrew Corp. v. Gabriel Elecs. Inc., 847 F.2d 819, 821-22, 6 USPQ2d 2010, 2013 (Fed. Cir. 1988) (noting that terms such as "approach each other," "close to," "substantially equal," and "closely approximate" are ubiquitously used in patent claims and that such usages, when serving reasonably to describe the claimed subject matter to those of skill in the field of the invention, and to distinguish the claimed subject matter from the prior art, have been accepted in patent examination and upheld by the courts). In this case, "substantially" avoids the strict 100% nonuniformity boundary.

Indeed, the foregoing sanctioning of such words of approximation, as contemplated in the foregoing, has been established as early as 1939, see Ex parte Mallory, 52 USPQ 297, 297 (Pat. Off. Bd. App. 1941) where, for example, the court said "the claims specify that the film is "substantially" eliminated and for the intended purpose, it is believed that the slight portion of the film which may remain is negligible. We are of the view, therefore, that the claims may be regarded as sufficiently accurate." Similarly, In re Hutchison, 104 F.2d 829, 42 USPQ 90, 93 (C.C.P.A. 1939) the court said "It is realized that "substantial distance" is a relative and somewhat indefinite term, or phrase, but terms and phrases of this character are not uncommon in patents in cases where, according to the art involved, the meaning can be determined with reasonable clearness."

Hence, for at least the forgoing reason, Applicants submit that it is improper for any examiner to hold as indefinite any claims of the present patent that employ any words of approximation.

Unless defined otherwise, all technical and scientific terms used herein have the same meanings as commonly understood by one of ordinary skill in the art to which this invention belongs. Preferred methods, techniques, devices, and materials are described, although any methods, techniques, devices, or materials similar or equivalent to those described herein may be used in the practice or testing of the present invention. Structures described herein are to be understood also to refer to functional equivalents of such structures. The present invention will now be described in detail with reference to embodiments thereof as illustrated in the accompanying drawings.

From reading the present disclosure, other variations and modifications will be apparent to persons skilled in the art. Such variations and modifications may involve equivalent and other features which are already known in the art, and which may be used instead of or in addition to features already described herein.

Although Claims have been formulated in this Application to particular combinations of features, it should be understood that the scope of the disclosure of the present invention also includes any novel feature or any novel combination of features disclosed herein either explicitly or implicitly or any generalization thereof, whether or not it relates to the same invention as presently claimed in any Claim and whether or not it mitigates any or all of the same technical problems as does the present invention.

Features which are described in the context of separate embodiments may also be provided in combination in a single embodiment. Conversely, various features which are, for brevity, described in the context of a single embodiment, may also be provided separately or in any suitable subcombination. The Applicants hereby give notice that new Claims may be formulated to such features and/or combinations of such features during the prosecution of the present Application or of any further Application derived therefrom.

References to "one embodiment," "an embodiment," "example embodiment," "various embodiments," "some embodiments," "embodiments of the invention," etc., may indicate that the embodiment(s) of the invention so described may include a particular feature, structure, or characteristic, but not every possible embodiment of the invention necessarily includes the particular feature, structure, or characteristic. Further, repeated use of the phrase "in one embodiment," or "in an exemplary embodiment," "an embodiment," do not necessarily refer to the same embodiment, although they may. Moreover, any use of phrases like "embodiments" in connection with "the invention" are never meant to characterize that all embodiments of the invention must include the particular feature, structure, or characteristic, and should instead be understood to mean "at least some embodiments of the invention" includes the stated particular feature, structure, or characteristic.

References to "user", or any similar term, as used herein, may mean a human or non-human user thereof. Moreover, "user", or any similar term, as used herein, unless expressly stipulated otherwise, is contemplated to mean users at any stage of the usage process, to include, without limitation, direct user(s), intermediate user(s), indirect user(s), and end user(s). The meaning of "user", or any similar term, as used herein, should not be otherwise inferred or induced by any pattern(s) of description, embodiments, examples, or referenced prior-art that may (or may not) be provided in the present patent.

References to "end user", or any similar term, as used herein, are generally intended to mean late stage user(s) as opposed to early stage user(s). Hence, it is contemplated that there may be a multiplicity of different types of "end user" near the end stage of the usage process. Where applicable, especially with respect to distribution channels of embodiments of the invention comprising consumed retail products/services thereof (as opposed to sellers/vendors or Original Equipment Manufacturers), examples of an "end user" may include, without limitation, a "consumer", "buyer", "customer", "purchaser", "shopper", "enjoyer", "viewer", or individual person or non-human thing benefiting in any way, directly or indirectly, from use of, or interaction, with some aspect of the present invention.

In some situations, some embodiments of the present invention may provide beneficial usage to more than one stage or type of usage in the foregoing usage process. In such cases where multiple embodiments targeting various stages of the usage process are described, references to "end user", or any similar term, as used therein, are generally intended to not include the user that is the furthest removed, in the foregoing usage process, from the final user therein of an embodiment of the present invention.

Where applicable, especially with respect to retail distribution channels of embodiments of the invention, intermediate user(s) may include, without limitation, any individual person or non-human thing benefiting in any way, directly or indirectly, from use of, or interaction with, some aspect of the present invention with respect to selling, vending, Original Equipment Manufacturing, marketing, merchandising, distributing, service providing, and the like thereof.

References to "person", "individual", "human", "a party", "animal", "creature", or any similar term, as used herein, even if the context or particular embodiment implies living user, maker, or participant, it should be understood that such characterizations are sole by way of example, and not limitation, in that it is contemplated that any such usage, making, or participation by a living entity in connection with making, using, and/or participating, in any way, with embodiments of the present invention may be substituted by such similar performed by a suitably configured non-living entity, to include, without limitation, automated machines, robots, humanoids, computational systems, information processing systems, artificially intelligent systems, and the like. It is further contemplated that those skilled in the art will readily recognize the practical situations where such living makers, users, and/or participants with embodiments of the present invention may be in whole, or in part, replaced with such non-living makers, users, and/or participants with embodiments of the present invention. Likewise, when those skilled in the art identify such practical situations where such living makers, users, and/or participants with embodiments of the present invention may be in whole, or in part, replaced with such non-living makers, it will be readily apparent in light of the teachings of the present invention how to adapt the described embodiments to be suitable for such non-living makers, users, and/or participants with embodiments of the present invention. Thus, the invention is thus to also cover all such modifications, equivalents, and alternatives falling within the spirit and scope of such adaptations and modifications, at least in part, for such non-living entities.

Headings provided herein are for convenience and are not to be taken as limiting the disclosure in any way.

The enumerated listing of items does not imply that any or all of the items are mutually exclusive, unless expressly specified otherwise.

It is understood that the use of specific component, device and/or parameter names are for example only and not meant to imply any limitations on the invention. The invention may thus be implemented with different nomenclature/terminology utilized to describe the mechanisms/units/structures/components/devices/parameters herein, without limitation. Each term utilized herein is to be given its broadest interpretation given the context in which that term is utilized.

Terminology. The following paragraphs provide definitions and/or context for terms found in this disclosure (including the appended claims):

"Comprising." This term is open-ended. As used in the appended claims, this term does not foreclose additional structure or steps. Consider a claim that recites: "A memory controller comprising a system cache . . . ." Such a claim does not foreclose the memory controller from including additional components (e.g., a memory channel unit, a switch).

"Configured To." Various units, circuits, or other components may be described or claimed as "configured to" perform a task or tasks. In such contexts, "configured to" or "operable for" is used to connote structure by indicating that the mechanisms/units/circuits/components include structure (e.g., circuitry and/or mechanisms) that performs the task or tasks during operation. As such, the mechanisms/unit/circuit/component can be said to be configured to (or be operable) for perform(ing) the task even when the specified mechanisms/unit/circuit/component is not currently operational (e.g., is not on). The mechanisms/units/circuits/components used with the "configured to" or "operable for" language include hardware—for example, mechanisms, structures, electronics, circuits, memory storing program instructions executable to implement the operation, etc. Reciting that a mechanism/unit/circuit/component is "configured to" or "operable for" perform(ing) one or more tasks is expressly intended not to invoke 35 U.S.C. sctn.112, sixth paragraph, for that mechanism/unit/circuit/component. "Configured to" may also include adapting a manufacturing process to fabricate devices or components that are adapted to implement or perform one or more tasks.

"Based On." As used herein, this term is used to describe one or more factors that affect a determination. This term does not foreclose additional factors that may affect a determination. That is, a determination may be solely based on those factors or based, at least in part, on those factors. Consider the phrase "determine A based on B." While B may be a factor that affects the determination of A, such a phrase does not foreclose the determination of A from also being based on C. In other instances, A may be determined based solely on B.

The terms "a", "an" and "the" mean "one or more", unless expressly specified otherwise.

Unless otherwise indicated, all numbers expressing conditions, concentrations, dimensions, and so forth used in the specification and claims are to be understood as being modified in all instances by the term "about." Accordingly, unless indicated to the contrary, the numerical parameters set forth in the following specification and attached claims are approximations that may vary depending at least upon a specific analytical technique.

The term "comprising," which is synonymous with "including," "containing," or "characterized by" is inclusive or open-ended and does not exclude additional, unrecited elements or method steps. "Comprising" is a term of art used in claim language which means that the named claim elements are essential, but other claim elements may be added and still form a construct within the scope of the claim.

As used herein, the phase "consisting of" excludes any element, step, or ingredient not specified in the claim. When the phrase "consists of" (or variations thereof) appears in a clause of the body of a claim, rather than immediately following the preamble, it limits only the element set forth in that clause; other elements are not excluded from the claim as a whole. As used herein, the phase "consisting essentially of" limits the scope of a claim to the specified elements or method steps, plus those that do not materially affect the basis and novel characteristic(s) of the claimed subject matter.

With respect to the terms "comprising," "consisting of," and "consisting essentially of" where one of these three terms is used herein, the presently disclosed and claimed subject matter may include the use of either of the other two terms. Thus in some embodiments not otherwise explicitly recited, any instance of "comprising" may be replaced by "consisting of" or, alternatively, by "consisting essentially of."

Devices or system modules that are in at least general communication with each other need not be in continuous communication with each other, unless expressly specified otherwise. In addition, devices or system modules that are in at least general communication with each other may communicate directly or indirectly through one or more intermediaries.

A description of an embodiment with several components in communication with each other does not imply that all such components are required. On the contrary a variety of optional components are described to illustrate the wide variety of possible embodiments of the present invention.

As is well known to those skilled in the art many careful considerations and compromises typically must be made when designing for the optimal manufacture of a commercial implementation any system, and in particular, the embodiments of the present invention. A commercial implementation in accordance with the spirit and teachings of the present invention may configured according to the needs of the particular application, whereby any aspect(s), feature(s), function(s), result(s), component(s), approach(es), or step(s) of the teachings related to any described embodiment of the present invention may be suitably omitted, included, adapted, mixed and matched, or improved and/or optimized by those skilled in the art, using their average skills and known techniques, to achieve the desired implementation that addresses the needs of the particular application.

It is to be understood that any exact measurements/dimensions or particular construction materials indicated herein are solely provided as examples of suitable configurations and are not intended to be limiting in any way. Depending on the needs of the particular application, those skilled in the art will readily recognize, in light of the following teachings, a multiplicity of suitable alternative implementation details.

An embodiment of the present invention may provide a temporary, do-it-yourself, clip-in hair extension system. Some embodiments may comprise pressure-sensitive hair clips attached to one side of a thin weft made of a mix of polymers comprising numerous synthetic or human hair strands inserted into or tied onto the opposite side of the thin weft from the clips. This system may enable a user to quickly and easily apply a hair extension solution that gives the appearance of longer and/or fuller hair without the employment of a professional hairstylist.

Figure 1B:
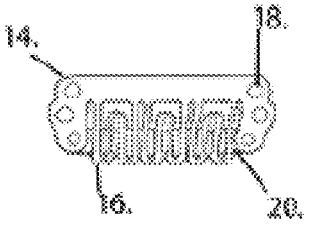
Figure 1C:
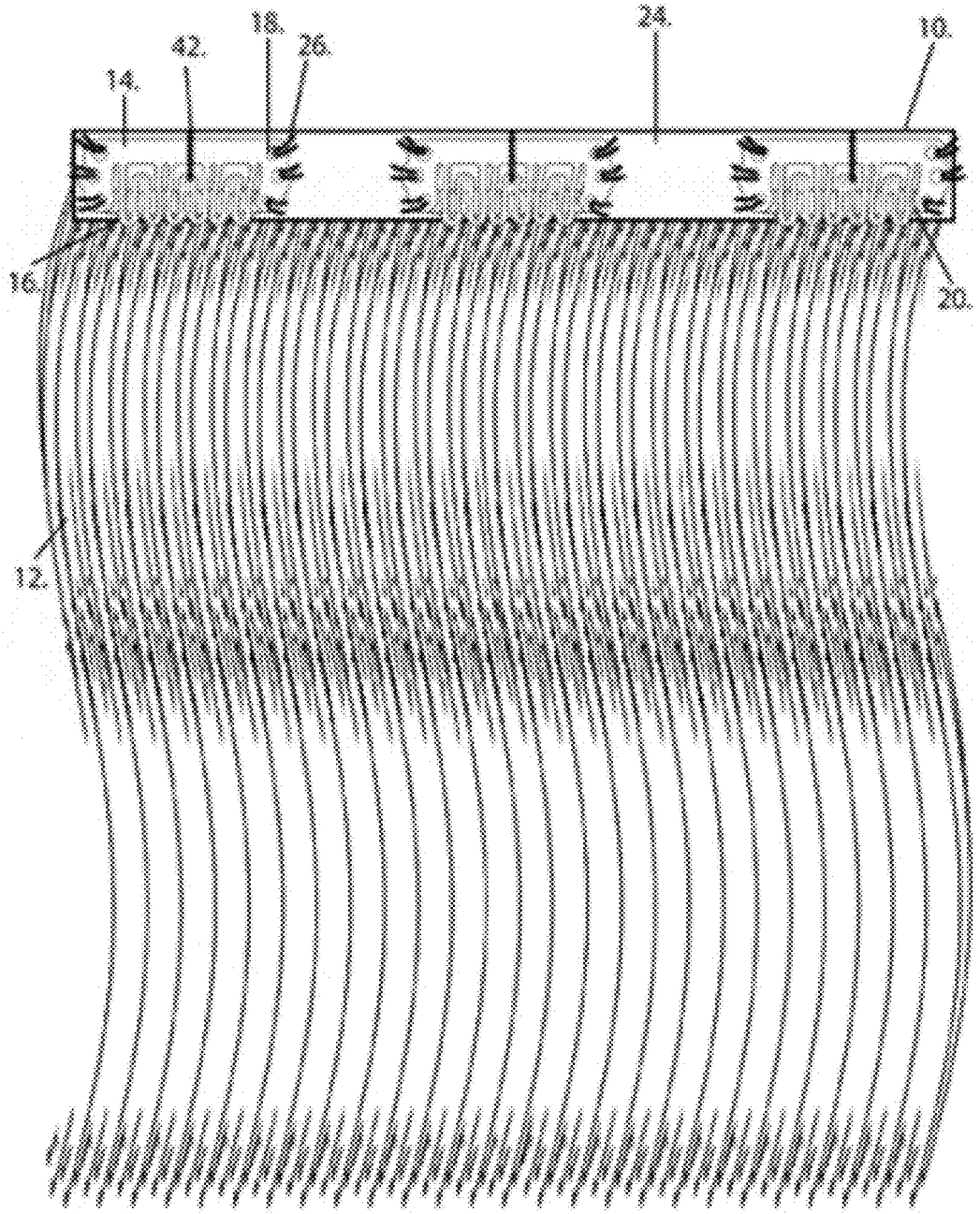

FIGS. 1A, 1B, and 1C illustrate exemplary elements of a temporary clip-in hair extension system, in accordance with an embodiment of the present invention. FIG. 1A is a diagrammatic front view of an exemplary weft 10. FIG. 1B is a diagrammatic front view of an exemplary clip 14, and FIG. 1C is a diagrammatic rear view of weft 10 with clip 14 attached. In the present embodiment, weft 10 may be formed as a thin strip made of one or more polymers such as, but not limited to, silicone, nylon, synthetic or organic rubber, polyurethane, synthetic or organic polymer, synthetic or organic plastic material, copolymers, thermoplastic polyurethane, thermosetting polymer, elastic polymer, etc. Weft 10 may also contain, without limitation, additives to achieve the desired thickness, thinness, bendability, transparency, opaqueness, shine and/or color, etc. or other feature of weft 10. The material of weft 10 may be flexible to typically enable weft 10 to conform to the user's head shape and lie flat against the scalp. Those skilled in the art will readily recognize, in light of and in accordance with the teachings of the present invention, that a multiplicity of suitable flexible, elastic, or non-flexible materials may be used to form the thin weft including, without limitation, plastic or wire mesh, natural or synthetic fabrics, monofilament, thin skin, silicone, cord, braided or woven strands of hair, etc. In some embodiments the weft may be made of a somewhat stiffer material for added strength. In the present embodiment, weft 10 may typically be lightweight and may be created in a variety of thicknesses, lengths, widths, and shapes and is typically not limited to the quantity, thickness, width, length, and arrangement demonstrated in the exemplary drawings. For example, without limitation, longer wefts may be implemented for application near the back of a user's head while shorter wefts may be implemented for application near crown of the head or the hairline. Thin weft 10 may be easily cut if necessary without concern for unraveling. However, it may be unnecessary to cut weft 10 as the extensions are usually provided to the user or hairstylist as completely assembled finished products in a variety of thicknesses, widths, lengths and shapes. Thus, users and hairstylist typically do not need to be concerned with creating their own clip-in hair extensions and the inconveniences of doing so including, without limitation, the risk of embarrassment if the handmade clip-ins fall out unexpectedly or become visible to others, uncertainty in their ability, the loss of valuable time, etc.

It is contemplated that weft 10 may be made in a variety of different colors to disappear or to blend into the natural hair of a user. For example, without limitation, weft 10 may be transparent or may be opaquely or translucently colored to match the flesh tone of the user, which may enable hair strands 12 attached to weft 10 to appear like natural hairs growing from the user's scalp. In other applications weft 10 may be the same color as the user's hair or strands 12, which may cause the user's natural hair to appear fuller at the roots. Typically, weft 10 is not visible regardless of whether weft 10 is configured to match the user's scalp or hair or is transparent since weft 10 is usually held flat against the user's head near the roots of the user's natural hair allowing the strands 12 to blend with the user's natural hair near the roots.

In some embodiments, weft 10 may be created in different shapes dependent upon the intended position and effect of the invention that is desired. In some embodiments weft 10 may be configured as a circle, triangle, square, rectangle, etc. In other embodiments, shapes of weft 10 may be configured as to include, but are not limited to, curved wefts, semicircular wefts, irregular circular wefts, s-shaped wefts, v-shaped wefts, wave wefts, irregular shaped wefts, etc. In some embodiments, multiple thin wefts may be combined to create any shape or configuration of weft 10 for example, without limitation, triangular, rectangular, circular, square, semicircular, irregular circle, irregular shapes, etc.

In some embodiments, the density of weft 10 may be 50% flatter or more than the sewn wefts currently sold on the market to create clip-in hair extensions. However, the density of weft 10 may vary depending upon the user's needs. In a non-limiting example, thinner density thin wefts may be used within the teachings of the invention for application to users with extremely thin hair. The density of weft 10 may also vary within an assembled package of multiple hair extensions. In a non-limiting example, the slimmest thin wefts can be positioned along the sides, temples, top, or crown areas of the user's head and normal density thin wefts used in the crown, back and nape areas. Weft 10 density may also differ within a shape configuration created with a single thin weft or multiple thin wefts. In a non-limiting example, if one or more thin wefts are configured as a circle, the slimmest thin weft(s) can be located at the top of the circle near the top or crown areas for user's to accommodate thin hair in these areas of the user's head with normal sized thin wefts located at the bottom of the circle in the back where the user's hair maybe thicker. Regardless of the density, wefts 10 may be 50% flatter or more than the current sewn wefts on the market, which may be a better option for those seeking increased length and/or volume with clip-in hair extension that have a natural appearance and not easily felt or revealed with the user's natural hair is move voluntarily or involuntarily.

In the present embodiment, weft 10 comprises numerous synthetic or human hair strands 12 that may be inserted or tied to a front side 22, of thin weft 10. The polymer(s) material, with or without additives, may be cured around the human or synthetic hair strands to create the desired thickness or density as well as bendability, color, length, width and shape of the thin weft(s) 10. Alternatively a sheet of the polymer(s) material, with or without additives, may be prepared and fully cured in advanced with the desired thickness or density as well as bendability, color, length, and width which may allow the hair strands 12 to be inserted or tied into the sheet of the polymer material and then strips of the polymer material may be cut according to the desired quantity, width, length, and/or shape needed to form the thin wefts 10. Alternatively the polymer material may be cut into a specific quantity, length, width, and/or shape needed prior to inserting or tying the human or synthetic hair strands to the material. It may be also optional to insert or tie human or synthetic hair strands along the edges and sides of the polymer strips depending upon the desired look and function. It is believed that by injecting or securely tying hair strands 12 into thin weft 10, shedding of hair strands 12 may be greatly minimized or eliminated as compared to sewn wefts. Unlike the current clip-in hair extensions on the market, the hair strands are not bound together by thread which may loosen with tension caused by daily hair maintenance and styling as well as time and usage. The hair strands in the present invention may be securely attached to a solid polymer material where they may not experience loosening of the strands due to a weakened polymer material after tension is applied to the hair as well as usage or time. This may be due to the fact, that once the polymer is formed it cannot melt and is not easily damaged. Therefore it may be extremely difficult to pull the human or synthetic hair strands inserted or tied securely to the polymer material out of the thin weft thereby greatly reducing if not eliminating hair shedding with the invention. In addition, weft 10 in the present embodiment is typically not coated with adhesive, which may help enable weft 10 to maintain flexibility and conform to the shape of the user's head. Weft 10 may be configured to hold a large number of hair strands 12 to equal the density of several individual conventional wefts that are sewn together with thread without the problems of thickness and bulkiness. Thereby fewer thin wefts 10 may be required to create the desired volume and length while at the same time allowing for the hairs attached to the thin weft to be evenly distributed for a natural look. Human or synthetic hair strands 12 may be available in a multitude of different lengths, hair weights or volume, colors, textures, highlights, lowlights, etc. For example, without limitation wefts 10 may comprise hair strands 12 in a variety of textures suitable for all ethnicities of users. This may enable the user to select their desired texture for easy blending with their natural hair to create the desired hairstyle from straight, wavy, relaxed straight, kinky straight, curly, kinky curly, etc. The availability of strands 12 in various textures may also reduce styling time for the user as they typically do not need to manipulate the texture of hair strands 12 to match their natural hair. Moreover, hair strands 12 may also be available with various different hair color techniques such as, but not limited to, ombre, reverse ombre, somber, color melt, ecaille, chunky highlights, chunky lowlights and other past, current and future hair color trends without the financial and time investment of employing a professional hairstylist to provide a hair color technique that can be costly initially and costly to maintain.

Referring to FIGS. 1B and 1C, pressure sensitive clips 14 comprise a row of downward facing teeth 16, up to three holes 18 on each side, and a base 20 beneath teeth 16, which may be covered by a polymer material. This polymer material may enhance the grip of clips 14 on the user's natural hair as clips 14 may serve as the point of attachment of weft 10 to a user's natural hair. In addition, the polymer material may also prevent friction and slippage between the base of the clip and the user's natural hair strands, thereby protecting the hair strands from damage while the clips are inserted into the user's natural hair. It is contemplated that some embodiments may incorporate pressure sensitive clips that do not have to have a polymer material covering the base beneath the teeth, and other embodiments may incorporate alternate means for adding to the grip of the clip including, without limitation, textured surfaces, fabric surfaces, velvet coverings, plastic surfaces, nylon, silicone, tacky surfaces, etc. In the present embodiment, clips 14 may typically be opened and closed by applying pressure on the sides of clips 14 so that teeth 16 pop up and away from base 20 in the open position and or snap back toward base 20 in the closed position. Clips 14 may be opened and closed repeatedly, typically enabling the user to install and remove the extension when needed or desired. In some contexts pressure sensitive clips may also be referred to as clip attachments, pressure sensitive wig clips, wig clips, hair clips, wig clip attachments, snap clips, etc. The clips may be created with any suitable material such a metal, plastic, silicone, polymer, nylon or any type of synthetic or organic material that will enable the clip to attach securely to the user's natural hair In the present embodiment, clips 14 are typically small, which may help to enable clips 14 to lie flat and secure against the user's head near the roots of their natural hair as small clips 14 typically grab the most amount of hair for a secure and flat hold. Small clips may have less surface area than large clips and smaller teeth than large clips resulting in a secure hold to the user's natural hair. Small clips may grab the most hair near the roots of the user's natural hair securely due to the fact that the teeth of the small clip are smaller than large clips and may therefore "scoop" more hairs close to the natural hair roots of the user into the area between the teeth and the polymer material surrounding the base of the small clip before popping into a closed position as opposed to large clips. In a non-limiting example, when the maximum amount of the user's natural hair is sandwiched between the closed position of the teeth of the small clip and the polymer material around the base of the small clip, the user may not experience slippage of the clips when tension is applied to the hair extension. As a result, the user's natural hair near the roots may be enclosed securely within the limited surface area of small clips until the user is ready to remove the hair extension. Small clips may work well for all hair densities. However, small clips may be ideal for users with thin or short hair for this very reason as the small teeth of small clips may grab or "scoop" the maximum amount of natural hair near the user's roots. Large clips have a large surface area and larger teeth. The large teeth of the large clips may not grab as many hairs as the small clip near the natural hair roots of the user because the teeth of the large clips cannot "scoop" a enough hair strands of the user's natural hair for a secure hold when the teeth are in a closed position, especially if the user's natural hair is thin in density. Therefore, fewer hairs are held between the teeth of the large clip and the polymer material along the base of the large clip when the clip is popped into a closed position. Especially if the use has thin or short hair. As a result, the clip may easily slide down the user's natural hair when tension is applied to the hair extension. However, large clips maybe preferred by users with thick hair as their hair density is thick at the natural hair roots, allowing the teeth of large clips to grab a sufficient amount of hair strands to create a secure hold of the clip onto the user's natural hair near the roots. As a result, the position of thin weft 10 is typically flat against the user's head near the roots of their natural hair allowing hair strands 12 to easily blend with the user's natural hair near the roots. The small pressure sensitive hair clips 14 typically can collect enough natural hair near the hair roots to allow for a secure and flat hold of weft 10 even if the consumer has thin or short hair. It is contemplated that clips in some embodiments may be made in various different sizes or colors. For example, without limitation, larger clips may be preferred by users that have thick hair. Also, clips may be colored to match the skin tone of the user or to match the color of the hair strands attached to the thin weft or match the color of the user's natural hair. In other embodiments the clips may be transparent. In some embodiments, the clips may be slightly curved to better conform to the shape of the user's head. In some embodiments, the clips can also be an irregular shape to meet fashion trends or to satisfy other cosmetic purposes. Clips of any shape or size maybe used in the present invention as long as the clips grip the user's natural hair securely. Clips may also contain one to three holes or more. Clips with zero holes may also be attached to the thin weft by secure means, such as but not limited to, permanent adhesive resistant to oil or other means of attachment. The holes of the clips may also appear seamless or invisible with the suitable materials connecting the clips to the thin weft that would achieve such an effect. The clips may be attached to the thin weft by any means as long as the means of attachment is secure.

In the present embodiment, the use of clips 14 as the point of attachment may enable a user to install and remove hair extensions without a messy and time consuming removal process similar to the process required when removing hair extension systems that utilize adhesive as the point of attachment since no adhesive is typically used in the installation of the present embodiment. Also, oil secreted from the scalp and oil ingredients found in hair care or hair styling products typically do not affect the grip of clips 14, as can be the case with extensions attached with adhesives. Furthermore, clips 14 are usually quick and easy to install and remove without employing a hairstylist, unless the user select's to do so, which may save the user money in addition to time. Those skilled in the art will readily recognize, in light of and in accordance with the teachings of the present invention, that a multiplicity of suitable clip attachments other than pressure sensitive hair clips may be used in some embodiments such as, but not limited to, wig clips or hair clips that are not pressure sensitive but display a top bar and teeth that may be closely or widely spaced, hairpins, bobby pins, combs, alligator clips, claw clips, etc.

Referring to FIG. 1C, an underside 24 of thin weft 10 may comprise a smooth surface with no hair. Clips 14 that are well secured to weft 10 typically hold weft 10 flat to the head near the roots of the user's natural hair since a secure attachment may help prevent movement of thin weft 10 away from clips 14. As a result, strands 12 can move in a similar manner as the natural hair near the roots. In the present embodiment, clips 14 may be sewn to thin weft 10 with thread 26, or other attachment material such as, but not limited to, elastic thread, monofilament, chord, synthetic hair, natural hair, or nylon through holes 18 on each side of clips 14. In the present example, all holes 18 of each clip 14 are used for sewing clips 14 to weft 10. It is contemplated that in some applications fewer holes may be used. In some embodiments the clips may comprise more or fewer than three holes on each side, all of which may or may not be used to sew or otherwise attach the clips to the thin weft. In some embodiments, the clips may also contain no holes and still may be attached to the thin weft with a material such as permanent adhesive resistant to oil. Optionally, a middle section 42 of each clip 14 may be sewn to underside 24 of thin weft 10 as shown in the present embodiment. However, in some applications middle section 42 may be left unattached from weft 10. In some applications, base 20 of each clip 16 may be optionally sewn to weft 10, not shown. Those skilled in the art will readily recognize, in light of and in accordance with the teachings of the present invention, that clips in some embodiments may be attached by means other than sewing including without limitation inserting a tack or tack-like bead with or without a backing into the hole(s) of the clip and into the thin weft, permanent adhesive intended to maintain a strong bond between the clip and the thin weft even when being exposed to oils, hook and loop material, metal or plastic snaps, metal or plastic clasps, etc. on the thin weft and the underside of the clips to make the clips detachable from the thin weft, etc. In some embodiments, the clips may also be attached with a rivet or eyelet that is inserted through the holes of the clips into the thin weft. The rivet or eyelet maybe secured with or without a cap, backing or washer. Any suitable rivet or eyelet with or without a cap, backing and/or washer may be used such as, but not limited to, a tubular rivet, eyelet rivet, crystal rivet, clear rivet, plastic rivet, plastic push snap rivet, snap rivet, snap rivet with hole, compression rivet, solid rivet, split rivet, etc. depending on the desired finished appearance. In some embodiments, the rivet or eyelet may even have the appearance of jewelry or contain a jewel like object in the center of the head or bottom as long as it securely fastens the clip attachment to the thin weft. In some embodiments, the clips may also be attached to the thin weft with clasps, chain, wire, screws with or without a backing, screws with or without a washer, etc. In some embodiments, other materials that maybe used to attach the clips to the thin weft may include, without limitation, suede lace, leather strips, waxed cotton cord, silk ribbon, silk string, flexible wire, satin cord, organic cotton string, cotton string, elastic cord, plastic cord, nylon thread, pleather cord, sheer ribbon, metallic ribbon, soft glass tubing, silk cord, French wire, etc.

In some alternate embodiments, the clips or other attachment means may be molded directly into the weft during manufacturing. In the present embodiment, clips 14 may be sewn or otherwise attached in alignment with or just below the top portion of thin weft 10 so that clips 14 are typically not visible when the extension is attached to the user's hair. It is contemplated that the number of clips attached to the weft in some embodiments may vary depending upon factors such as, but not limited to, the width, shape or length of the thin weft, the length of the hair strands coming from the weft, the thickness or quantity of the hair strands, the size of the clips, etc. In some embodiments, the number of clips attached to the thin weft may also be determined by how much resistance is desired against tension applied to the add-on hair from pulling voluntarily or involuntarily caused by instances such as styling, daily wear, etc.

Figure 2A:
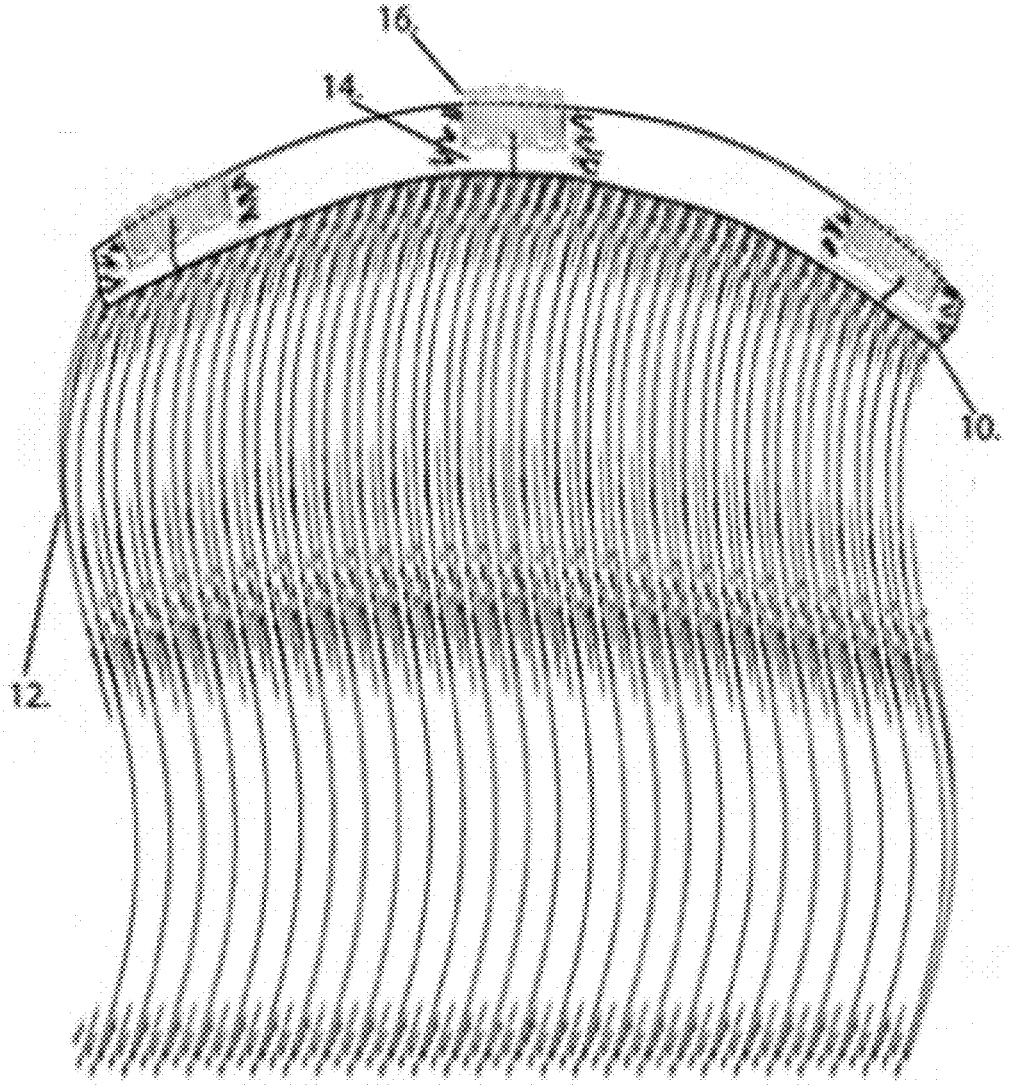
FIGS. 2A through 2D illustrate an exemplary method for attaching a temporary clip-in hair extension system, in accordance with an embodiment of the present invention.
Figure 2B:
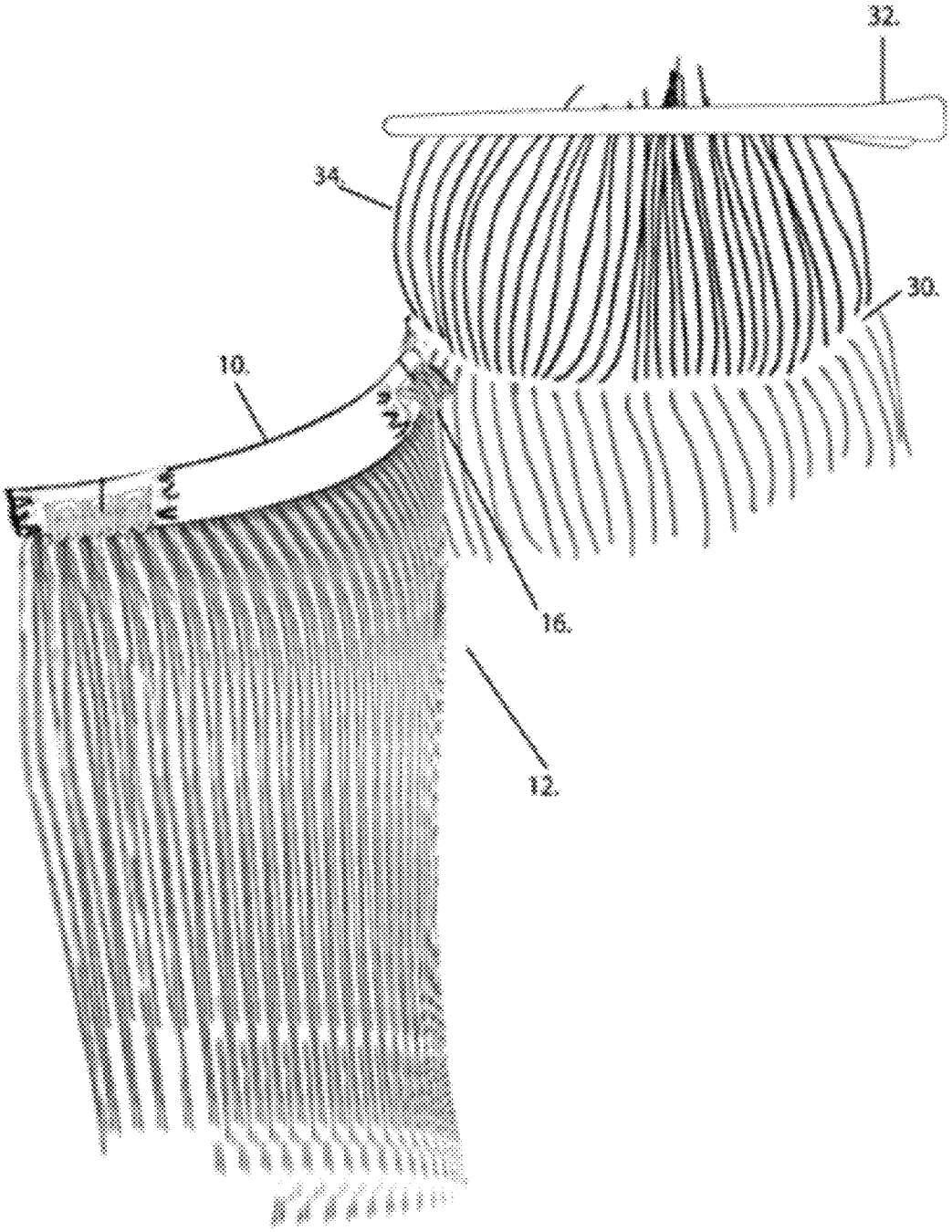
Figure 2C:
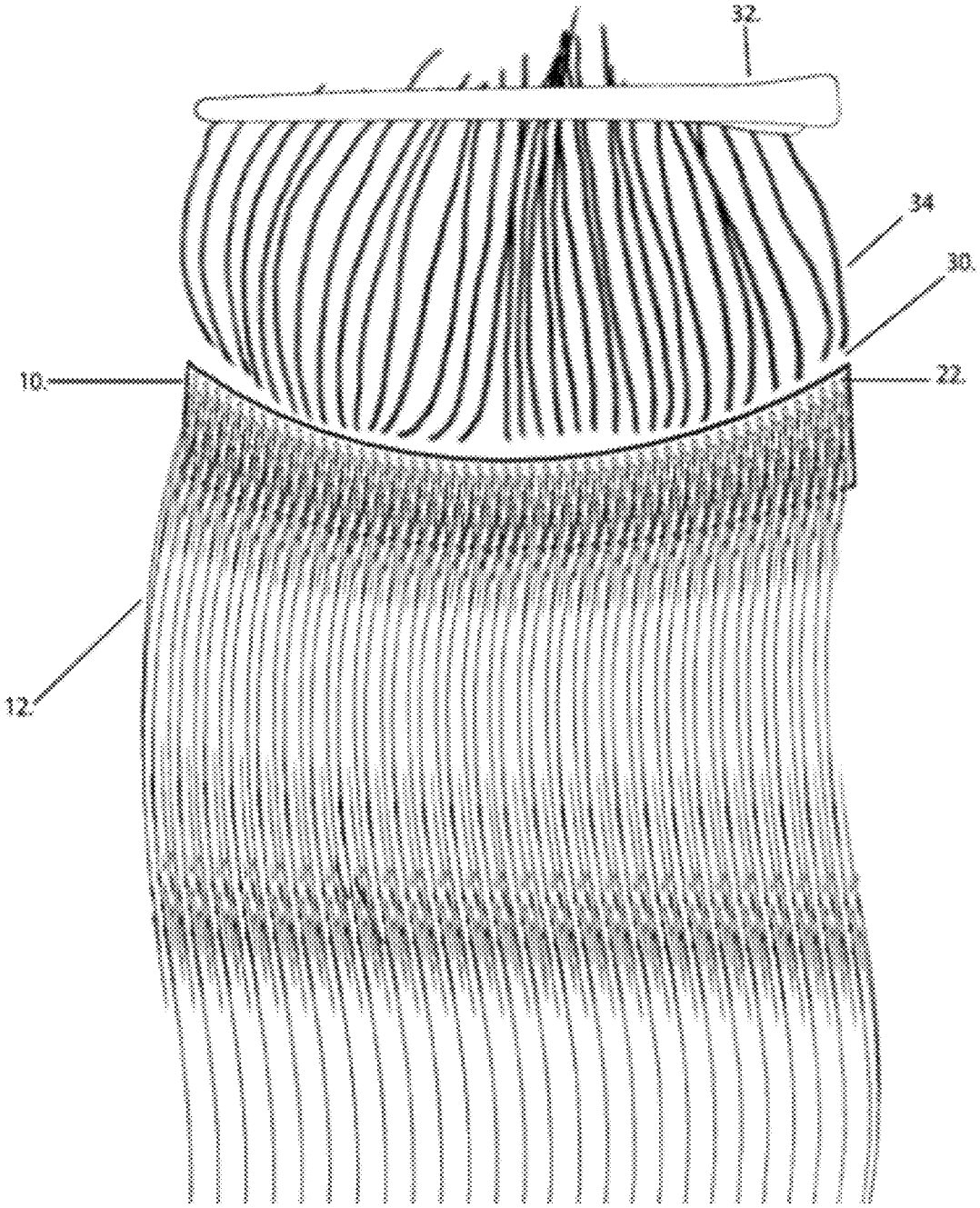
Figure 2D:
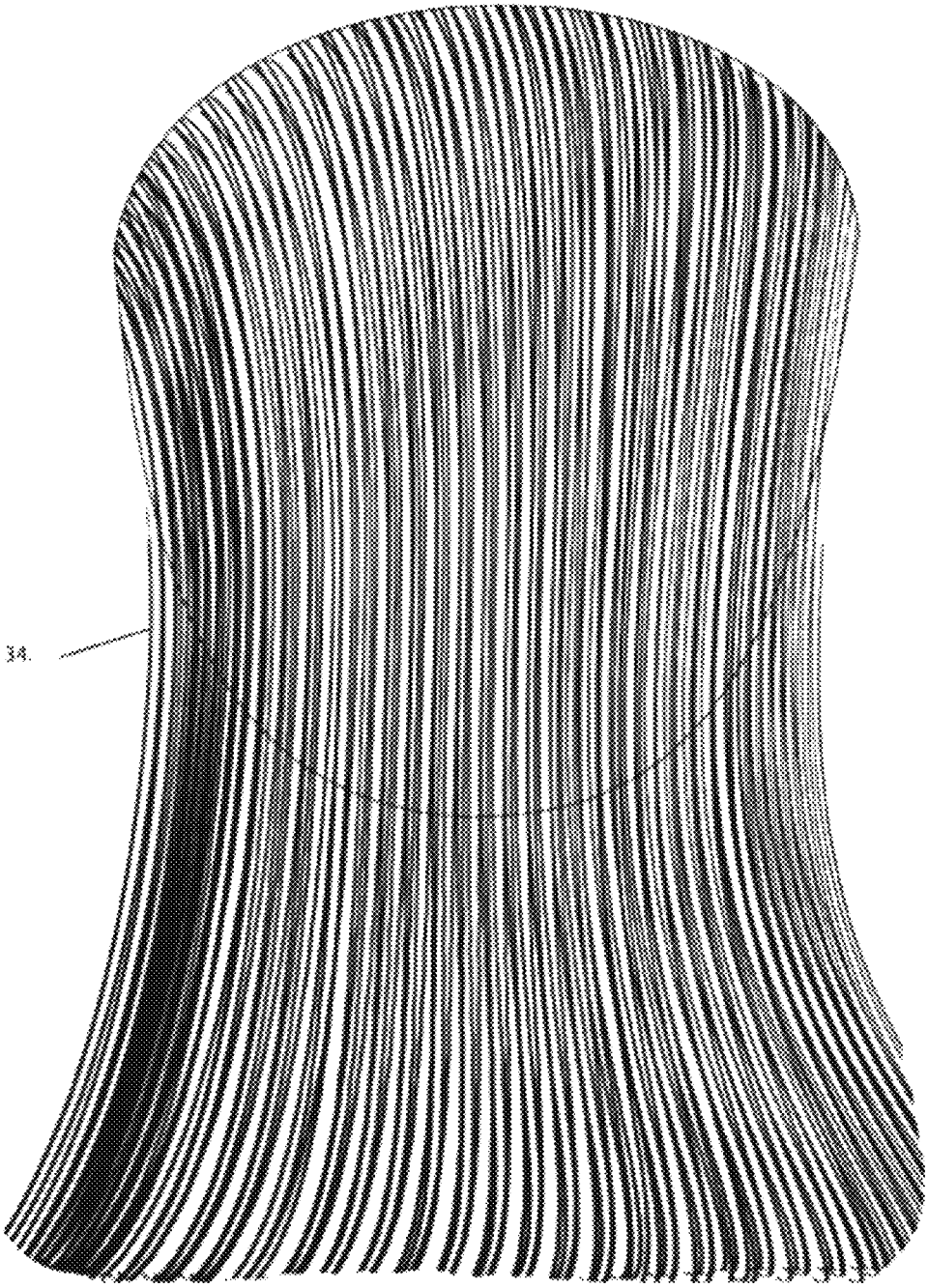

FIGS. 2A through 2D illustrate an exemplary method for attaching a temporary clip-in hair extension system, in accordance with an embodiment of the present invention. FIG. 2A is a diagrammatic rear view of the hair extension prior to application. FIG. 2B is a front perspective view of the hair extension during application. FIG. 2C is a diagrammatic front view of the hair extension after application, and FIG. 2D is a diagrammatic front view of the hair extension blended into the user's natural hair. In the present embodiment, the hair extension comprises three pressure sensitive clips 14 attached to a thin weft 10. In some embodiments, the underside of the thin weft may be covered with a colored, transparent, or opaque material such as, but not limited to, lace, stretch lace, stretch material, elastic, latex mesh, hook and loop material, nylon, monofilament, thin skin, silicone, or other lightweight woven or polymer material that is sewn or otherwise attached to the thin weft before the clip attachments are added. In some embodiments, the purpose of applying the lightweight material to the thin weft before clips may be purely cosmetic. In some embodiments, another reason to apply the lightweight material to the thin weft before clips may be to conceal the underside of the thin weft. Also, a light covering of the underside of the thin weft may provide enhanced blending of the thin weft with the user's hair or scalp. Alternatively, a lightweight material may be applied to showcase an inscribed label or logo. The thin weft may not be easily damaged but in the case of prolonged exposure to extremely high heat from a styling tool, the lightweight material may provide light protection against accidental damage. Other non-lighting examples of lightweight materials that may be used to cover the underside of the thin weft such as, without limitation, rubber, plastics, nylon, silicone, moleskin, suede, an additional polymer or polymer mix, etc. to meet ones needs for cosmetic appearance or enhanced function. In the following description detailing an exemplary method for installing a hair extension the individual who is attaching the extension is referred to as an installer. The installer may be the user wearing the extension or another individual such as, but not limited to a hairstylist. Referring to FIG. 2A to attach the extension according to the present embodiment, an installer first flips the top of thin weft 10 up so that teeth 16 of clips 14 are pointing in a generally upwards direction. The installer may then place their thumbs under clips 14 on top of hair strands 12 attached to the front side of thin weft 10 to press clips 14 into an open position. It is contemplated that the clips may be opened at different points in the attachment process and by using various different means. For example, without limitation, the installer may open clips 14 from the underside of weft 10 by pushing the sides of clips 14 away from himself while pushing the middle section of the clips toward himself.

Referring to FIG. 2B, the installer creates a hair part 30 in the user's natural hair 34 at the desired location to guide the installation of clips 14 and in order to create the desired hairstyle. Then the installer secures the user's natural hair 34 above part 30 with a tool 32 such as, but not limited to, a standard hairclip, bobby pins, hair tie, hair band, claw clip, alligator clip, or another tool 32 to help keep the user's natural hair 34 positioned away from the part. The installer may then attach thin weft 10 to hair 34 by inserting teeth 16 of an open clip 14 into hair part 30 near the roots of natural hair 34 but not directly on the scalp. The teeth of the clips may come in contact with or brush against the user's scalp while grabbing or "scooping" the user's natural hair near the roots within the clip. But, the clips should not be attached directly to the user's scalp with materials such as adhesive or glue to avoid scalp damage and hair root damage. Instead the teeth of the hair clips may grab the maximum amount of hair strands near the roots of the user's natural hair while the clip is in an open position and being inserted into the user's natural hair near the roots. After the clip is pressed closed, the clip may lay flat against the wearer's head inclusive of the wearer's natural hair near the roots and scalp without direct attachment of the clips to the user's scalp with adhesive or glue thereby avoiding scalp damage and hair root damage such as bald spots or bald patches. The installer may secure clip 14 in this location by pressing the sides of clip 14 from the front side of thin weft 10 toward the user's head in order to close clip 14 onto the user's natural hair near the hair 34 roots. Then the installer may repeat this attachment step for all of the other clips 14 on weft 10. In the present embodiment, weft 10 may be substantially straight along the top edge, which may enable weft 10 to be easily aligned with part 30 made to guide the installation of the extension even some cases where the installer does not have a clear view of all angles of the user's head. Clips 14 typically only need to be inserted into a small section of the user's natural hair 34 near the roots for a successful installation. In some alternate embodiments, the clips may be configured to be inserted into a larger section of natural hair. In some applications, the installer may optionally choose to twist or braid the section of natural hair to which the clips will attach prior to inserting the clips into the user's natural hair, which may add to the security of the hold.

Referring to FIG. 2C, once the extension is properly installed synthetic or human hair strands 12 in the front side of thin weft 10 face away from the user's head while clips 14 typically remain hidden beneath thin weft 10. Referring to FIG. 2D, the installer may release the user's natural hair 34 from tool 32 to cover the top portion of the extension. To finish the look, the installer may comb the user's natural hair 34 over the extension or otherwise style natural hairs 34 and strands 12. In the present embodiment, hair strands 12 may be attached to the front side of thin weft 10 in a manner that may enable strands 12 to experience movement above the insertion points closely matching the appearance and movement of the user's natural hair 34 near the roots. This and the hidden clips 14 may make the top portion of the extension practically imperceptible even if the user's natural hair 34 moves or if the user runs their fingers through their hair. Typically, the user may only feel hair strands 12 on the front side of thin weft 10 as they run their fingers through their hair. Additionally, extensions in accordance with the present embodiment may be more imperceptible and natural looking for users with thin or short hair than current systems comprising sewn wefts as such approaches may become bulky and may be easily seen or felt, particularly in users with thin or short hair. It is contemplated that some embodiments of the present invention may enable a user with thin hair or short hair to install clip-in hair extensions near the crown or hair line with less detection as the system may be less visible than traditional weft and thread systems.

In one exemplary application multiple clip-in hair extensions may be evenly distributed throughout the user's natural hair including, without limitation, near the back, nape, sides, hairline, temples, and crown to create a customized natural look for the user's head shape with the desired length, hair weight, volume, texture, and color from the thin weft, where the hair strands may easily blend with the user's natural hair near the roots, and throughout the length of the add-on hair. Due to the ability to evenly distribute the add-on hair throughout the user's natural hair, the ends of the hair strands typically appear layered and natural once inserted into the consumer's natural hair, typically without the need for a wave formation at the ends of the hair strands. Moreover, the lightweight nature of some embodiments may enable the extension system to feel buoyant and comfortable even when multiple clip-in hair extensions are installed in the user's natural hair. In other exemplary applications, the user may not be limited to style options determined by a fixed placement and fixed hair direction of the hair extensions systems. Those skilled in the art will readily recognize, in light of and in accordance with the teachings of the present invention, that users may be able to create limitless hair styles with various embodiments of the present invention including, without limitation, side ponytails, high ponytails, bangs, side bangs, up do's, etc. since an aspect of the present embodiment is to typically enable the extensions to be removed, replaced, and repositioned as needed to create hairstyles that may require the extensions to be positioned in different locations and directions within the user's natural hair. Current systems including, without limitation, adhesive based systems and those utilizing micro beads may not provide the user with a large range of style options since the typically fixed attachment positions of these systems may become visible by others when the extensions or the natural hair around the extensions are shifted. The consumer can also wear clip-in hair that is the desired hair weight. Additionally, the easy removal and application of extensions according to some embodiments may enable a user to change their hairstyle multiple times a day. For example, without limitation, a user could select extensions with a light hair weight for daytime and office wear that will give them just enough length and volume suitable for a professional environment. Then, the user may remove those extensions and replace them with extensions with a heavier hair weight for evening wear that provides the desired length and volume to stand out subtly or significantly. In some embodiments, one may also add changes to the user's natural hair color without a long term commitment or expensive salon visits. In a non-limiting example, the invention may be used to enhance or decrease the depth of one's natural hair color. Alternatively, one may use the invention to add a hair color, highlights, lowlights, single strand highlights or low lights, or to create hair color trends such as, but not limited to, ombre, somber, color melt, ecaille, hair painting or other current, past, future hair color trends without the investment or commitment to a permanent hair color change created by a hairstylist. In some applications temporary clip-in hair extensions according to some embodiments may enable a user to install decorative extensions without a long term commitment, for example, without limitation, hair extensions for providing fantasy colors such as, but not limited to, red, blue, green, silver, etc. or other types of fantasy hair including, without limitation, printed hair, hair feathers, hair gems, hair crystals, tinsel hair, etc.

Those skilled in the art will readily recognize, in light of and in accordance with the teachings of the present invention, that some embodiments may be configured to form particular types of hair enhancement devices such as, but not limited to, clip-in bangs, clip-in side bangs, clip-in ponytails, clip-in volumizers, clip-in part, clip-in falls, clip-in hair band, clip-in band falls, clip-in fashion band, clip-in closures, clip-in lace front closures, clip-in lace frontals, clip-in silk closures, clip-in monofilament closures, clip-in monofilament lace frontals, clip-in half wigs, clip-in partial wigs, clip-in ¾ wigs, clip-in u-part wigs, clip-in v-part wigs, clip-in wigs, etc. Some embodiments of the invention may also be configured as a multi-layered clip-in hair extension which may be irregularly or regularly shaped. Other lightweight materials such as fabric materials, woven materials, lace, thin skin, monofilament, polymer materials, silicone, nylon, chord, stretch materials, stretch lace, elastic, rubber, latex, etc. can be incorporated within the invention to create the aforementioned products. In a non-limiting example, the invention may be used in a u-part wig by lining the border of the u-part wig for seamless integration between the user's natural hair and the human or synthetic hair strands attached to the invention with the center cap made of multiple thin wefts or other lightweight material such as, but not limited to, monofilament, lace, thin skin, stretch lace, stretch material, etc. and the optional additional of adjustable straps in the nape area.

Figure 3A:
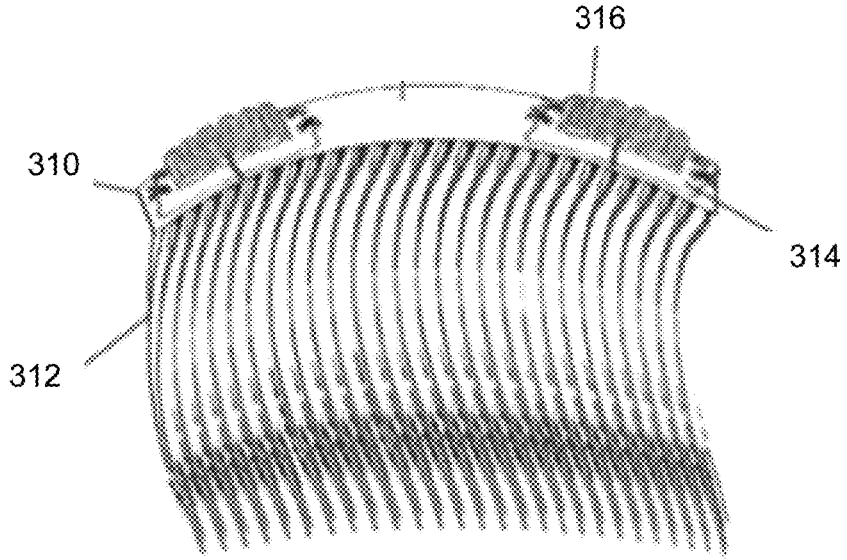
FIGS. 3A, 3B, and 3C illustrate an exemplary clip-in bang extension, in accordance with an embodiment of the present invention.
Figure 3B:
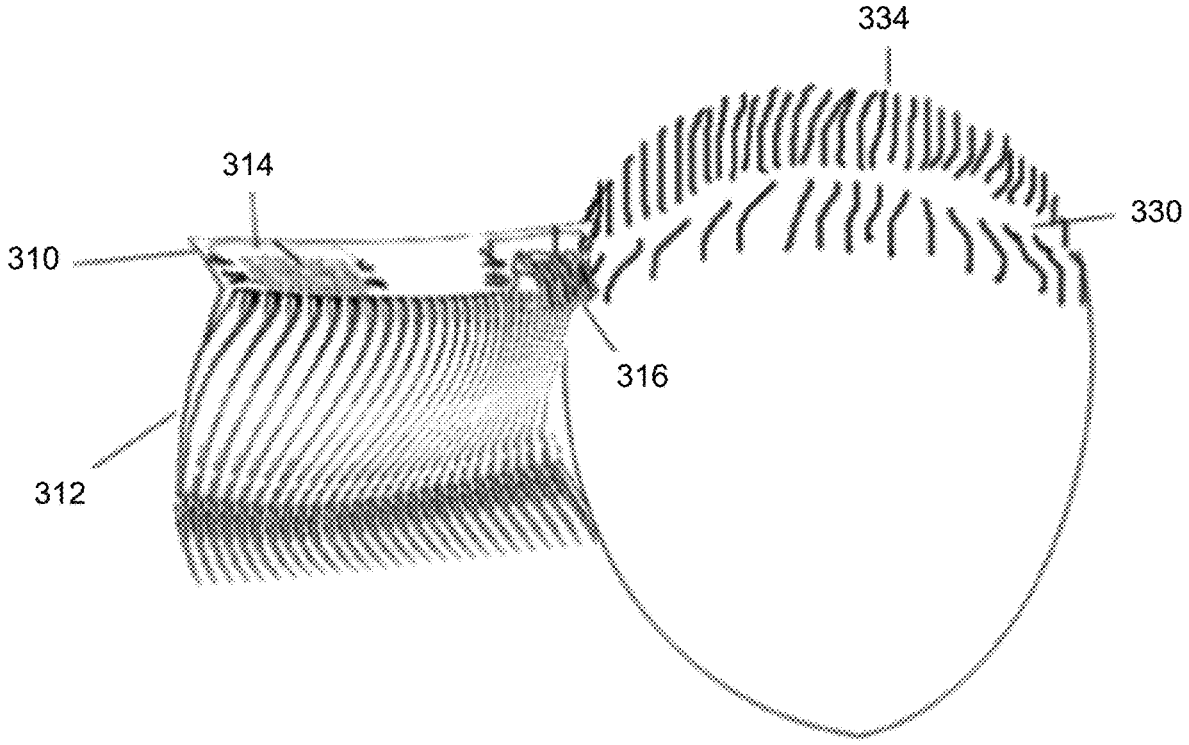
Figure 3C:
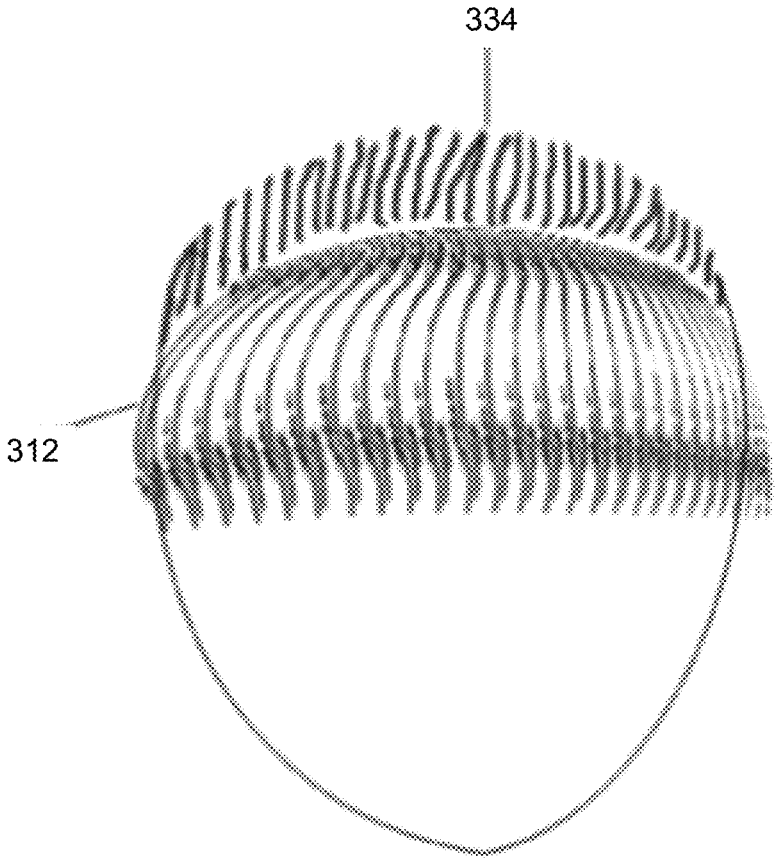

FIGS. 3A, 3B, and 3C illustrate an exemplary clip-in bang extension, in accordance with an embodiment of the present invention. FIG. 3A is a diagrammatic rear view of the clip-in bang extension. FIG. 3B is a front perspective view of the bang extension during application, and FIG. 3C is a diagrammatic front view of the bang extension after application. In the present embodiment, the bang extension comprises a thin weft 310 with two pressure sensitive clips 314 attached to an underside of weft 310 and synthetic or natural hair strands 312 inserted or tied into a front side of weft 310. The bang extension and may be attached to a user's natural hair 334 in a manner similar to that describe by way of example in accordance with FIGS. 2A through 2D. Referring to FIGS. 3A and 3B, an installer opens pressure sensitive clips 314 so that teeth 316 on clips 314 may be raised from the surface of weft 310 to the open position. Then the installer may create a part 330 at the desired location within the user's natural hair 334 to guide the installation of the clips 314. The installer may secure the user's natural hair 334 away from the part 330 with a hairclip, alligator clip, hair band or other hair styling tool. Referring to FIG. 3B, the installer may then attach thin weft 310 by inserting the teeth 316 of open clips 314 into a part 330 created in the user's natural hair 334 near the roots but, not on the scalp. The installer presses both sides of each clip 314 from the front side of thin weft 310 towards the user's head to securely close clips onto the user's natural hair 314. Referring to FIG. 3C, if desired, the installer may then comb the user's natural hair 334 over a portion of the extension or otherwise style the extension and/or natural hair 334 to finish the look. In this example, a differently sized clip-in hair extension is installed so that strands 312 lie in a different position and angle from natural hair 334 rather than in the same direction as natural hair 334, from the example illustrated by way of example in FIG. 2C.

Some embodiments may provide multi-layered clip-in hair extensions. In such embodiments multiple thin wefts may be linked together in a wide range of different arrangements. In many of these embodiments, the wefts may comprise human or synthetic hair strands connected to the front side of the thin weft and clip attachments connected to the underside of the thin weft. The multiple thin wefts may vary in thickness, width, length, and shape to create hair pieces of a multiplicity of possible styles including, but not limited to clip-on bangs, clip-in parts, hair volumizers, hairpieces, wigs, ponytails, falls, buns, halos, fringe, braids, top pieces, etc.

Figure 4:
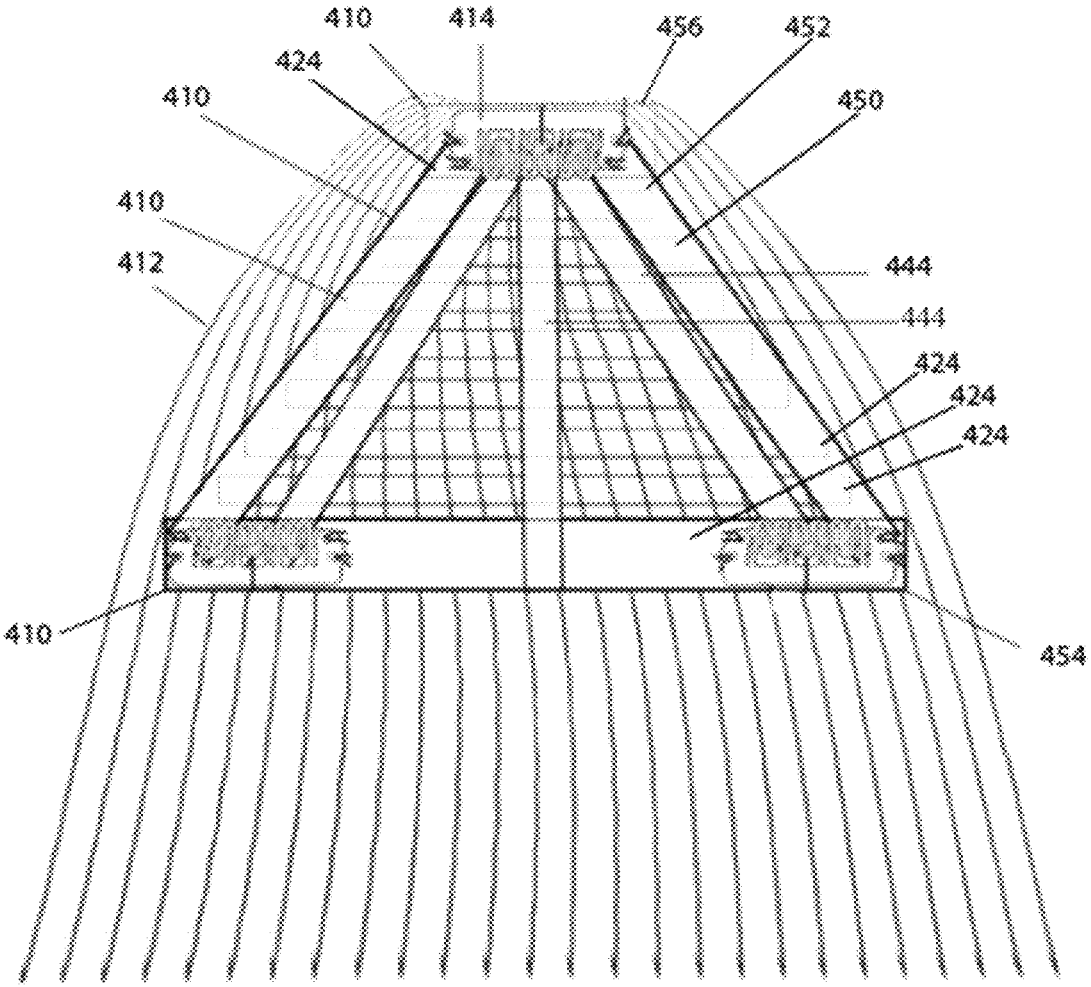
FIG. 4 is a diagrammatic rear view of an exemplary multi-layered clip-in hair extension, in accordance with an embodiment of the present invention.

FIG. 4 is a diagrammatic rear view of an exemplary multi-layered clip-in hair extension, in accordance with an embodiment of the present invention. In the present embodiment the hair extension may function as a clip-in bang and comprises thin wefts 410 of various densities or thicknesses, widths, and lengths. Wefts 410 may comprise human or synthetic hair strands 412 attached to the front sides of each thin weft 410 and pressure sensitive hair clips 414 attached to the underside of the clip-in hair extension unit in specific locations to secure the multi-layered clip-in hair extension to the user's natural hair. It is contemplated that some of the wefts may be implemented without clips. In the present embodiment, multiple rectangular wefts 410 are configured in a triangular formation. There may be four different sized rectangular wefts 410 including narrow horizontal thin wefts 450, angled thin wefts 452, a single bottom thin weft 454, and a single short thin weft 456 at the top of the triangular configuration. The horizontal thin wefts 450 may have a smaller density than both the angled thin weft 452 and bottom thin weft 454. The narrow horizontal thin wefts 450 may have a thin density and may be positioned as the front of the multi-layered hair extension unit along with the single short thin weft 456 and lay over the angled thin wefts 452 and woven material 444. The horizontal thin wefts 450 have a front side and an underside 424. The front side of the horizontal thin wefts 450 may contain inserted or tied human or synthetic hair strands 412. The underside 424 of the horizontal thin weft 450 may be smooth with no added hairs attached. In some embodiments, it may be optional to add hair strands to the underside 424 and edges of the thin horizontal thin weft 450. In some embodiments, it may be optional to add clips to the horizontal thin wefts 450. The horizontal thin wefts 450 may extend or point from the left angled thin weft 452 to the right angled thin weft 452 in the present embodiment. The angled thin wefts 452 create the boarder of the multi-layered hair extension unit and are located beneath the horizontal wefts 450 and the single short thin weft 456. The angled thin wefts 452 may or may not contain human or synthetic hair strands attached to the front side of the weft. The underside 424 of the angled thin wefts 452 is smooth without hair, however it may be optional to insert hair strands into the underside 424 and edges of the angled thin wefts 452 as they serve as the border of the configuration. The angled thin wefts 452 may extend or point to the top short thin weft 456 that contains a clip attachment 414 and towards the bottom thin weft 454 that contains two clip attachments. The density of the short thin weft 456 may be the same as the horizontal thin weft 450 or angled thin weft 452 dependent upon preference. The short thin weft 456 at the top of the triangular configuration faces the front of this embodiment along with the horizontal thin wefts 450. The short thin weft 456 is positioned over the connected ends of the angled thin weft 452 and linking material 444. The front side of the short thin weft 456 at the top of the hair extension unit may contain synthetic or human hair strands. The underside 424 of the short thin weft 456 at the top of the hair extension unit may be smooth to allow for the attachment of the angled thin wefts 452 linking material 444, and clip 414. However, it may be optional to insert hair strands into the underside 424 or edges of the short thin weft 456 at the top of the configuration. The bottom thin weft 454 may be positioned on the front side of the hair extension unit along with the horizontal thin weft 450 and short thin weft 456. The bottom thin weft 454 may contain human or synthetic hairs 412 attached to the front side of the weft. The underside 424 of the bottom thin weft 454 may be smooth to allow for the attachment of the ends of the angled thin weft 452, lightweight material 444, and clips 414. However, it may be optional to insert hair strands into the underside 424 or edges of the bottom thin weft 454. In the present embodiment all thin wefts are created with a polymer material. However, one may replace one or more thin wefts in this embodiment with a lightweight material such as monofilament, thin skin, silicone, lace, silk, nylon etc. For example the horizontal thin wefts 450 maybe replaced with a lightweight material such as thin skin connected by secure means such as thread, rivet, eyelet, etc. to the angled thin weft 452, bottom thin weft 454, and short top thin weft 456. In the present embodiment, thin wefts 410 may be connected by a woven lightweight linking material 444 such as, but not limited to, lace, stretch lace, stretch material, elastic mesh, monofilament, silk, cotton, nylon, lace, chord etc. In some embodiments, the thin wefts may be linked together by the same polymer material used to create the thin wefts or other materials such as, but not limited to, ribbons, plastic mesh, elastic strips, thin skin, silicone, leather, pleather, rivets, eyelets, snaps, clasps, tacks, tack-like beads etc. Optionally, human or synthetic hair strands may be attached to linking material 444. In some embodiments, thin wefts 410 in the hair extension unit may also be attached to the linking material 444 where they touch, intersect, or overlap the linking material. Thin wefts 410 and linking material 444 may typically be connected in the desired configuration by sewing or other secure attachment means such as, but not limited to, permanent adhesives resistant to oil or tacks or tack like beads, rivets, eyelets, etc. that may act as nails with or without a backing, washer, or cap. In some alternate embodiments, the wefts may be connected by adjustable attachment means including, without limitation, hook and loop material, clasps, sliders, adjustable straps, or snaps to enable the user to change the configuration of the wefts if desired. The installer would attach this embodiment of the invention as a multi-layered clip-in bang to a user's natural hair in a manner similar to that describe by way of example in accordance with FIG. 2A through FIG. 2D. The installer would first open all clip attachments. Then the installer would create a part within the top or crown areas of the user's head starting from the hairline. The installer may then position the clip 414 connected to thin weft 456 located at the top of the triangular configuration at a point along the part away from the hairline. The installer may then insert and close the teeth of the clip 414 into the user's natural hair along the part near the roots. How far the clip 414 connected to the thin weft 456 at the top of the triangle is placed along the part away from the hairline may be determined by the desired finished length of the bang. After the clip 414 connected to the thin weft 456 located at the top of the triangle is closed, the installer would insert and close the two side clips 414 along the bottom thin weft 454 to the sides or temples of the user's head behind the hairline within the user's natural hair. The installation may be finished when all clips are closed. In some embodiments, it may be optional to comb the user's natural hair over this embodiment as the attached hairs may fall naturally to cover the multi-layered hair extension configuration. This embodiment of the invention is not limited to a triangular configuration. This embodiment of the invention may be configured into any shape inclusive of, but not limited to, rectangular, square, irregular shape, circular, irregular circle, etc. to suit the needs of the intended hairstyle.

Figure 5A:
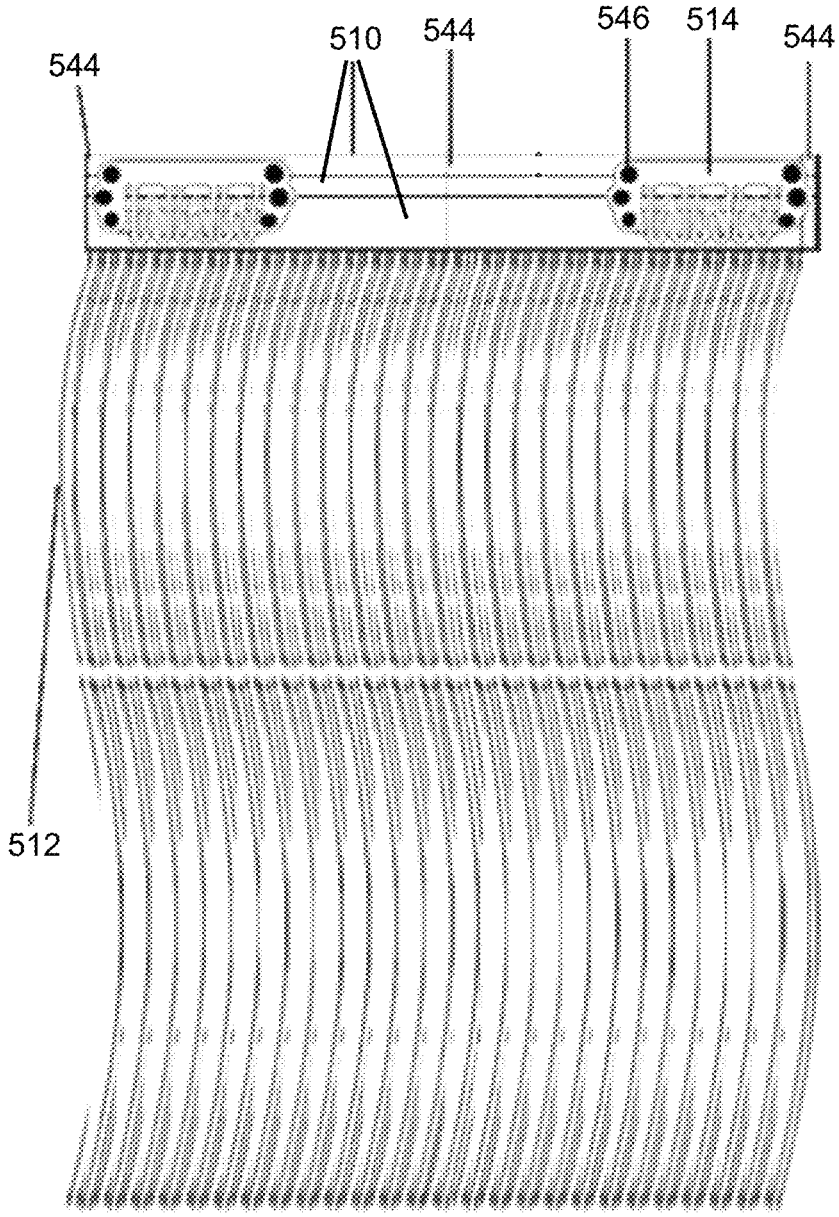
FIGS. 5A and 5B illustrate an exemplary clip-in hair extension comprising a combined weft, in accordance with an embodiment of the present invention.
Figure 5B:
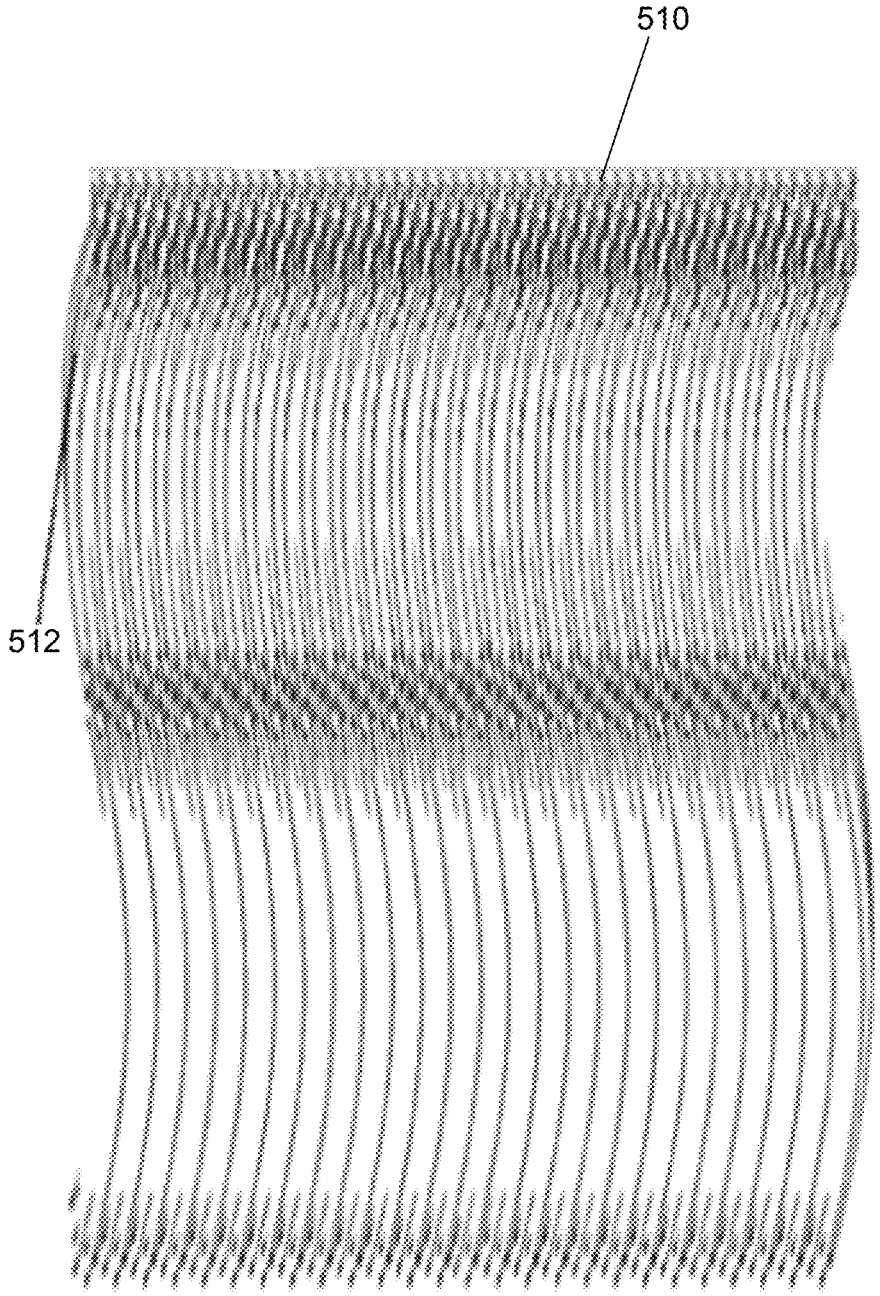

FIGS. 5A and 5B illustrate an exemplary clip-in hair extension comprising a combined weft, in accordance with an embodiment of the present invention. FIG. 5A is a diagrammatic rear view, and FIG. 5B is a diagrammatic front view. Referring to FIG. 5A, in the present embodiment, the combined thin weft comprises three individual thin wefts 510 that overlap each other in a step like configuration with the underside of one thin weft 510 covering a portion of the front side of another thin weft 510. In some embodiments, the thin wefts may directly stack on top of each other rather than being staggered in a step like configuration. There may be human or synthetic hair strands inserted into the front side of each overlapping thin weft. In some embodiments, to avoid bulkiness, the mix of polymer material to create the thin weft is made thinner than the already slim single thin wefts created with just one strip of the polymer material. In a non-limiting example, the single thin wefts may be overall 50% or more thinner with increased bendability than the current sewn wefts on the market that are sewn together to create a combined weft. The add-on human or synthetic hair 512 is inserted or tied into one side of each individual thin weft 510. Afterwards the thin wefts may be arranged on top of each other directly or in a step-like configuration as shown in FIG. 5A and FIG. 5B. The step-like formation may spread out the hairs on the front side of each thin weft allowing the combined thin weft to remain flat against the user's head. Furthermore the ends of the add-on hair within the combined thin weft in a step-like formation may have a naturally tapered, yet full appearance. The flat surface of the underside of each overlapping thin weft is smooth and therefore serves as a protective covering and cushion for the hair stands beneath the underside of the overlapping thin weft. In the present embodiment, by overlapping thin wefts, more hair volume may be created per clip-in hair extension. It is contemplated that two, three, or more thin wefts may be overlapped in some embodiments. In the present embodiment, individual thin wefts 510 may be connected with a linking material 544 attached by sewing or other secure attachment method to the undersides of thin wefts 510 at the ends and the middle to form the combined thin weft. In some embodiments, the linking material may be applied to additional locations along the combined thin weft to make the weft as flat as possible and to prevent gaping and bulkiness. Virtually any durable linking material may be used that may enable the extension to conform to the user's head. For example, without limitation, one may link thin wefts 510 with a polymer material or lightweight material similar to that which may be used to create the individual thin wefts or other materials such as, but not limited to, lace, mesh, monofilament, stretch material, stretch lace, elastic, thin skin, silicone, silk, cotton, ribbon, nylon, chord etc. In other embodiments, the overlapping thin wefts may be sewn together with thread to connect the top edge of each underlying thin weft to the underside of the overlapping thin weft. The thin wefts may be connected by other means of secure attachment including, without limitation, a tack or tack-like bead, permanent adhesive that is not affected by oils, hook and loop material, snaps, clasps, sliders, rivets, eyelets etc. In some embodiments, it is optional to add a cosmetic or light protective covering (not shown) material to the underside of the combined thin weft either before attaching the clips or attaching the linking material that is colored, transparent, or opaque such as, but not limited to, lace, mesh, monofilament, thin skin, silicone, hook and loop material, stretch material, stretch lace, elastic or other lightweight material that is sewn or otherwise attached to the underside of the combined thin weft. In the present embodiment, two pressure sensitive hair clips 514 may be connected to the underside of the combination thin weft with tacks or tack-like beads 546 that may act like nails with or without a backing. Alternatively, the clips 514 may also be attached to the combined thin weft 510 with rivets or eyelets with or without a backing, washer or cap. In some embodiments clips 514 may be sewn to the combination weft with thread, attached with permanent adhesive, snaps, clasps, etc. The attachment method of the clips may further reinforce and flatten the structure of the combined thin weft. Referring to FIG. 5B, multiple human or synthetic hair strands 512 may be attached to the front side of the individual thin wefts 510. In typical use of the present embodiment, the hair extension may be attached near the roots of a user's hair in a similar manner to the method used to attach the hair extension illustrated by way of example in FIG. 2A through FIG. 2D.

Figure 6A:
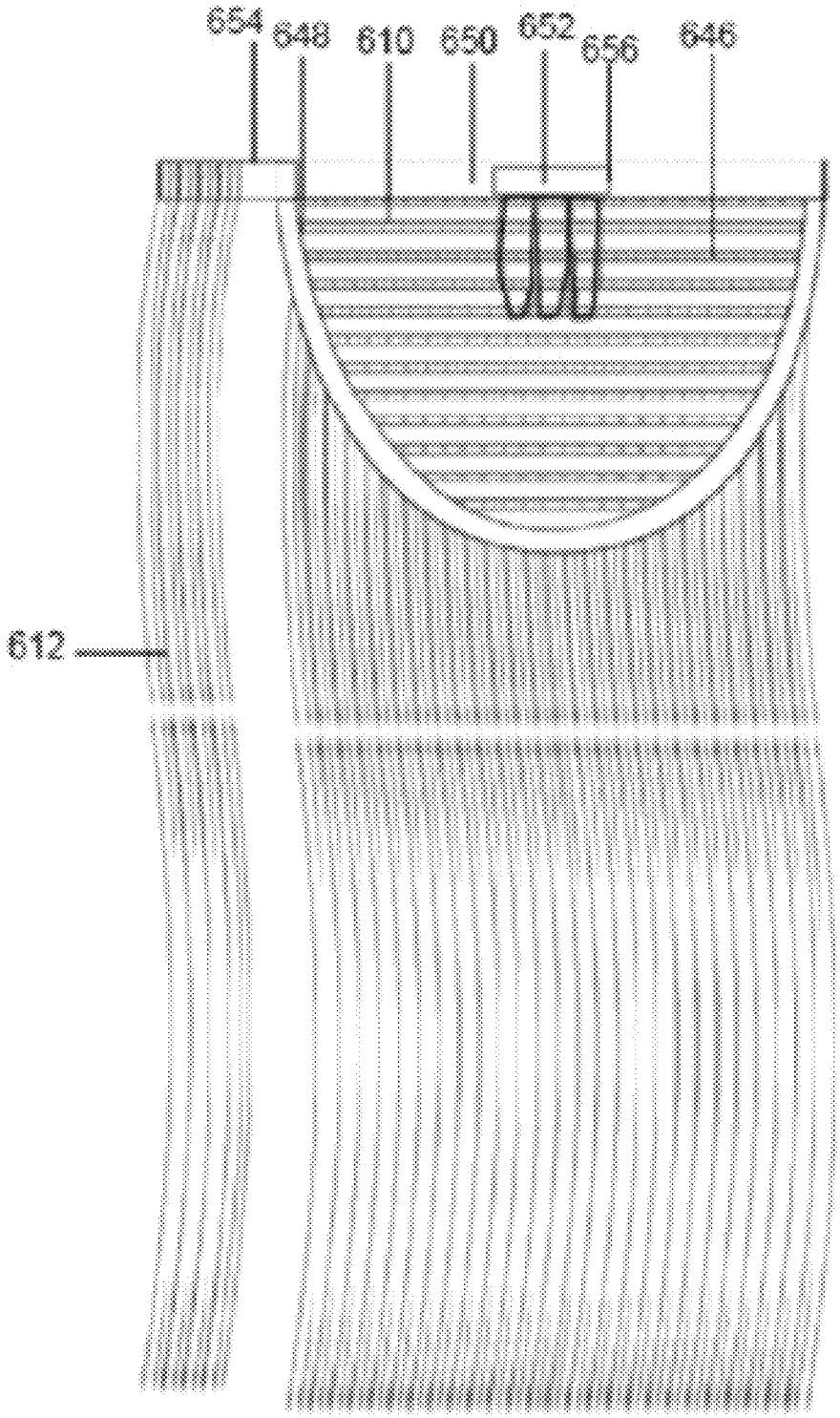
FIGS. 6A and 6B illustrate an exemplary clip-in hair extension comprising a combined weft, in accordance with an embodiment of the present invention.
Figure 6B:
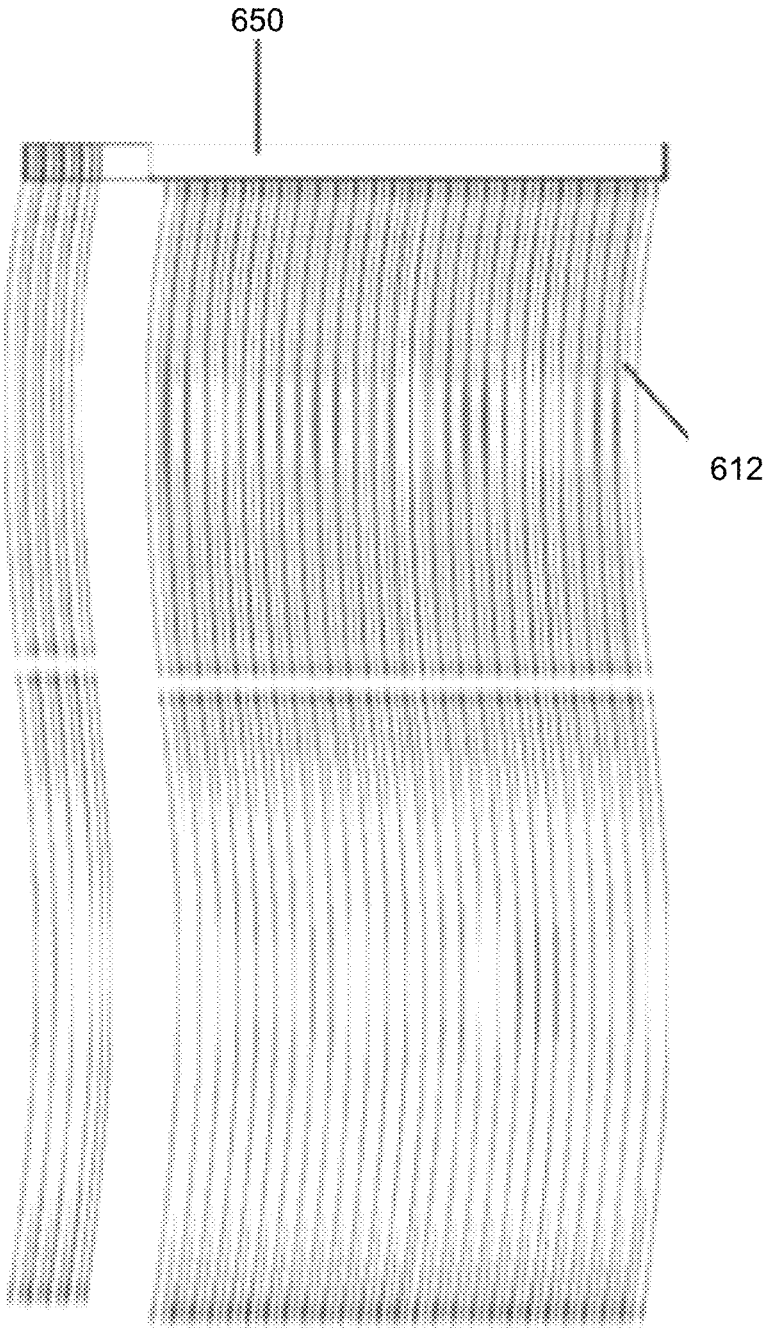

FIGS. 6A and 6B illustrate an exemplary clip-in hair extension comprising a combined weft, in accordance with an embodiment of the present invention. FIG. 6A is a diagrammatic rear view, and FIG. 6B is a diagrammatic front view. In the present embodiment, the hair extension may be applied to a user's natural hair to form a ponytail. Referring to FIG. 6A, multiple thin wefts 610 of different sizes and densities may be connected horizontally to one circular thin weft 648 and a top horizontal thin weft 650. In some embodiments the circular thin weft and/or the top horizontal thin weft may be formed from a material other than the polymer material of the thin weft such as, but not limited to, a woven material, lace, nylon, silicone, monofilament, thin skin, chord, stretch material, stretch lace, elastic etc. Human or synthetic hair strands 612 may be connected to the front side of thin wefts 610 and circular thin weft 648. Optionally human or synthetic hair strands may also be connected to top horizontal thin weft 650. In some embodiments, it is optional to attach human or synthetic hair strands 612 to the underside or edges of the thin wefts 610, circular thin weft 648, and top horizontal thin weft 650. In the present embodiment, top horizontal thin weft 650 a non-pressure sensitive hair clip attachment 652 comprising a top bar and teeth that may be attached to the horizontal thin weft 650 by permanent adhesive resistant to oil 656 or other secure attachment means such as, but not limited to, sewing with thread, rivets, eyelets, etc. The non-pressure sensitive hair clip 652 may act as the point of attachment for the extension to the user's natural hair. A center or cap 646 of the ponytail may be created with a lightweight, woven or polymer material that may be made of stretch or non-stretch material such as, but not limited, to lace, stretch lace, elastic, silk, nylon, fabric material, thin skin, silicone or monofilament. The lightweight, woven or polymer material may be positioned beneath the thin wefts 610 and beneath the hair clip 652. The cap 646 may be connected to the circular thin weft 648 and top horizontal thin weft 650 by various different means of attachment such as, but not limited to, sewing, permanent adhesive, hook and loop material, tack, tack like bead, rivet, eyelet, snaps etc. The cap 646 may not contain attached hair human or synthetic hair strands. In some embodiments, it maybe optional to attach human or synthetic hair strands to the lightweight, woven or polymer material, of the cap. It is contemplated that various different types of attachment means may be used to connect the extension to the user's natural hair such as, but not limited to, pressure sensitive clips, combs, hair pins, rubber bands, etc. In the present embodiment, the left side of top horizontal thin weft 650 comprises an extension 654 of the weft material or a woven material into which multiple human or synthetic hair strands 612 may be attached. Extension 654 may be attached to top horizontal thin weft 650 using a multiplicity of suitable means such as, but not limited to sewing, permanent adhesive, tack, tack like bead, rivet, eyelet, snaps, clasps, hook and loop material, etc. being formed as a part of top horizontal weft 650, etc. In addition to horizontal thin weft 650 and individual thin wefts 610 may be connected to circular thin weft 648 using various different means of attachment such as, but not limited to, sewing, permanent adhesive, hook and loop material, tack, tack like bead, rivet, eyelet, snaps etc. The circular weft 648 may serve as the border and connector of the horizontal thin wefts 610 and cap 646. The circular weft 648 may also be another configuration such as, without limitation, triangular, square, rectangular, irregular etc. In the present embodiment all thin wefts are created with a polymer material. However, one may replace one or more thin wefts in this embodiment with a lightweight woven or polymer material such as, but not limited to, monofilament, nylon, stretch material, stretch lace, elastic, thin skin, silicone, lace, silk, etc. For example, the horizontal thin wefts 610 maybe replaced with a woven material such as, but not limited to, monofilament, nylon, stretch material, stretch lace, thin skin, silicone, lace, or silk connected to by secure means to the circular thin weft 648. Referring to FIG. 6B, hair strands 612 may be connected to the front side of individual thin wefts 610, circular thin weft 648, top horizontal thin weft 650 and to the front side of extension 654. This embodiment of the invention is not limited to the irregular configuration. This embodiment of the invention may be configured into any shape inclusive of, but not limited to, rectangular, square, circular, irregular circle, etc. to suit the needs of the intended hairstyle. In typical use of the present embodiment, the installer would simply create a ponytail in the user's natural hair tied with a rubber band or other suitable hair tie material. Then the installer would insert the teeth of the combs of the unit into the ponytail directly in front of the rubber band or other hair tie. Then the installer would wrap both sides of the unit around the user's natural ponytail. To secure wrapped position of the unit, the installer would then wrap the extended portion 654 of the unit several times around the base of the ponytail while covering the base of the wrapped portion of the invention in order to conceal and secure the invention. The installer would then secure any exposed hair connected to the extended portion 654 with a bobby pin, hair tie, or other suitable hair styling device to complete the installation.

Figure 7A:
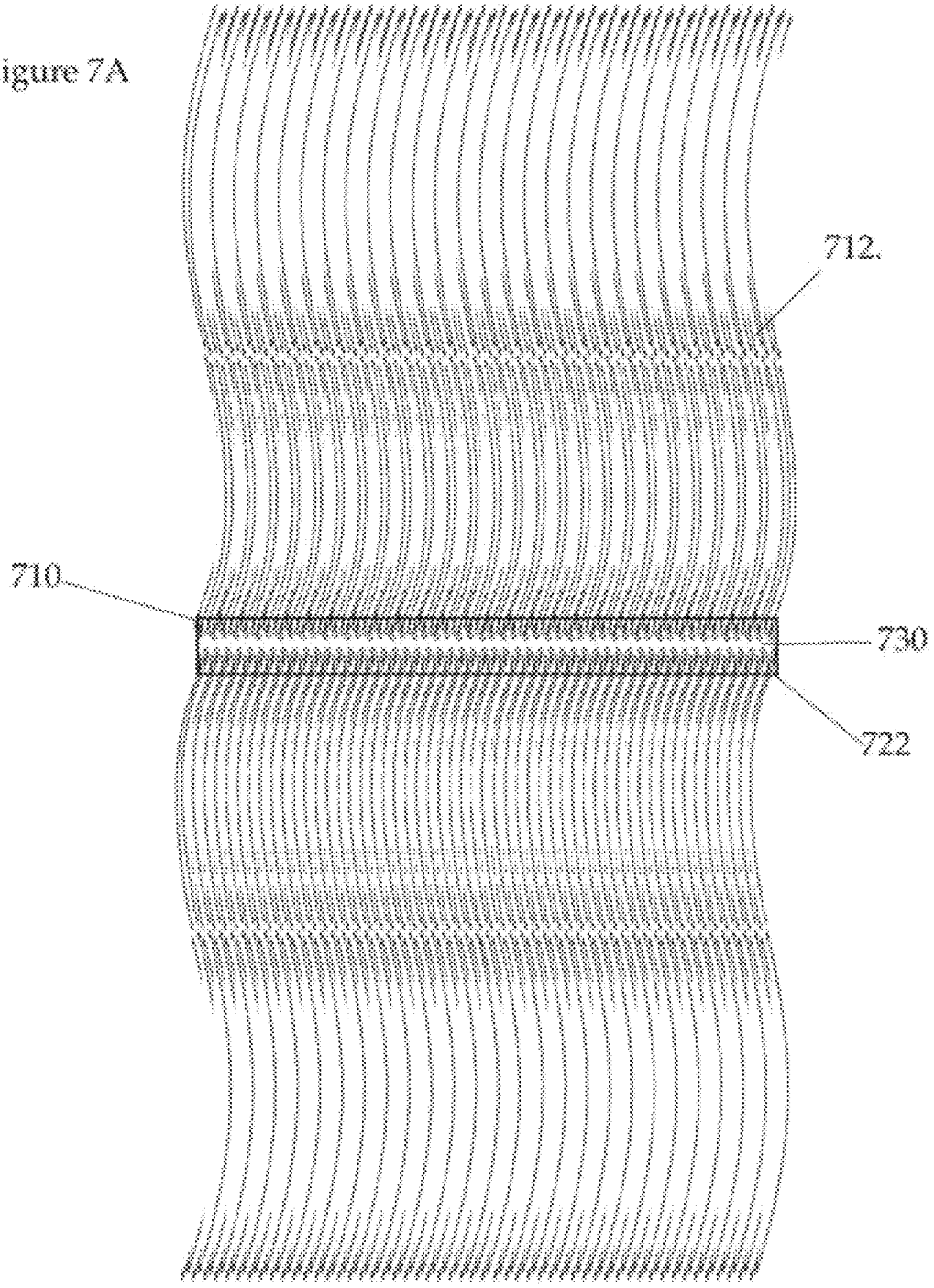
FIG. 7A is a diagrammatic front view of an exemplary clip-in hair extension comprising a part within the human or synthetic hair along the thin weft, in accordance with an embodiment of the present invention.

FIG. 7A is a diagrammatic front view of an exemplary clip-in hair extension comprising a part within the human or synthetic hair along the thin weft, in accordance with an embodiment of the present invention. In the present embodiment, a part may be created within the human or synthetic hair strands along the thin weft 710 as shown in FIG. 7A. A part 730 created within the human or synthetic hair strands 712 attached to a thin weft 710 that is transparent or flesh tone in color, will allow a user to insert a natural looking part anywhere on their head with the invention. In a non-limiting example, a part created within the human or synthetic hair strands along the longest border of the invention configured as a rectangular clip-in bang may allow the user to wear clip-in bangs with an enhanced natural appearance. A part 730 along the front side 722 of the thin weft may be created by tying or inserting the human or synthetic hair strands 712 to the front side 722 of the thin weft 710 in a freestyle manner, which means in a way that allows the hair strands to move in multiple directions. By inserting and tying the human or synthetic hair strands 712 in a freestyle manner, the hair 712 attached to the thin weft 710 may be parted in any direction whether horizontal, vertical, or angled. Alternatively, the human or synthetic hair strands 712 can be inserted or tied to lay in a specific pre-set direction to create a part 730 along the front side 722 of the thin weft 710. The pre-set part 730 may be created at any angle inclusive of, but not limited to, horizontal, vertical, or angular. The present embodiment shows a single part 730 created along the human or synthetic hairs within the thin weft. In other embodiments, multiple parts, whether freestyle or pre-set, may be created in any direction along the human or synthetic hairs within the thin weft.

In order to install a thin weft with a parting one may simply follow the steps of FIG. 2A through FIG. 2D. The installer may create a part 30 within the user's natural hair so the user's natural hair falls in the desired direction for the finished look. In some embodiments, part 30 may be created anywhere on the user's head. In many embodiments, part 30 may be created on the top, crown and sides areas of the user's head. Then the installer would open the clips 14 on the underside 24 of the thin weft 10 as shown in FIG. 2A. Then the installer would insert the teeth 16 of the open clips 14 into the user's natural hair 34 near the root along the created part 30 as shown in FIG. 2B. Alternatively, depending upon the configuration of the invention, such as, without limitation, a rectangular bang, the installer may align the invention perpendicular, or at the desired angle, to the part 30 in the user's natural hair and insert the open clips 14 directly into the user's natural hair 30 near the roots to create the desired effect. Once the clips are inserted, the installer may close the clips as shown in FIG. 2C. If the part 730 is pre-set and already created within the human or synthetic hairs attached to the front side of the thin weft 710, the installer may simply style the user's natural hair 34 as usual with the pre-set part 730. Alternatively, the installer may create a new part 730 within the human or synthetic hair strands 712 attached to the thin weft after the invention is attached to the user's natural hair 34. One may create a part among the human or synthetic hair strands 712 within the invention, whether pre-set or freestyle, for hair extension products such as, but not limited to, clip-in bangs, clip-in side bangs, falls, etc. Furthermore, this embodiment of the invention shows that the human or synthetic hair strands can be positioned in any direction within the thin weft for an enhanced natural appearance.

Figure 8A:
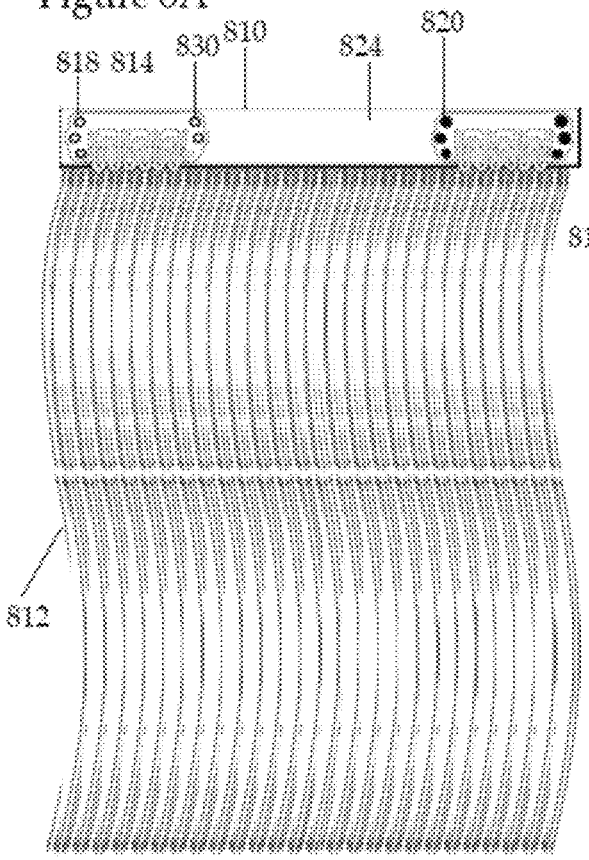
FIG. 8A and FIG. 8B illustrate an exemplary clip-in hair extension comprising clip attachments attached to the thin weft with a rivet or eyelet within accordance with an embodiment of the invention.
Figure 8B:
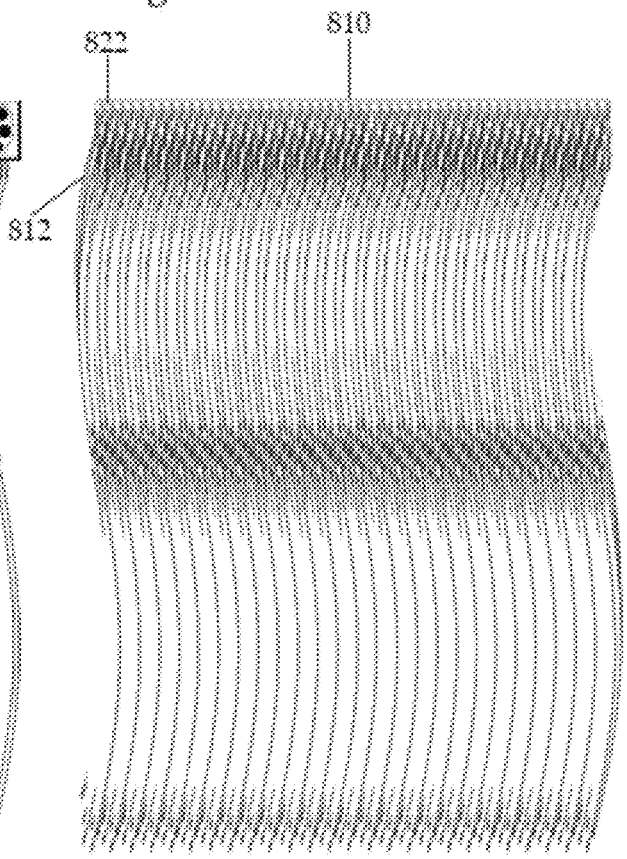

FIG. 8A and FIG. 8B illustrate an exemplary clip-in hair extension comprising clip attachments attached to the thin weft with a rivet or eyelet within accordance with an embodiment of the invention. FIG. 8A is a diagrammatic rear view, and FIG. 8B is a diagrammatic front view. In the present embodiment, clips 814 may be attached with a rivet or eyelet that is inserted through the holes of the clips into the thin weft as shown in FIG. 8A and FIG. 8B. The rivet 820 or eyelet 830 maybe secured with or without a cap, backing or washer. In order to insert an eyelet 830 or rivet 820 into the thin weft 810, one may puncture a hole into or through the thin weft 810 that is similar in size to the holes 818 of the clips 814 with a hole puncturing tool created and sized for rivets 820 and/or eyelets 830. Alternatively, a nail or nail-like device can be used to puncture a hole through the thin weft 810 as long as the hole is similar in size to the holes 818 of the clip attachment 814. The clip 814 may then be aligned over the punctured holes of the thin weft 810. Then a rivet 820 or eyelet 830 may be inserted through the holes 818 of the clip 814 and into the punctured hole in the thin weft 810. The rivet 820 or eyelet 830 may be inserted from the front side 822 or underside 824 of the thin weft depending on one's preference. The rivet 820 or eyelet 830 may be inserted through the holes 818 of the clip 814 and thin weft 810 before or after the human or synthetic hair strands 812 are tied or inserted into the thin weft 810 depending upon one's preference. In some embodiments, it is optional to attach a cap, backing and/or washer to the rivet 820 or eyelet 830 dependent upon the type of rivet 820 or eyelet 830 inserted. Any suitable rivet or eyelet with or without a cap, backing and/or washer may be used such as, but not limited to, a tubular rivet, eyelet rivet, crystal rivet, clear plastic push snap rivet, snap rivet, snap rivet with hole, compression rivet, solid rivet, split rivet, etc. depending on the desired finished appearance. The rivet or eyelet may be created with any suitable material such, without limitation, a metal, plastic, polymer, nylon, polycarbonate, etc. The rivet or eyelet may be any shape or any color including, without limitation, transparent or the same color as the add-on hair or user's scalp. The rivet or eyelet may be any size depending upon the size of the holes present in the clip attachment. In some embodiments, the rivet or eyelet may contain an imprint or hot stamp of language on its exposed head or bottom. In some embodiments, the rivet or eyelet may have the appearance of jewelry or contain a jewel like object as long as it securely fastens the clip attachment to the thin weft. In some embodiments, depending upon the material of the rivet, the exposed head of the rivet may be sanded down for a seamless or invisible appearance of the rivet and clip attached to the thin weft.

Figure 9A:
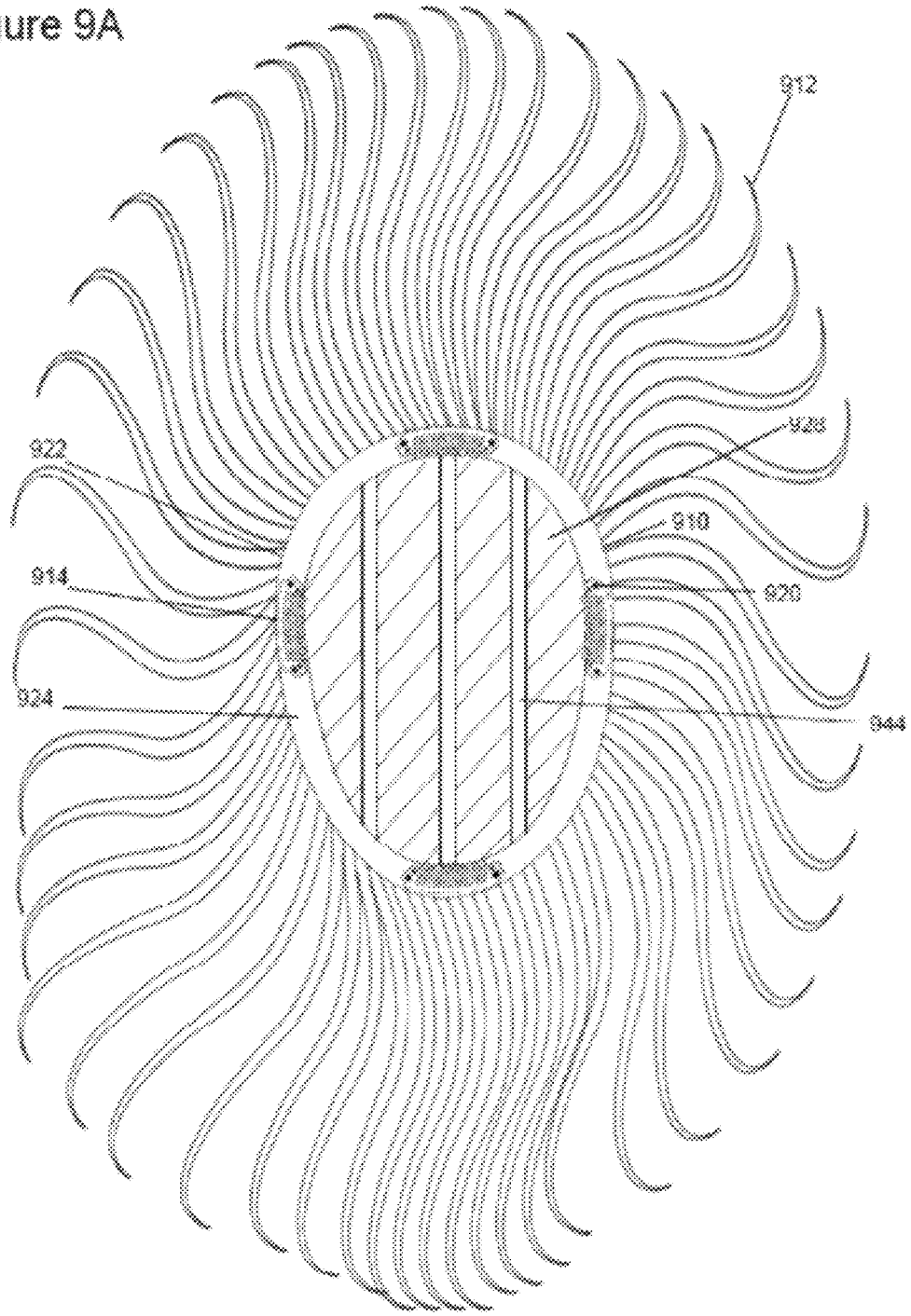
FIG. 9A and FIG. 9B illustrate an exemplary clip-in hair extension as a full wig, three quarter wig, hairpiece or fall, in accordance with an embodiment of the present invention.
Figure 9B:
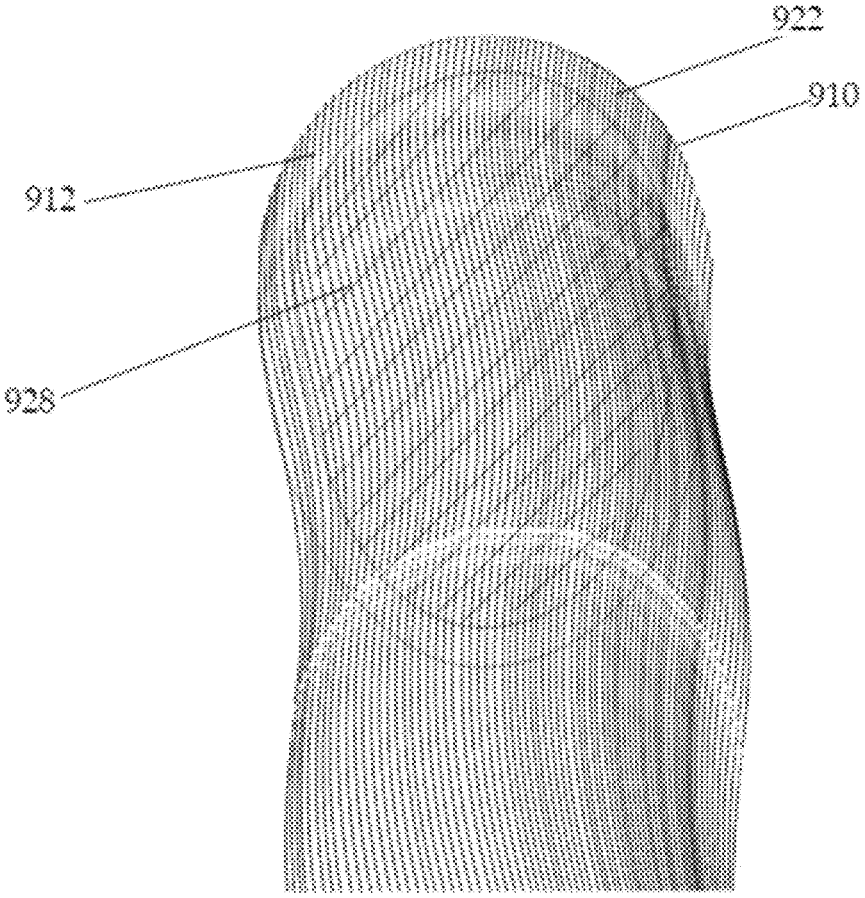

FIG. 9A and FIG. 9B illustrate an exemplary clip-in hair extension as a full wig, three quarter wig, hairpiece, or fall, in accordance with an embodiment of the present invention. FIG. 9A is a diagrammatic rear view, and FIG. 9B is a diagrammatic front view. In the present embodiment a thin weft 910 creates the border in the three quarter wig or fall containing human or synthetic hair strands 912 that are attached to the front side 922 of the thin weft 910 as shown in FIG. 9B and clips 914 attached to the underside 924 of the thin weft as shown in FIG. 9A. The center or cap 928 of the fall is created with a lightweight, woven or polymer material that maybe made of stretch or non-stretch material such as, but not limited to, lace, stretch lace, elastic, silk, nylon, fabric material, thin skin, silicone or monofilament. The lightweight, woven or polymer material contains tied or otherwise attached human or synthetic hair strands 912 on the front side of the cap 928. Alternatively, multiple thin wefts 910 with a slim density containing human or synthetic strands attached to the front side of the thin wefts and no hairs attached to the underside of the thin wefts may also create the cap 928 of the fall. In some embodiments, it may be optional to attach the multiple thin wefts overlapping the cap in the three quarter wig or fall that may be made of stretch or non-stretch material. In some embodiments, it may be optional to add clips 914 to any thin weft 910 that is part of the cap 928 or center of the three quarter wig or fall. The lightweight material used to create the cap 928, whether a woven material, stretch material, polymer material or multiple thin wefts, may be connected to the thin weft border by sewing, permanent adhesive, rivets, eyelets, or other secure connection method. The circular thin weft 910 which creates the border of this embodiment may contain inserted or tied human or synthetic hair strands 912 on the front side 922 of the thin weft 910 and suitable clip attachments 914 on the underside 924 of the thin weft 910. The clip attachments 914 may be any clip inclusive of, but not limited to, pressure sensitive hair clips or non-pressure sensitive wig clips or any other type of clip attachment that will secure the fall to the user's natural hair. The clip attachments 914 may be attached to the underside of the thin weft 910 in a variety of ways including, but not limited to, sewing with thread, permanent adhesive resistant to oil, rivets 920, or eyelets depending upon preference. For illustrative purposes only, the clips 914 are attached with rivets 920 to the underside 924 of the thin weft. In the present embodiment, a woven lightweight linking material 944 such as, but not limited to, lace, stretch lace, stretch material, elastic, mesh, monofilament, silk, cotton, nylon, lace, chord etc. may be added for structural support of the embodiment. In some embodiments, the linking material may be created from the same polymer material used to create the thin wefts or other materials such as, but not limited to, ribbons, plastic mesh, elastic strips, thin skin, silicone, leather, pleather, rivets, eyelets, snaps, clasps, tacks, tack-like beads etc. Optionally, human or synthetic hair strands may be attached to linking material 944. In some embodiments, thin wefts 910 and/or the cap 928 in the hair extension unit may also be attached to the linking material 944 where they touch, intersect, or overlap the linking material. Thin wefts 910 and/or the cap 928 may typically be connected to the linking material 944 in the desired configuration by sewing or other secure attachment means such as, but not limited to, permanent adhesives resistant to oil or tacks or tack like beads, rivets, eyelets, etc. that may act as nails with or without a backing, washer, or cap.

This embodiment of the invention is not limited to a circular configuration. This embodiment of the invention may be configured into any shape inclusive of, but not limited to, rectangular, square, triangular, irregular shape, irregular circle, etc. to suit the needs of the intended hairstyle.

In other embodiments, it may be optional to add, without limitation, an adjustable or non-adjustable band made of fabric, woven material, plastic, polymer material, human hair, synthetic hair, stretch material, fabric material, etc. underneath or along the top portion of the three-quarter wig or fall to create a band fall. In some embodiments, it may be also optional to attach an adjustable or non-adjustable band within the embodiment, on top, or below a closure, lace frontal unit, bang, side part or other hairpiece created with, without limitation, lace, thin skin, monofilament, stretch material, silk or other lightweight woven or polymer material. In some embodiments, it may be also optional to add adjustable straps in the nape area.

Typically, a user may wear a full wig, hairpiece, fall or three quarter wig because the add-on hairs attached to the thin weft may appear as natural hairs growing from the user's scalp. Also, if the user's natural hair is moved voluntarily or involuntarily, the three quarter wig or fall may not be detectable because the border of the embodiment is lined with a thin weft with attached human or synthetic hair strands that move naturally. The user may also run their fingers through their hair with the fall or three quarter wig attached and not feel the thin weft border unlike current three quarter wigs or falls sold on the market created with sewn wefts. Furthermore, the thin weft is neither easily damaged nor do the add-on hairs shed when attached to the thin weft, thereby increasing the usability of the three quarter wig or fall.

In order to attach the full wig, hairpiece, three quarter wig or fall embodiment of the invention to the user's natural hair, the installer may follow the steps of FIG. 2A through FIG. 2D. The installer may first open all the clips 14 in the circular configuration of the embodiment as shown similarly in FIG. 2A. The installer may then create a circular part in the user's natural hair to match the circular configuration of the embodiment in a similar manner as the part 30 created in FIG. 2B. The installer may secure the user's natural hair 34 in the middle of the part 30 with a hairstyle that may allow the three quarter wig or fall to lay as flat as possible against the user's head such as, but not limited to, a flat bun, french braid(s), twists, braids, cornrows, a twisted ponytail, etc. The flat hairstyle created in the center of the user's head may be secured as flat as possible with styling tools, such as, but not limited to, sewing thread, bobby pins, rubber bands, hair clip, hair tie, etc. The installer may also secure the user's natural hair 34 around the outer edge of the circular part 30 with additional hairclips 32 in a similar manner as shown in FIG. 2B. The next step would be to insert the teeth 16 of the open clips 14 into the user's natural hair 34 along the circular part 30 near the roots of the user's natural hair 34, but not directly on the scalp, which is similarly shown in FIG. 2B starting with the top clip 14 of the circular embodiment. After the teeth 16 of the top clip 14 are inserted into the user's natural hair 34 near the roots, the installer may then close the clip 14 to secure the invention flat within the wearer's natural hair 34 near the roots so that the inserted or tied human or synthetic hair strands 12 may move naturally. For the purpose of illustration, a pressure sensitive clip is attached to the thin weft with rivets 920. Other suitable clip attachments and attachment methods of the clip to the thin weft previously mentioned may be used in this embodiment. The insertion and closure of the clips 14 in the circular embodiment of the invention will continue around the circular part 30 of the user's natural hair 34 covering the flatly secured center of the user's natural hair 34 until all clips 14 are closed as shown similarly in FIG. 2C. The installer may use the circular part to guide the installation of the extension around the back of the head. In some embodiments, it may also be optional to let the user's natural hair hang freely underneath the embodiment. In some embodiments, it may be optional to pull the user's natural hair in-between the multiple thin wefts of the embodiment with a comb when the user's natural hair is left loose beneath the irregular clip-in hair extension to create the desired hairstyle when a cap is not present. Once the clips 14 are closed securely similarly to FIG. 2C, the installer would then remove the hair clip 32 from the user's natural hair 34 along the outside border of the circular part and comb the user's natural hair 34 over the three quarter wig or fall embodiment of the invention as shown similarly in FIG. 2D to complete the installation or otherwise style.

Figure 10A:
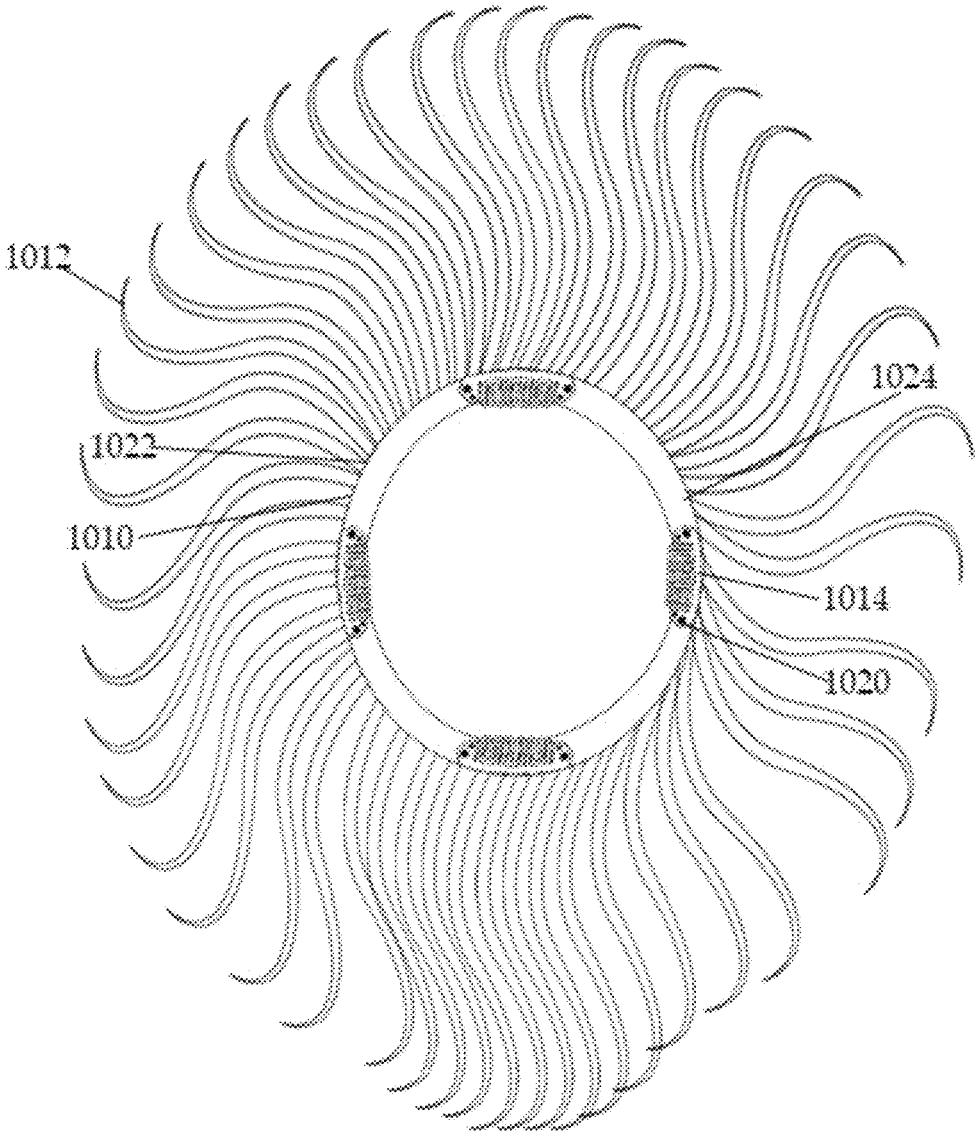
FIG. 10A and FIG. 10B illustrate an exemplary clip-in hair extension as a circular configuration, in accordance with an embodiment of the present invention.
Figure 10B:
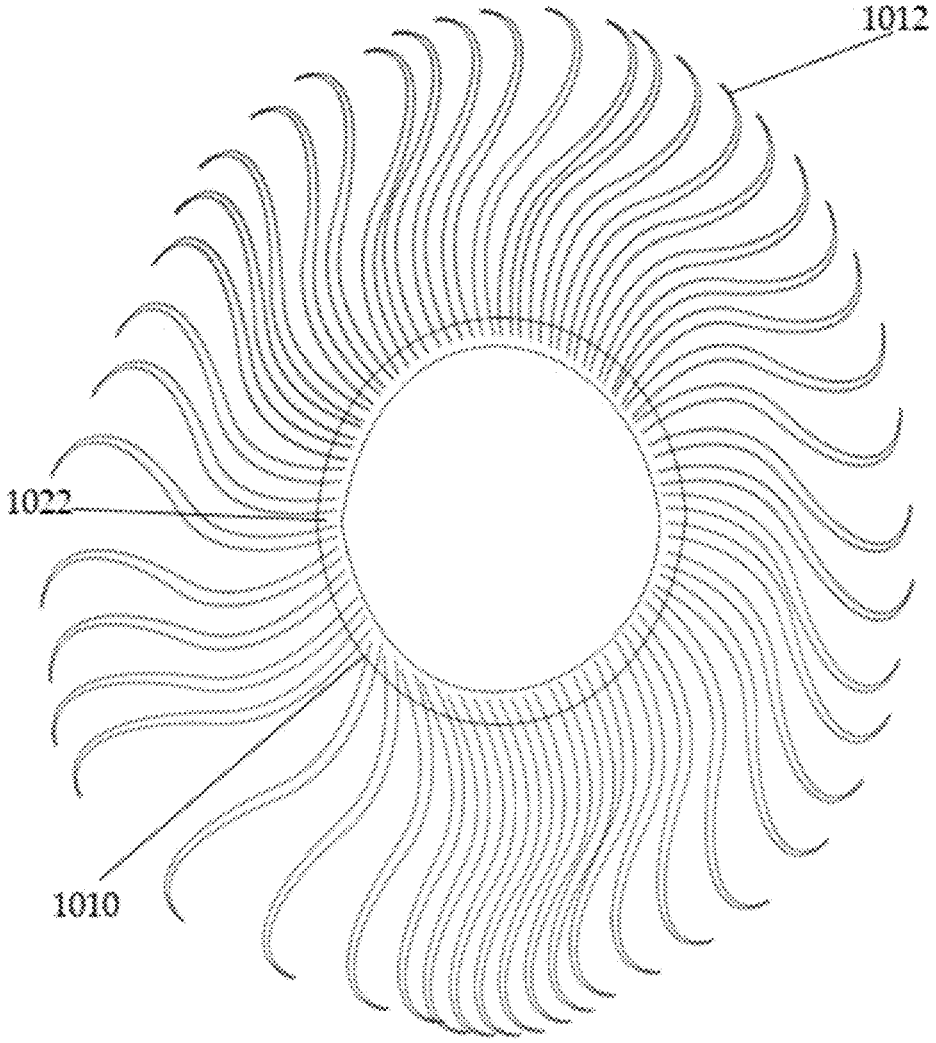

FIG. 10A and FIG. 10B illustrate an exemplary clip-in hair extension as a circular configuration, in accordance with an embodiment of the present invention. This embodiment of the invention is not limited to a circular configuration. This embodiment of the invention may be configured into any shape inclusive of, but not limited to, rectangular, square, triangular, irregular shape, irregular circle, etc. to suit the needs of the intended hairstyle.

FIG. 10A is a diagrammatic rear view, and FIG. 10B is a diagrammatic front view. The present embodiment of the invention is a circular configuration that is inserted within the user's natural hair. Unlike the previous embodiment, there is no center or cap created with a lightweight woven material, polymer material or multiple thin wefts. The center of the present embodiment is open so that the user's natural hair moves freely around the circular embodiment like the earlier rectangular configurations of the invention. The circular configuration may allow the user to easily create up dos and ponytails and any other desired hairstyle. The circular configuration distributes the hair differently than the rectangular configuration while achieving the same goal of a natural look with added volume and length. The circular configuration of the invention may not be easily felt when the user run's their fingers through their hair or easily seen when the user's natural hair moves voluntarily. The density of the thin weft in a circular configuration may vary like the earlier rectangular configuration. In a non-limiting example, for users with thin hair, one may create a density that is thinner along the top portion of the circular configuration than the bottom portion. Additionally, multiple sizes of the invention in the circular configuration may be applied to the user's natural hair as needed.

FIG. 10A shows the underside of the circular configuration of the invention with clips 1014 attached to the underside 1024 of the thin weft 1010 and human or synthetic hair strands 1012 attached to the front side 1022 of the thin weft 1010 which is shown in FIG. 10B. For illustrative purposes only, the clips 1014 are attached with rivets 1020 to the underside 1024 of the thin weft 1010. The clips 1014 may also be attached to the thin weft 1014 by other materials including, but not limited to, sewing with thread, eyelets, permanent adhesive resist to oil, or other secure attachment method. FIG. 10B shows the front side 1022 of the circular configuration of the invention with human or synthetic hair strands 1012 attached to the front side 1022 of the thin weft 1010. In this embodiment, pressure sensitive hair clips 1014 are used however one may attach any suitable clip attachment as long as it creates a secure hold to the user's natural hair once installed.

In order to apply this embodiment of the invention to the user's natural hair, the installer may follow the steps of FIG. 2A through FIG. 2D. The installer would first open all the clips 14 in the circular configuration of the embodiment as shown similarly in FIG. 2A. The installer would then create a circular part 30 in the user's natural hair 34 to match the circular configuration of the embodiment in a similar manner as shown in FIG. 2B. The installer would then secure the user's natural hair 34 in the middle of the part with a hair clip 32 in a similar manner as shown in FIG. 2B so the user's natural hair does not interfere with the installation of this embodiment of the invention. Any of the user's natural hair 34 outside of the circular part may also be secured with a hairclip 32 so the installer can feel the part to guide installation of the embodiment. The next step would be to insert the teeth 16 of the open clips 14 into the user's natural hair 34 along the circular part 30 near the roots of the user's natural hair 34, but not directly on the scalp, which is similarly shown in FIG. 2B starting with the top clip 14 of the circular embodiment. After the teeth 16 of the top clip 14 are inserted into the user's natural hair near the roots of the circular part 30, the installer would then close the clip 14 to secure the invention flat within the wearer's natural hair 34 so that the inserted or tied human or synthetic hair strands 12 can move naturally. For the purpose of illustration, a pressure sensitive clip is attached to the thin weft with rivets 1020. Other suitable clip attachments and attachment methods of the clip to the thin weft previously mentioned may be used in this embodiment. The insertion and closure of the clips 14 in the circular embodiment of the invention will continue around the circular part 30 created in the user's natural hair 34. The installer may use the circular part to guide the installation of the extension around the back of the head. Once the clips are closed securely similarly to FIG. 2C, the installer would then remove the clip 32 from the user's natural hair 34 in the middle and outside of the circular part 30 and comb the user's natural hair 34 over circular embodiment of the invention to complete the installation similarly shown in FIG. 2D. In some embodiments, it may be optional to add multiple circular embodiments of the invention in different sizes to the user's natural hair to create the desired look.

Figure 11A:
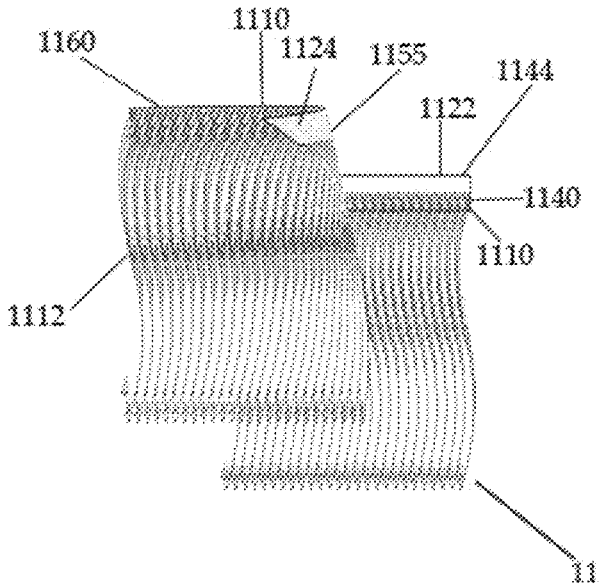
FIG. 11A through FIG. 11B illustrate an exemplary clip-in hair extension as another version of the combination weft, in accordance with an embodiment of the present invention.
Figure 11C:
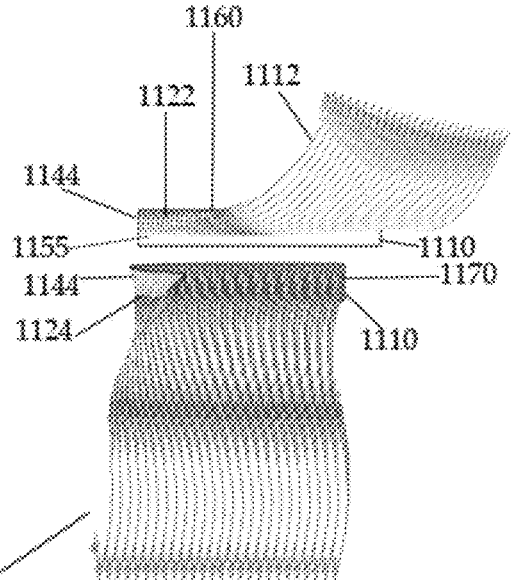
Figure 11B:
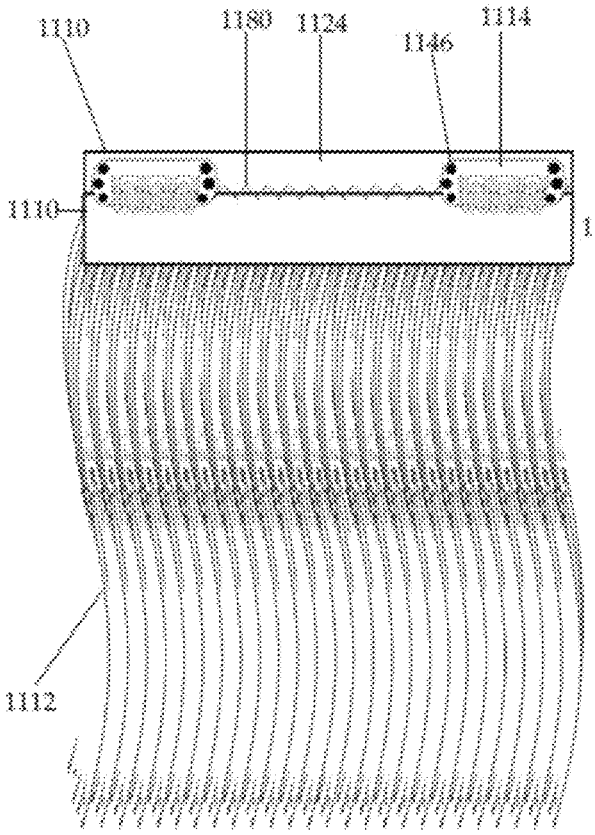
Figure 11D:
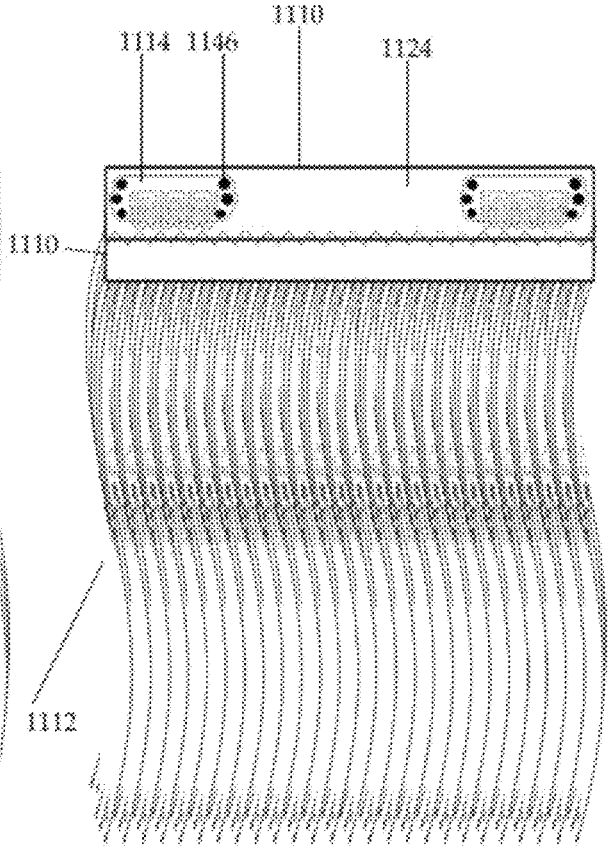
FIG. 11D is a diagrammatic rear view.

FIG. 11A through FIG. 11B illustrate an exemplary clip-in hair extension as another version of the combination weft, in accordance with an embodiment of the present invention. FIG. 11A and FIG. 11C is a diagrammatic front view, and FIG. 11B and FIG. 11D is a diagrammatic rear view. In the present embodiment a user may create a combination weft with thin wefts that contain hair strands inserted or tied to only one horizontal portion of the front side of the thin weft leaving the other horizontal portion of the thin weft hairless on the front side. This may allow the hairless horizontal front side of the thin weft to connect to the underside of another thin weft in order to create a combination weft. In FIG. 11A, human or synthetic hairs 1112 may be inserted or tied horizontally to the bottom portion 1140 of the front side 1122 of the thin weft 1110 leaving the top horizontal portion 1144 of the thin weft 1110 without hair strands. The size of the bottom portion to which add-on hairs are attached may vary depending upon one's needs. In the present embodiment the hairless horizontal top portion 1144 of the thin weft 1110 may be connected to the bottom portion 1155 of the underside 1124 of another overlapping thin weft 1110 to create a combination weft. In this arrangement, the add-on hairs 1112 attached to the horizontal bottom portion 1140 of the underlying thin weft 1110 are not covered as in FIGS. 5A and 5B. More than two thin wefts 1110 may be connected to form a combination weft with this configuration. The top most thin weft 1160 in this configuration may have a front side 1122 that is completely covered with attached human or synthetic hair strands 1112.

In FIG. 11C the top horizontal portion 1144 of the front side 1122 of the thin weft 1110 contains attached human or synthetic hair strands 1112 while the bottom horizontal portion 1155 of the front side 1122 of the thin weft 1110 is left hairless with zero add-on hairs. In this alternative arrangement, the bottom portion 1155 of the front side 1122 of the top most thin weft 1160 may be connected to the top horizontal portion 1144 of the underside 1124 of another thin weft 1110. In this arrangement, the add-on hairs 1112 attached to the horizontal top portion of the overlapping thin weft may not be covered as in FIGS. 5A and 5B. More than two thin wefts may be connected to form a combination weft with this configuration. In this alternative arrangement the final bottom thin weft 1170 may have a front side 1122 that is completely covered with human or synthetic hair strands 1112. Like FIG. 5A and FIG. 5B, a combination weft created with the arrangement of this embodiment may allow the wearer to experience more hair weight per combination weft. The benefit of this arrangement may be an even flatter combination weft than FIGS. 5A and 5B with the elimination of gaps and bulkiness.

FIG. 11B is a diagrammatic rear view of FIG. 11A. FIG. 11D is a diagrammatic rear view FIG. 11C. In these embodiments, the overlapping thin wefts 1110 may be sewn together with thread 1180 on the underside 1124 of the combination thin weft. Alternatively, the thin wefts 1110 may be connected by other means of secure attachment including, without limitation, a tack or tack-like bead, permanent adhesive that is not affected by oils, hook and loop material, snaps, clasps, sliders, rivets, eyelets etc. The thin wefts may also be connected with a linking material 544 as shown in FIG. 5A such as, but not limited to, a polymer material similar to that which may be used to create the individual thin wefts or other materials such as, but not limited to, lace, mesh, monofilament, thin skin, silicone, silk, cotton, ribbon, nylon, chord etc. In some embodiments, it may be optional to add a cosmetic or light protective covering material to the underside of the combined thin weft either before attaching the clips or attaching the linking material, without limitation, that is colored, transparent, or opaque such as, but not limited to, lace, mesh, monofilament, thin skin, silicone, hook and loop material, or other lightweight material that is sewn or otherwise attached to the underside of the combined thin weft. The clip attachments 1114 may be connected to the combination weft in both FIGS. 11B and 11D by sewing thread or inserting rivets 1146, eyelets or other attachment method securing the clips 1114 to the thin weft 1110 in alignment with or just below the top edge of the thin weft 1110.

FIG. 11A and FIG. 11C may be attached to the wearer's head as demonstrated by FIGS. 2A through 2D. The front side of the combination wefts in FIG. 11A through 11D may have the same appearance as FIG. 5B.

In another embodiment of the present invention, the combination thin weft may be created by connecting the undersides of two individual thin wefts. The individual thin wefts comprise human or synthetic hair strands attached to the two outward facing front sides and one or more clips or other attachment means to one side of the combined thin weft. This embodiment may enable a user to obtain more hair weight and hair volume per clip-in hair extension. In some embodiments, the underside of both thin wefts may be connected, without limitation, with thread, permanent adhesive resistant to oil, snaps, rivets, eyelets, sliders, clasps, etc. or other suitable connecting material. In some embodiments, the clip attachments on one side of the combined thin weft may be attached with thread, permanent adhesive resistant to oil, eyelets, rivets, tacks, tack like beads, etc. or other form of attachment material that may secure the embodiment to the user's natural hair.

Figure 12A:
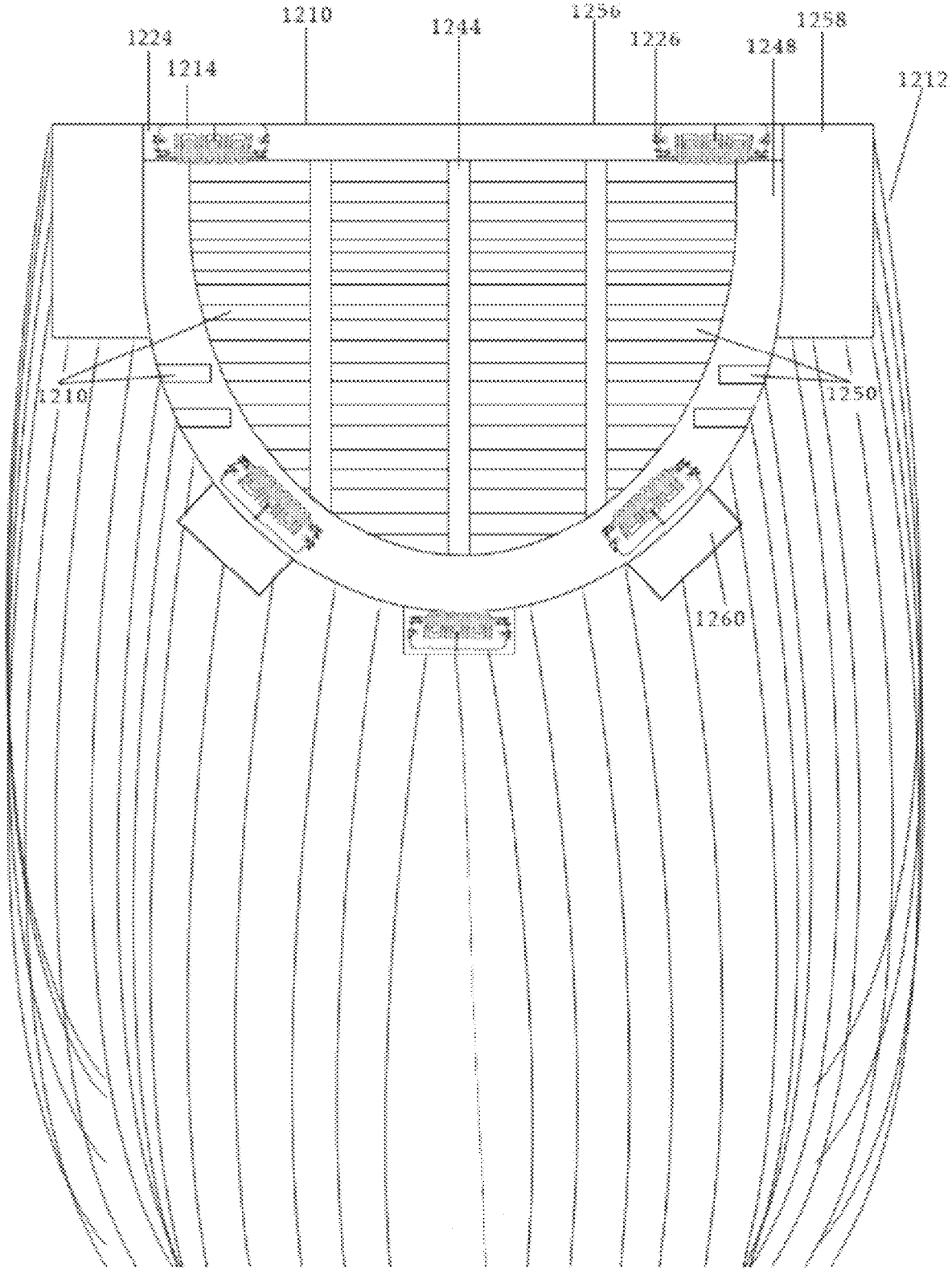
FIG. 12A, FIG. 12B, FIG. 12C, and FIG. 12D illustrate an exemplary clip-in hair extension that maybe multi-layered with an irregular configuration, in accordance with an embodiment of the present invention.
Figure 12B:
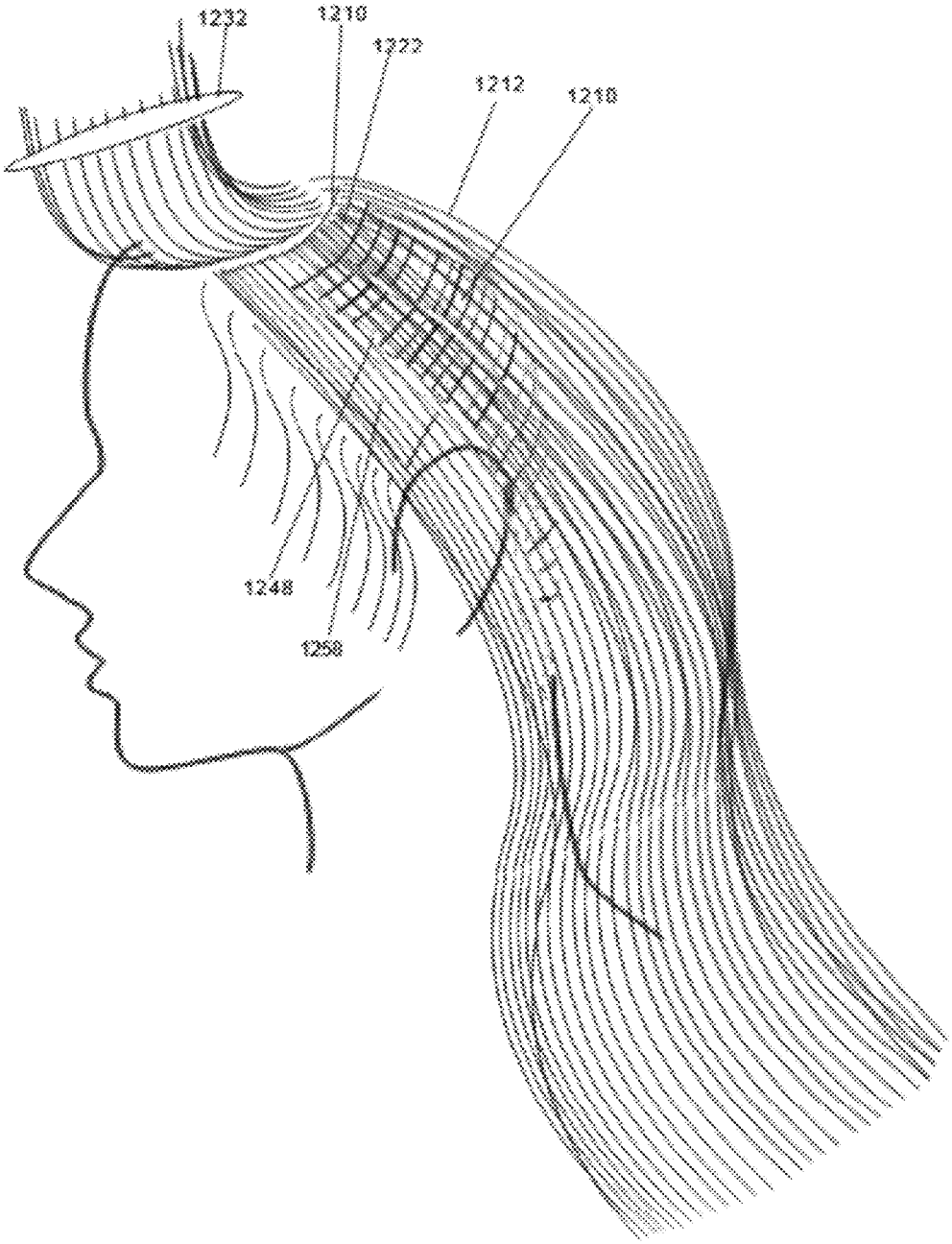
Figure 12C:
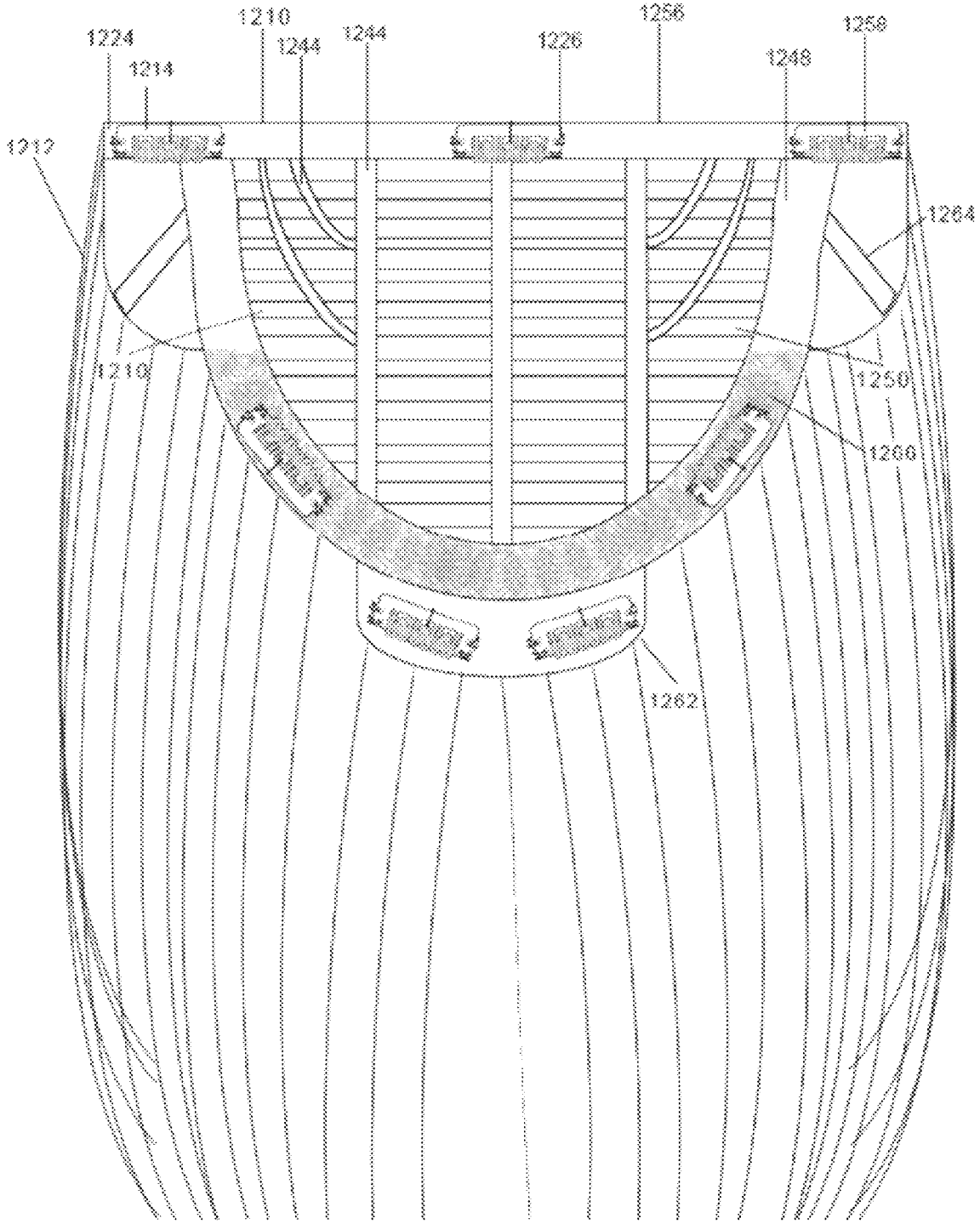
Figure 12D:
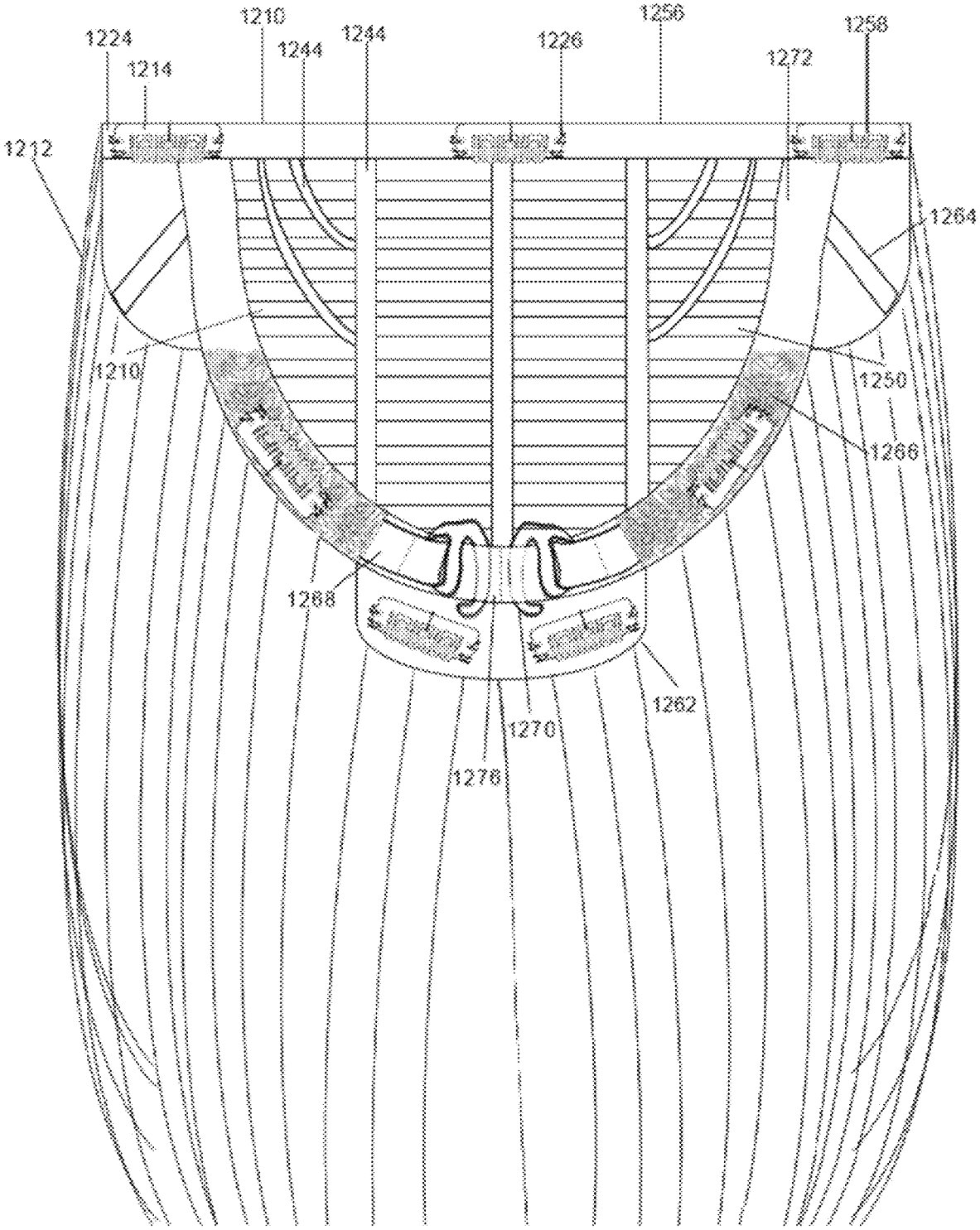

FIG. 12A and FIG. 12B illustrate an exemplary clip-in hair extension that may be multi-layered with an irregular configuration, in accordance with an embodiment of the present invention. FIG. 12A is a diagrammatic rear view, and FIG. 12B is a diagrammatic front view showing the embodiment after the clip attachments are closed securely to the user's natural hair. In the present embodiment, the multi-layered irregularly shaped clip-in hair extension (or referred to as a hairpiece) may be applied to a user's natural hair for extra length and/or fullness. FIG. 12C illustrates an exemplary clip-in hair extension as another version of the multi-layered irregular configuration, in accordance with an embodiment of the present invention with the addition of woven material to enable the user to wear the embodiment in an up do or ponytail. FIG. 12C may contain variations in structural support within the embodiment that may be different from FIG. 12A. FIG. 12C is the diagrammatic rear view, and FIG. 12B is the diagrammatic front view. FIG. 12D illustrate an exemplary clip-in hair extension as another version of the multi-layered irregular configuration, in accordance with an embodiment of the present invention that is adjustable and may contain variations in structural support different from FIG. 12A while allowing the user to wear the multi-layered irregular configuration of the embodiment in ponytail or up do. FIG. 12D is the diagrammatic rear view, and FIG. 12B is the diagrammatic front view.

This embodiment is an improvement upon the current multi-layered clip-in hair extensions on the market that may be created with sewn wefts. The hair extensions created with sewn wefts may be easily felt as the user run's their fingers through their hair and have the aforementioned problems such as, but not limited to, bulkiness, heaviness, hair shedding, visibility, and the inability of the user to wear the hair extension unit in a ponytail or up do without visibility problems. The improvement of the current irregularly shaped clip in hair extension on the market with the addition of the invention may result in a clip-in hair extension that may be lighter in weight, discreet and durable where the invention is present. The variation of the embodiment shown with FIG. 12C and FIG. 12D may allow the user to wear the add-on hair attached to the embodiment in a ponytail or up do.

In FIG. 12A and as also illustrated in FIG. 12B, FIG. 12C, and FIG. 12D, weft 1210 may comprise human or synthetic hair strands 1212 attached to the front side 1222 of each thin weft 1210 and pressure sensitive clips 1214 attached to the underside of the embodiment to secure the irregularly shaped clip-in hair extension to the user's natural hair. It is contemplated that some of the wefts may be implemented without clips. In the present embodiment, there may be two different sized thin wefts 1210 including the top thin weft 1256 and the multiple thin wefts 1250. The top thin weft 1256 and circular border 1248 create the border in the irregularly shaped clip-in hair extension. The multiple thin wefts 1250 create the center in the embodiment. The circular border 1248 may be extended by optional side extensions 1258 and lower extensions 1260. The top thin weft 1256 maybe located at the top of the irregular configuration creating the upper most border of the embodiment and faces the front of the embodiment. The top thin weft 1256 may comprise human or synthetic hair strands 1212 attached to the front side of the top thin weft 1256. The underside 1224 of the top thin weft 1256 may be smooth with no added hairs attached. The top thin weft 1256 may contain at least one pressure sensitive clips 1214 attached to the underside of the top thin weft to serve as the connection point of the irregular clip-in hair extension unit to the user's natural hair. The top thin weft 1256 may connect to the ends of the circular border 1248 and along the side extension 1258. The underside of the top thin weft 1256 may be connected to linking material 1244. The top thin weft 1256 may be a rectangular shape as illustrated in FIG. 12A. In some embodiments however, it is optional to create the top thin weft in, without limitation, c-shape, v-shape, irregular shape, s-shape etc. to accommodate different hairstyles. In some embodiments, it may be optional to add a cosmetic or light protective covering material to the underside of the top thin weft 1256 or any thin weft 1210 in the embodiment either before attaching the clips 1214 or after attaching the linking material 1244, that is colored, transparent, or opaque such as, but not limited to, lace, stretch lace, stretch material, mesh, monofilament, thin skin, silicone, hook and loop material, or other lightweight material that is sewn or otherwise attached to the underside of the combined thin weft. The center of the hair extension unit may be created with multiple thin wefts 1250 containing human or synthetic hair strands attached to the front side 1222 of the multiple thin wefts 1250. The underside 1224 of the multiple thin wefts 1250 may be smooth with no added hairs and no clips attached. In some embodiments it may be optional to add clips to the underside of the thin wefts 1250. The thin wefts 1210 may lay parallel to the top thin weft 1256 extend or point to each side of the circular border weft 1248. The ends of the multiple thin wefts 1250 may connect to the circular border 1248 by overlapping the front side of the circular border 1248 and wrapping around to the underside of the circular border 1248 where there are no lower extensions 1260 present starting from below the side extension 1258. In some embodiments, it may be optional not to wrap the multiple thin wefts 1250 around the circular border 1248 but to connect the multiple thin wefts 1250 to either the front side of the circular border 1248 as shown in FIG. 12C and FIG. 12D or to the underside of the circular border 1248. The underside of the multiple thin wefts 1250 may overlap and be connected to the front side of linking material 1244. The multiple thin wefts 1250 are rectangular in shape. In some embodiments, the multiple thin wefts 1250 may be created in different shapes to create the desired hairstyle such as but not limited to s-shape, c-shaped, irregularly shaped, etc. The circular border 1248 is part of the border of the irregular clip-in hair extension and may be created from woven material that maybe stretch or non-stretch material such as but not limited to monofilament, fabric material, lace, stretch lace, silk, elastic, chord, etc. In some embodiments, it may be optional to create the circular border 1248 with the same polymer material used to create the thin wefts 1210 or other polymer material such as but not limited to silicone, thin skin, nylon, etc. The circular border 1248 may have no hairs attached to the front side and underside of the circular border 1248. In some embodiments, it may be optional to attach or insert human or synthetic hairs to the front side and/or perimeter of the circular border. The circular border 1248 may have one or more clips 1214 attached to the underside of the circular border 1248. In some embodiments, it maybe optional to not add clips to the underside of the circular border weft. The circular border 1248 may connect to the top thin weft 1256 and along the side extension 1258. In some embodiments, it may be optional to form the circular border 1248 as part of the top thin weft 1256 made with the same polymer material used to create the thin wefts 1210 to create one border of the embodiment eliminating the need to connect the circular border 1248 and the top thin weft 1250 together. The circular border 1248 may also be another configuration such as, without limitation, irregular, triangular, square, rectangular, etc. The side extensions 1258 illustrated in FIG. 12A and as illustrated in other versions of the embodiment in FIG. 12C and FIG. 12D, may serve as the extension of the circular border to provide more coverage to the user's hairline. The side extensions 1258 may be cut by the user for a customized fit of the multi-layered clip-in hair extension unit to the user's head shape and hairline. The side extensions 1258 may connect to the circular border 1248 and the both ends of the top thin weft 1250. The side extensions 1258 may extend or point from the top thin weft 1248 and end above or at the user's ear. The side extensions 1258 may be made of one or more layers of lace or other woven material that may be stretch or non-stretch material such as but not limited to monofilament, lace, stretch lace, elastic, fabric material, silk, etc. In some embodiments, it may be optional to create the side extensions 1258 with the same polymer material used to create the thin wefts 1210 or other polymer material, such as but not limited to silicone, thin skin, nylon, etc. The side extensions 1258 may contain hand tied or inserted human or synthetic hair strands attached to the front side and along the perimeter of the side extension. There may be no hairs attached to the underside of the side extension. In some embodiments, it may be optional to attach hair strands to the underside of the side extension. The underside of the side extension 1258 may not contain clips. In some embodiments, it may be optional to add clips to the underside of the side extension 1258 depending upon user preference. In some embodiments, it may be optional to attach thin wefts containing human and synthetic hairs to the front side of the side extensions 1258 and clips to the underside of the side extension with the woven material of the side extensions 1258 serving as a lightweight protective covering that may allow the attachment of hand tied or inserted human or synthetic hair strands along the perimeter of the side extension to cover the ends of the thin wefts. In some embodiments it may be optional to extend and connect the top thin weft 1256 over the side extension for additional structural support with or without human or synthetic hair strands attached to the portion of the side extension that maybe overlapped by the top thin weft 1256. In some embodiments, the side extension may be attached to the embodiment by adjustable means such as, but not limited to, hooks, clasps, sliders, snaps etc. to allow the user to remove and add the side extensions 1258 depending upon the desired hairstyle. The side extension may be any length, width or shape such as, but not limited to, rectangular, square, irregular, circular, c-shape, s-shaped etc. to match the user's side head shape and hairline. In some embodiments, it may be optional to remove the side extension entirely or not add the side extension to the embodiment to enable the user to leave out more of their natural hair along their hairline. As illustrated in FIG. 12A, one or more lower extensions 1260 may serve as a lower point of attachment the circular border 1248 to the back or nape areas of the user's natural hair. It is contemplated that the number of lower extensions 1260 connected to the circular border may vary. The lower extensions 1260 may be made of a woven material that may be stretch or non-stretch material such as, but not limited to, monofilament, lace, stretch lace, elastic, fabric material, silk, etc. In some embodiments, it may be optional to create lower extensions with the same polymer material used to create the thin wefts 1210 or other polymer material, such as, but not limited to, silicone, thin skin, nylon, etc. The three lower extensions 1260 illustrated in FIG. 12A may be connected along the bottom of the circular border 1248 with no hair strands attached to the front side or underside of the lower extensions 1260. In some embodiments, it may be optional to attach human or synthetic hair strands to the front side of the lower extensions. Clips 1214 may be attached to the underside of one or more lower extensions 1260. In some embodiments, it maybe optional to not add clip attachments to the lower extensions. It is contemplated that the user may cut the size of the lower extensions to leave out more of the user's natural hair in the back or nape areas of the user's head. The lower extension 1260 may be any size, length or shape inclusive of rectangular, square, circular, triangular, doughnut, irregular, etc. depending upon the user's preference. In some embodiments, it may be optional to remove or not add the lower extensions entirely from the embodiment depending on user preference and/or if clip attachments are present elsewhere in the irregular configuration of the clip-in hair extension embodiment. In the present embodiment, the top thin weft 1256, circular border 1248, and multiple thin wefts 1250 in the irregular configuration of the clip-in hair extension may be connected by and overlap linking material 1244 where they touch, intersect, or overlap the linking material. Linking material 1244 may be created from a woven material that maybe stretch or non-stretch material such as, but not limited to, elastic, lace, stretch lace, braided material, mesh, monofilament, silk, cotton, mesh, ribbons, leather, pleather, chord etc. In some embodiments, it may be optional to create linking material with the same polymer material used to create the thin wefts or other polymer material that may be stretch or non-stretch material such as, but not limited to, silicone, thin skin, nylon, plastic mesh, rubber material, etc. Linking material 1244 may not have hair strands attached. In some embodiments, it may be optional to attach human or synthetic hair strands to the linking material. The number of linking material 1244 added may vary depending upon the shape and size of the irregular clip-in embodiment.

In the present embodiment all thin wefts may be created with a polymer material. However, one may replace one or more thin wefts in this embodiment with a woven or polymer material such as, but not limited to, fabric material, stretch material, monofilament, thin skin, silicone, lace, silk, nylon, stretch lace, stretch material, stretch polymer, elastic etc. In a non-limiting example, the multiple thin wefts 1250 may be replaced with a polymer material such as, without limitation, silicone connected by secure means to the circular border 1248 such as, but not limited to, thread 1226, rivet, eyelet, clasps, hook and loop material, etc. The thin wefts, borders, extensions, and linking material in the irregular clip-in hair extension embodiment may be connected or attached in the irregular configuration by sewing or other secure attachment means such as, but not limited to, permanent adhesives resistant to oil, or tacks or tack like beads, rivets, eyelets, etc. that may act as nails with or without a backing, washer, or cap. In some alternate embodiments the thin wefts, borders, extensions, and linking material may be connected or attached by adjustable attachment means including, without limitation, adjustable elastic wig straps, hook and loop material, clasps, sliders or snaps to enable the user to change the fit or configuration of the irregular clip-in hair extension if desired. This embodiment of the invention is not limited to the irregular configuration. This embodiment of the invention may be configured into any shape inclusive of, but not limited to, rectangular, square, triangular, irregular shape, irregular circle, etc. to suit the needs of the intended hairstyle. In some embodiments, it may be optional to insert or tie human or synthetic hair strands into the underside, perimeter, and/or border of the thin wefts, borders, extensions, and linking material in the embodiment depending upon the desired hairstyle. It is contemplated that hair clip attachments may be attached to any thin wefts, borders, extensions, and linking material in the embodiment depending upon user preference. It is contemplated that various different types of attachment means may be used to connect the embodiment to the user's natural hair such as, but not limited to, pressure sensitive clips, non-pressure sensitive clips, wig combs, combs, hair pins, elastic bands, stretch lace, etc. The clip attachments may be secured to any thin wefts, borders, extensions, and linking material in the multi-layered clip in hair extension embodiment by secure means such as sewing, or other secure attachment means such as, but not limited to, permanent adhesives resistant to oil or tacks or tack like beads, rivets, eyelets, etc. In the present embodiment, the thin wefts are of the same density. In some embodiments, it may be optional to make the thin wefts of the different densities depending on the desired hairstyle. For example, in some embodiments, it may be optional to create multiple thin wefts 1250 in a smaller density than the top thin weft 1256 for a lighter weight of the embodiment.

FIG. 12C is a diagrammatic rear view of the embodiment where there may be no lower extensions 1260 present. FIG. 12B is the diagrammatic front view. FIG. 12C illustrates the attachment of lace 1266 around the circular border weft 1248 to allow the attachment of hand tied or inserted human or synthetic hair strands 1212 to enable the user to wear the embodiment as a ponytail or up do. The circular border 1248 may be covered with any woven or polymer material that may be stretch or non-stretch material such as, but not limited to, stretch lace, stretch material, elastic, silk, nylon, fabric material, thin skin, silicone or monofilament. In this variation of the embodiment, clips 1214 may be attached to the underside of the circular border 1248 to secure the circular border 1248 to the user's natural hair. In this version of the embodiment the top thin weft 1256 extends along the top of the side extension 1258. The top thin weft 1256 connects the top of the side extension by sewing with thread or other secure attachment means. The side extension 1258 in this version of the embodiment may be an irregular shape.

FIG. 12D is a diagrammatic rear view of the embodiment where the circular border 1248 and border extensions 1262 may be replaced with different materials to create an adjustable clip-in hair extension to allow the user to customize the fit of the embodiment to the user's head shape. FIG. 12B is the diagrammatic front view. The circular border in FIG. 12A is replaced with a side border 1272, adjustable straps 1268, and bottom border 1274. The side border 1272 may connect to and extend or point from the top thin weft 1256 to the adjustable straps 1268. The side border 1272 may also be connected to the side extension 1258. In this version of the embodiment, the top thin weft 1256 overlaps the side extension 1258 for additional structural support without human or synthetic hair strands attached to the portion of the side extension 1258 that may be overlapped by the top thin weft 1256. The adjustable straps 1268 extend and point from the side border 1272 to the bottom border 1274. The side border 1272 and bottom border 1274 may be made out of woven materials that may be stretch or non-stretch materials such as, but not limited to, monofilament, lace, stretch lace, elastic, rubber, fabric material, silk, etc. The adjustable straps 1268 may be elastic and made with stretch material such as, but not limited to, rubber or latex. In some embodiments, it may be optional to make the side border, bottom border, and adjustable straps out of the same polymer material used to create the thin wefts or other polymer material such as, but not limited to, silicone, thin skin, nylon, etc. The side border 1272, adjustable straps 1268, and bottom border 1274 are connected together within the irregular configuration of the embodiment by secure means such as sewing with thread or other secure attachment means such as, but not limited to, permanent adhesive resistant to oil, rivets, eyelets, or other secure connection method. The adjustable straps 1268 may contain hooks 1270 that may be inserted into loops 1276 sewn with thread or otherwise attached to the underside of the bottom border 1274 to enable the user to customize the fit of the embodiment to their head shape. The adjustable straps 1268 and bottom border 1274 may be covered with lace 1266 to allow the attachment of hand tied or inserted human or synthetic hair strands to enable the user to wear the adjustable hair extension embodiment in a ponytail or up do. In some embodiments, it may be optional not to add a lace covering to the adjustable straps and bottom border.

FIG. 12C and FIG. 12D illustrate the addition of boning material 1258, extra linking material 1244 and an optional bottom extension 1262 which are not present in FIG. 12A. Boning material 1264 maybe added to any side extension 1258 that maybe present for additional structural support. Additional linking material 1244 may be extend and point from the top thin weft 1256 to other linking material 1244 in FIG. 12C & FIG. 12D for additional structural support. In some embodiments, it maybe optional to extend or point additional linking material from the top thin weft to any thin weft, border, or extension within the embodiment. In some embodiments, it may be optional to connect the linking material to the adjustable straps 1268 and bottom border. In some embodiments, a single bottom extension 1262 may be added to provide coverage of the user's nape area with the embodiment. The bottom extension 1262 maybe made of woven material such as, but not limited to, fabric material, stretch material, non-stretch material, monofilament, lace, stretch lace, elastic, silk, etc. to allow the attachment of hand tied or inserted human or synthetic hair strands to the front side and along the perimeter of the bottom extension 1262. In some embodiments, it may be optional to create the bottom extension with the same polymer material used to create the thin wefts 1210 or other polymer material such as, but not limited to, silicone, thin skin, nylon, etc. There may be one or more clip attachments 1214 attached to the underside of the bottom extension 1262 in FIG. 12C. There may be no clip attachments 1214 attached to the underside of the bottom extension 1262 in FIG. 12D. In some embodiments, it may be optional to attach thin wefts containing human and synthetic hairs to the front side of the extensions and clips to the underside of the extensions with the woven material of the extensions serving as a lightweight protective covering that may allow the attachment of hand tied or inserted human or synthetic hair strands along the perimeter of the bottom extension to cover the ends of the thin wefts. The bottom extension 1262 may be any size or shape such as, but not limited to, irregular, circular, rectangular, square irregular circle, s-shape, c-shape, etc. to allow the bottom extension 1262 to cover the nape area of the user's natural hair. In some embodiments, it may be optional for the bottom extension to not be present if coverage of the nape area of the user's natural hair is not needed.

In some embodiments, it may be optional to attach within the irregular shaped clip-in hair extension, or hair piece, on top, or below the embodiment a closure, lace frontal unit, bang, side part or other hairpiece created with, without limitation, lace, thin skin, monofilament, stretch material, silk or other lightweight woven or polymer material.

In some embodiments, the top thin weft may be the only application of the invention to the current irregular clip-in hair extension units created with sewn wefts with human or synthetic hair strands attached to the front side of the top thin weft and at least one clip attached to the underside of the top thin weft. In some embodiments, the invention may be applied elsewhere within the irregular clip-in hair extension such as, but not limited to, the side extension, circular border, bottom border and/or lower extensions to create the desired hairstyle. However, the usage of sewn wefts may contain the aforementioned problems with sewn wefts including, but not limited to, reducing the durability of the adjustable hair extension unit and increasing the bulkiness, visibility, weight, etc.

In a typical use the installer may attach this embodiment of the invention as a irregularly shaped multi-layered clip-in hair extension, or hairpiece, to a user's natural hair in a manner similar to that described, by way of example, in accordance with FIG. 2A through FIG. 2D. The installer may first open all clip attachments 14 in the irregular configuration of the embodiment as shown similarly in FIG. 2A. Then the installer may create a part in the top, or crown areas of the user's hair 34 to match the configuration of the top thin weft in the embodiment in a similar manner as the part 30 created in FIG. 2B. If the installer would like to leave out a portion of the user's natural hair 34 around the sides, back and/or nape areas of the embodiment, the installer may then create an additional part 30 in the sides, back and/or nape areas of the user's natural hair 34 which may be left out around the irregular configuration of the embodiment. The installer may then secure the sectioned off hair 30 with a hair clip 32 as shown in FIG. 2C also labeled as a hair clip 1232 as shown in FIG. 12B. The installer may secure the user's natural hair 34 that will lay beneath the embodiment with a hairstyle that may allow the irregular clip-in hair extension to lay as flat as possible against the user's head such as, but not limited to, a flat bun, french braid, twists, braids, cornrows, a twisted ponytail, etc. The flat hairstyle created in the center of the user's head may be secured as flat as possible with styling tools such as, but not limited to, sewing with thread, bobby pins, rubber bands, hair clip, hair tie etc. The next step may be to position the top thin weft in the embodiment along the part 30 created in the top, or crown areas of the user's natural hair 34. Then the installer may insert the teeth 16 of the open clips 14 into the user's natural hair 34 along the part 30 created in the top, or crown areas of the user's head near the roots of the user's natural hair 34, but not directly on the scalp, which is similarly shown in FIG. 2B starting with the clips 14 in the top thin weft of the irregular embodiment. After the teeth 16 of the clips 14 are inserted into the user's natural hair 34 near the roots, the installer may then close the clip 14 to secure the invention flat within the user's natural hair 34 near the roots so that the inserted or tied human or synthetic hair strands 12 may move naturally. For the purpose of illustration, a pressure sensitive clip may be attached to the thin weft by means of sewing with thread 1226. Other suitable clip attachments and attachment methods of the clip to the thin weft previously mentioned may be used in this embodiment. The insertion and closure of the clips 14 in the irregular configuration of the embodiment of the invention may continue where clips 14 are present to secure the embodiment over the flatly secured center of the user's natural hair 34 which may lay underneath the embodiment similarly shown in FIG. 2C.

If the embodiment of the invention being installed contains adjustable straps 1268 along the bottom border 1274, as illustrated in FIG. 12D, the installer may pull the hooks 1270 attached to the adjustable straps 1268 until the clip-in hair extension felt snug around the user's head covering the flatly secured center of the user's natural hair 34. Then the installer may insert the hooks 1270 into the loops 1276 attached to the underside of the bottom border 1274 to customize the fit of the embodiment to the user's head shape as illustrated in FIG. 12D.

The installer may use the sectioned off hair in the top, or crown areas and sides, back and/or nape areas of the user's head in combination with the flat hairstyle of the user's natural hair which may lie beneath the embodiment to guide the installation of the irregular clip-in hair extension around to the user's natural hair. In some embodiments, it is also optional to let the user's natural hair hang freely underneath the irregular clip-in hair extension unit. In some embodiments, it may be optional to pull the user's natural hair in between the multiple thin wefts of the embodiment with a comb when the user's natural hair is left loose beneath the irregular clip-in hair extension to create the desired hairstyle when a cap created with woven or polymer materials may not present. Once the clips 14 are closed securely similarly to FIG. 2C, the installer may then remove the hair clip 32 from the user's natural hair 34 along the top, or crown areas as well as the sides, back and/or nape areas of part 30 and comb the user's natural hair 34 over the irregularly shaped clip in hair extension embodiment of the invention as shown similarly in FIG. 2D to complete the installation or otherwise style.

Figure 13A:
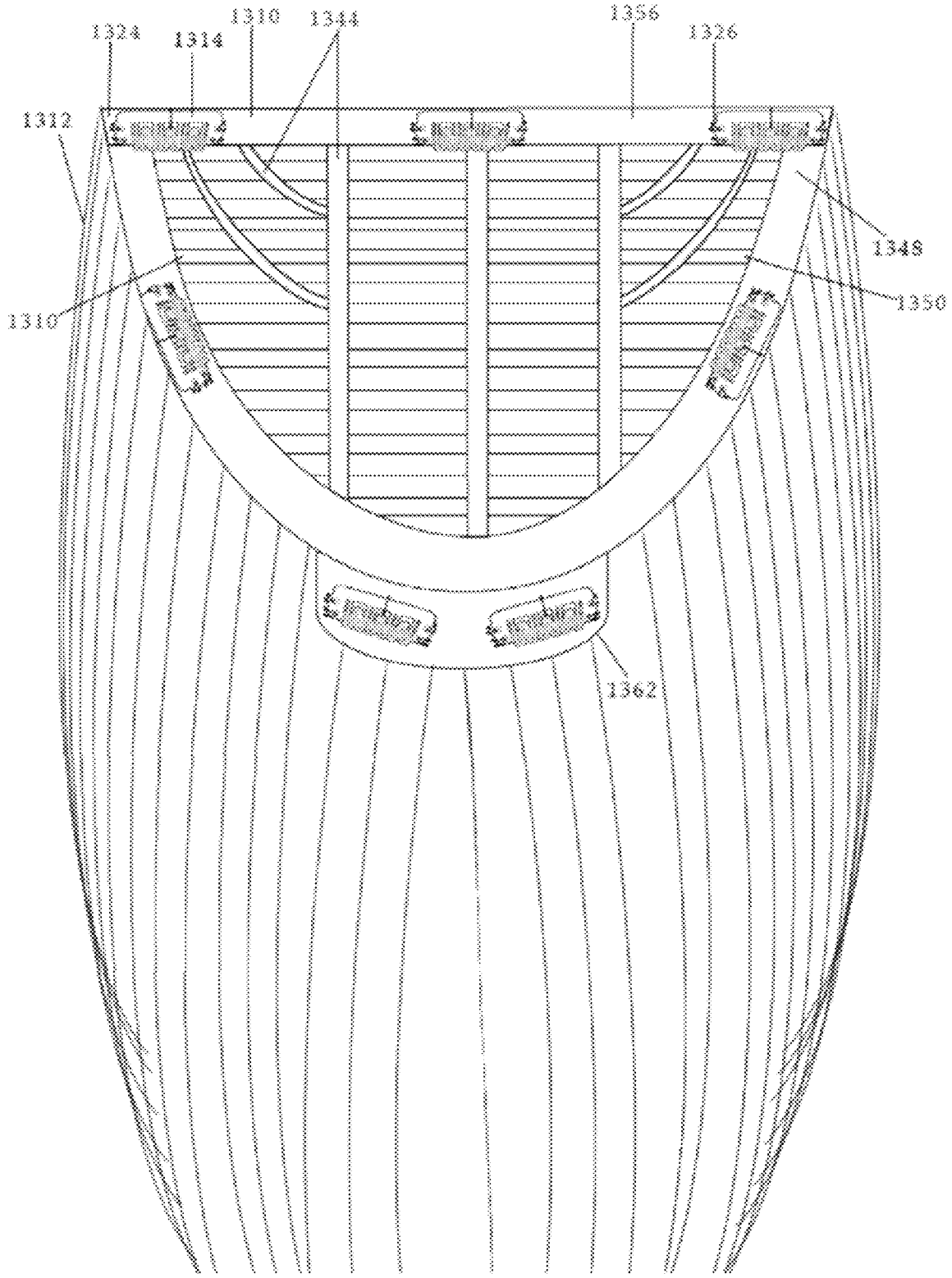
FIG. 13A and FIG. 13B illustrate an exemplary a clip-in hair extension that maybe multi-layered with an irregular configuration, in accordance with an embodiment of the present invention.
Figure 13B:
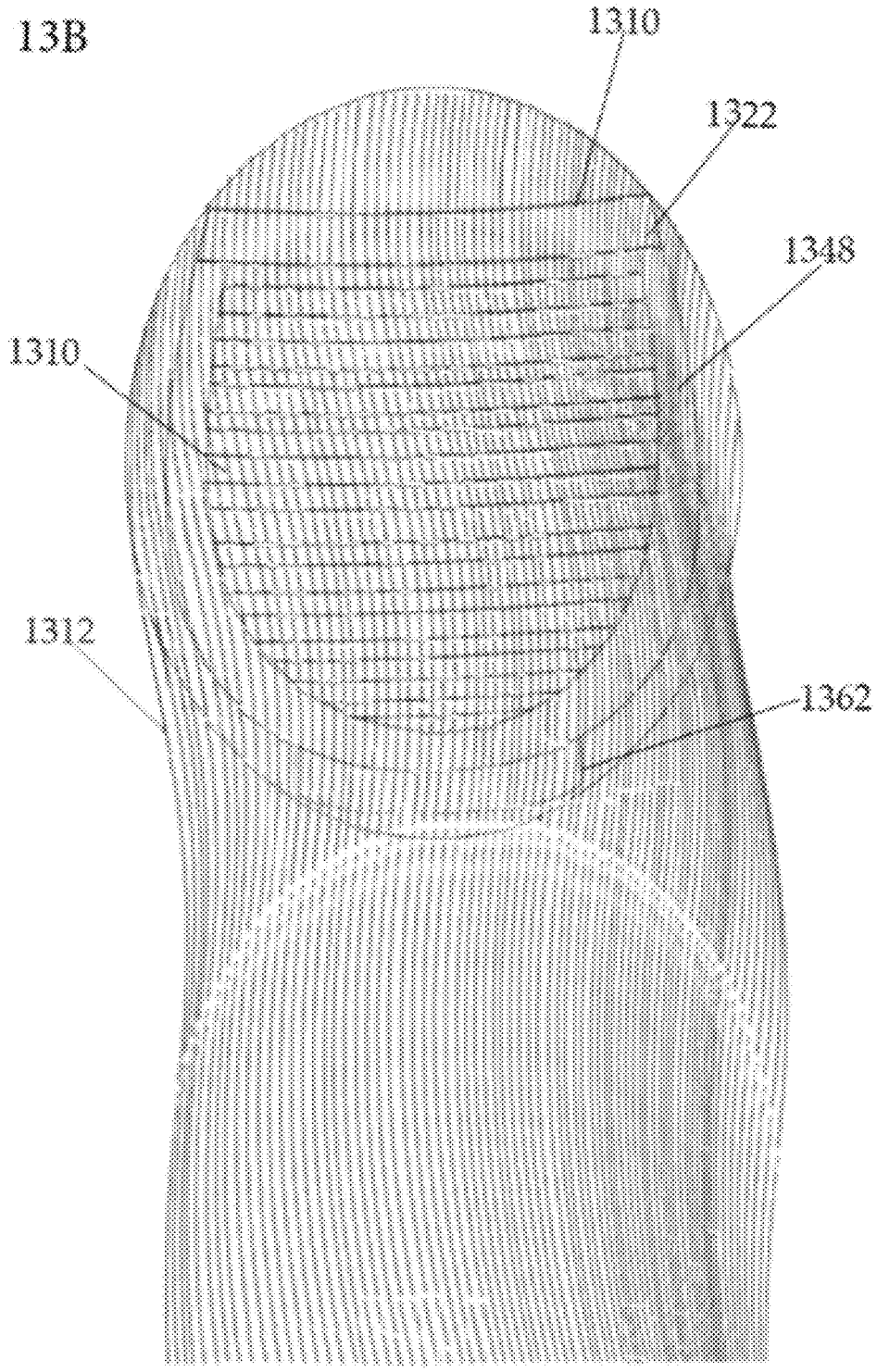

FIG. 13A and FIG. 13B illustrate a version of the embodiment as a clip-in hair extension, or hair piece, that may be multi-layered with an irregular configuration, in accordance with an embodiment of the present invention. FIG. 13A is a diagrammatic rear view, and FIG. 13B is the diagrammatic front view. In the present embodiment a thin weft 1310 creates the top border in the irregularly shaped clip-in hair extension containing human or synthetic hair strands 1312 attached to the front side 1322 of the thin weft 1310 as shown in FIG. 13A and clips 1314 attached to the underside 1324 of the thin weft as shown in FIG. 13A. The embodiment contains two different thin wefts 1310, the top thin weft 1356 and the multiple thin wefts 1350.

Typically a user may wear the embodiment configured as an irregular shaped clip-in hair extension, or hair piece, because the add-on hairs attached to the thin weft may appear as natural hairs growing from the user's scalp. Also, if the user's natural hair is moved voluntarily or involuntarily, the clip-in hair extension embodiment of the invention may not be detectable because the top border of the embodiment is lined with a thin weft with attached human or synthetic hair strands that move naturally and blend with the user's natural hair near the roots. The user may also run their fingers through their hair with the clip-in hair extension attached and not feel the thin weft border unlike current clip-in hair extensions on the market created with sewn wefts. In addition, the thin weft is neither easily damaged nor do the add-on hairs shed when attached to the thin weft, thereby increasing the usability of the clip-in hair extension. The embodiment does not contain a cap which may result in a clip-in hair extension that may have increased breathability to the user's natural hair and scalp. The absence of a cap may also allow the user to increase the volume of the clip-in hair extension by pulling strands of their own hair in between the thin wefts without concern for damage to their natural hair.

In FIG. 13A and as also illustrated in FIG. 13B, the top thin weft 1356 may comprise human or synthetic hair strands 1312 attached to the front side of the top thin weft 1356 and no hair strands attached to the underside 1234 of the top thin weft 1356. The top thin weft 1356 may contain at least one pressure sensitive clips 1314 attached to the underside of the top thin weft to serve as the connection point of the irregular clip-in hair extension unit to the user's natural hair. The top thin weft 1356 may connect to the ends of the circular border 1348. Multiple thin wefts 1350 may create the center of the irregular clip-in hair extension configuration with a slim density containing human or synthetic hair strands 1312 attached to the front side of the multiple thin wefts 1350 and no hairs attached to the underside of the thin wefts. The circular border 1348 which creates the border of this embodiment may be created from woven material that maybe stretch or non-stretch material such as, but not limited to, monofilament, fabric material, lace, stretch lace, silk, elastic, chord, etc. In some embodiments, it may be optional to create the circular border 1348 with the same polymer material used to create the thin wefts 1310 or other polymer material such as, but not limited to, silicone, thin skin, nylon, etc. The circular border 1348 may not contain human or synthetic hair strands 1312 attached on the front side 1322 of the circular border 1348. In some embodiments, it may be optional to add human or synthetic hair strands to the front side, perimeter, or underside of the circular border. The circular border 1348, top thin weft 1356, and multiple thin wefts 1350 maybe connected by and overlap linking material 1344 in the irregular configuration of the embodiment where they touch, interest, or overlap the linking material. Linking material 1344 may also be attached to other linking material 1344. Linking material 1344 may be created from a woven material that maybe stretch or non-stretch material such as, but not limited to, elastic, lace, stretch lace, latex, braided material, mesh, monofilament, silk, cotton, mesh, ribbons, leather, pleather, chord etc. In some embodiments, it may be optional to create the linking material with the same polymer material used to create the thin wefts or other polymer material that may be stretch or non-stretch material such as, but not limited to, silicone, thin skin, nylon, plastic mesh, rubber material, etc. Linking material 1344 may not have hair strands attached. In some embodiments, it may be optional to attach human or synthetic hair strands to the linking material. The number of linking material 1344 added may vary depending upon the shape and size of the irregular clip-in embodiment. In some embodiments, it may be optional to add a lightweight material such as lace or other woven material such as, but not limited to, monofilament, silk, etc. around the circular border 1348 to allow the attachment of hand tied or inserted human or synthetic hair strands to the front side and perimeter of the circular border 1348 to enable the user to wear the irregular shaped embodiment in a ponytail or up do. The underside of the circular border 1348 may contain clip attachments 1314. In some embodiments, it may be optional to add clips 1314 to any thin weft 1310 in the irregularly shaped clip-in hair extension. The clip attachments 1314 may be any clip inclusive of, but not limited to, pressure sensitive hair clips or non-pressure sensitive wig clips or any other type of clip attachment that will secure the fall to the user's natural hair. The clip attachments 1314 may be attached to the underside of the thin weft 1310 in a variety of ways including, but not limited to, sewing with thread, permanent adhesive resistant to oil, rivets, or eyelets depending upon preference. For illustrative purposes only, the clips 1314 are attached with thread 1326 to the underside 1324 of the thin weft. In some embodiments, a single bottom extension 1362 may be added to provide coverage of the user's nape area with the embodiment. The bottom extension 1362 may be made of woven material such as, but not limited, to fabric material, stretch material, non-stretch material, monofilament, lace, stretch lace, elastic, silk, etc. to allow the attachment of hand tied or inserted human or synthetic hair strands to the front side and along the perimeter of the bottom extension 1362. There may be clip attachments attached to the underside of the bottom extension 1362. In some embodiments, there may be no clip attachments added to the underside of the bottom extension. In some embodiments, it may be optional to create the bottom extension with the same polymer material used to create the thin wefts or other polymer material such as, but not limited to, silicone, thin skin, nylon, etc. In some embodiments, it may be optional to attach thin wefts containing human and synthetic hairs to the front side of the thin wefts and clips to the underside of the thin wefts with the woven material of the bottom extension serving as a lightweight protective covering that may allow the attachment of hand tied or inserted human or synthetic hair strands along the perimeter of the bottom extension to cover the ends of the thin wefts. The bottom extension 1362 may be any size or shape such as, but not limited to, irregular, circular, rectangular, square irregular circle, s-shape, c-shape, etc. to allow the bottom extension 1362 to cover the nape area of the user's natural hair. In some embodiments, it may be optional for the bottom extension to not be present if coverage of the nape area of the user's natural hair is not needed. In some embodiments, it may be optional to add a cap to the center of the embodiment beneath the underside of the multiple thin wefts 1350 created with a lightweight, woven or polymer material that maybe stretch or non-stretch material such as, but not limited to lace, stretch lace, elastic, thin skin, silicone or monofilament, nylon, etc. that may be connected to the circular border 1348 by sewing, permanent adhesive, rivets, eyelets, or other secure connection method. In some embodiments, it may be optional to add a cap made of woven or polymer material to the center of the embodiment without the addition of the multiple thin wefts 1350. This embodiment of the invention is not limited to an irregular configuration. This embodiment of the invention may be configured into any shape inclusive of, but not limited to, rectangular, square, triangular, irregular circle, etc. to suit the needs of the intended hairstyle.

In some embodiments, it may be also optional to attach within the irregular shaped clip-in hair extension, on top, or below the embodiment a closure, lace frontal unit, bang, side part or other hairpiece created with, without limitation, lace, thin skin, monofilament, stretch material, silk or other lightweight woven or polymer material. In some embodiments, it may be also optional to add adjustable straps in the nape area.

The installer may attach this embodiment of the invention as a irregularly shaped multi-layered clip-in hair extension or hairpiece, to a user's natural hair in a manner similar to that describe by way of example in accordance with FIG. 2A through FIG. 2D. The installer may first open all clip attachments 14 in the irregular configuration of the embodiment as shown similarly in FIG. 2A. Then the installer may create a part in the top, or crown areas of the user's hair 34 to match the configuration of the top thin weft in the embodiment in a similar manner as the part 30 created in FIG. 2B. If the installer would like to leave out a portion of the user's natural hair 34 around the sides, back and/or nape areas of the embodiment, the installer may then create an additional part 30 in the sides, back and/or nape areas of the user's natural hair 34 which may be left out around the irregular configuration of the embodiment. The installer may then secure the sectioned off hair 30 with a hair clip 32 as shown in FIG. 2C. The installer may secure the user's natural hair 34 that may lay beneath the embodiment with a hairstyle that may allow the irregular clip-in hair extension to lay as flat as possible against the user's head such as, but not limited to, a flat bun, French braid, twists, braids, cornrows, a twisted ponytail, etc. The flat hairstyle created in the center of the user's head may be secured as flat as possible with styling tools, such as, but not limited to, sewing thread, bobby pins, rubber bands, hair clip, hair tie etc. The next step may be to position the top thin weft in the embodiment along the part 30 created in the top, or crown areas of the user's natural hair 34. Then the installer may insert the teeth 16 of the open clips 14 into the user's natural hair 34 along the part 30 created in the top, or crown areas of the user's head near the roots of the user's natural hair 34, but not directly on the scalp, which is similarly shown in FIG. 2B starting with the clips 14 in the top thin weft of the irregular embodiment. After the teeth 16 of the clips 14 are inserted into the user's natural hair 34 near the roots, the installer may then close the clip 14 to secure the invention flat within the user's natural hair 34 near the roots so that the inserted or tied human or synthetic hair strands 12 may move naturally. For the purpose of illustration, a pressure sensitive clip is attached to the thin weft by means of sewing with thread 1326. Other suitable clip attachments and attachment methods of the clip to the thin weft previously mentioned may be used in this embodiment. The insertion and closure of the clips 14 in the irregular configuration of the embodiment of the invention may continue where clips 14 are present along embodiment to secure the embodiment over the flatly secured center of the user's natural hair 34 which may lay underneath the embodiment similarly shown in FIG. 2C.

The installer may use the sectioned off hair in the top, or crown areas and sides, back and/or nape areas of the user's head in combination with the flat hairstyle of the user's natural hair which may lie beneath the embodiment to guide the installation of the irregular clip-in hair extension around to the user's natural hair. In some embodiments, it may be also optional to let the user's natural hair hang freely underneath the irregular clip-in hair extension unit. In some embodiments, it may be optional to pull the user's natural hair in between the multiple thin wefts of the embodiment with a comb when the user's natural hair is left loose beneath the irregular clip-in hair extension to create the desired hairstyle when a cap created with woven or polymer materials may not present. Once the clips 14 are closed securely similarly to FIG. 2C, the installer may then remove the hair clip 32 from the user's natural hair 34 along the top, or crown areas as well as the sides, back and/or nape areas of part 30 and comb the user's natural hair 34 over the irregularly shaped clip in hair extension embodiment of the invention as shown similarly in FIG. 2D to complete the installation or otherwise style.

Many individuals with thinning hair due to medical conditions, medical procedures, age, genetics, etc. may wear a wig created with sewn wefts that is currently sold on the market or a cranial prosthesis which is a wig created with a full or partial fabric cap.

The cranial prosthesis is typically expensive because this type of wig is custom made for the user and often requires adhesive as the point of attachment along the user's hairline. Users often find the cranial prosthesis difficult to install by themselves particularly when adhering the unit with glue to their scalp or hairline in the nape areas. User's with hair along their hairline often find that the adhesive pulls out, weakens or damages their natural hair that comes into contact with the adhesive used to secure the cranial prosthesis. Often users will have to re-attach loosened areas of the cranial prosthesis along their hairline that were previously attached with adhesive. The loosening of the adhesive occurs when the adhesive comes into contact with oils secreted from the user's scalp. This may cause the user embarrassing visibility problems of the cranial prosthesis. Because of the potential complications of wearing a cranial prosthesis, user's commonly employ a professional hairstylist to initially install and continuously maintain the desired appearance of the cranial prosthesis.

The current wigs on the market are created with multiple sewn wefts stitched together. The current wigs on the market are attached to the user's head by wig clips with or without adjustable straps in the nape area. User's often find the current wigs on the market are difficult to wear because they can appear un-natural as they are often pre-cut and/or created with a low grade of human or synthetic hair. Furthermore, the border of the current wigs sold on the market are detectable when a consumer styles their hair away from their hairline such as in a high ponytail or up do. The border of the current wigs sold on the market are also visible if the hair is moved to reveal the consumer's hairline involuntarily such as the wind blowing. The current wigs on the market often have a wig base created with multiple sewn wefts stitched together that experience hair shedding and can feel heavy or scratchy with long term wear.

In a non-limiting example, the invention may be used to improve the current wigs sold on the market made with sewn wefts by creating or lining the border of wigs in addition to other hair extension products made with sewn wefts such as, but not limited to full wig, three quarter wigs, fall, u-part wigs, v-part wigs, hairpieces, lace frontals, closures, bangs, clip-in hair extensions, etc. The usage of the invention along the border may greatly improve the durability and visibility of the current wigs and hair extension products on the market if the center or cap may be created with sewn wefts. The benefit of the invention's usage along the border of the wig or hair extension product may provide increased durability, an inconspicuous look, lighter weight, etc. The thin weft may not be easily damaged and the add-on hairs may not easily shed increasing the longevity of the wig or hair extension product currently sold on the market. If the user's natural hair is moved voluntarily or involuntarily, the wig or other hair extension product may not be detectable visually where all or part of the border of the wig or hair extension product is lined with the invention. The consumer may also run their fingers through the wig or hair extension product and not feel the border created with the invention unlike the border of the current wigs and hair extension products sold on the market created with sewn wefts which are bulky, easily felt, and easily seen when the user's hair is moved voluntarily or involuntarily. Furthermore, the user maybe able to style the wig or hair extension product in a high ponytail or up do where the invention is present along the border. However, the usage of sewn wefts for the cap or center of the wig or hair extension product may continue to present the aforementioned problems of visibility, bulkiness, easily felt, heavy weight, etc.

In one embodiment of the present invention, the thin, lightweight clip-in wefts may be used as a more affordable and comfortable solution to add more volume to thinned hair due to medical conditions, medical procedures, age, genetics, etc. One can apply the invention to the natural hair of a user with thin hair with wefts of different thickness, lengths, widths, and/or shapes evenly distributed throughout the user's hair for a natural look. Because the thin weft in the invention can be created with various densities, this would allow a user with thin hair to wear the invention with multiple wefts of various densities to match the natural density of the user's hair. For example, if the user's hair is thinner along the temples, top, crown and sides than the back and nape areas, the user can apply wefts of a thinner density to the temples, top, crown and sides and wefts of a normal density to the back and nape areas. As a result the user will be able to wear a seamless natural look providing fuller and longer hair with the clip-in hair extensions of the invention that can be installed and removed without the employment of a professional hairstylist. Furthermore, the smooth surface of the underside of the invention allows the user to experience all day comfort. And finally, the user can also install and remove the invention by themselves. In one embodiment of the present invention, the thin, lightweight clip-in wefts may be used as a more affordable solution to add more volume to thinned hair. Other current approaches to this problem include, without limitation, wigs; however, not all users may be comfortable wearing a wig. Moreover, not all users may be comfortable with the idea of applying adhesive to their hair or scalp. The present invention presents another alternative to wearing a wig for users with thin or short hair. Users of the present invention with thin hair may not have to experience the problems of cost, installation, discomfort, un-natural look and manageability challenges associated with the cranial prosthesis and current wigs on the market.

Yet another embodiment of the present invention may be created by attaching human or synthetic hair strands to both sides of a single thin weft with clips sewn, or otherwise attached, such as with tacks, rivets, or eyelets to one side of the thin weft. Again, this embodiment may be able to provide additional hair weight and hair volume per clip-in hair extension.

An aspect of some embodiments of present invention may be to provide a thin, flat and lightweight hair extension that is not easily felt as the user runs their fingers through their hair. Instead, the user typically only feels the hair strands inserted into the front side of the thin weft unlike some current approaches utilizing the sewn wefts, adhesive tapes, polyurethane strips, or micro beads, which may be thick, bulky, and heavy particularly near the application point. Furthermore, embodiments may be at least 50% flatter than current clip-in hair extensions on the market, which may typically enable the weft to be covered completely within the user's natural hair, reducing the risk of visibility. Furthermore, various densities of the thin weft in the invention can be applied to the user's hair. After installation, these embodiments typically remain lightweight even when multiple clip-in hair extensions are distributed throughout the user's natural hair. This may enable the user to experience comfortable all-day-wear while adding volume and length to the user's hairstyle with a natural look, unlike some current approaches the prior art hair system that utilizes the sewn wefts or micro beads. Another aspect of some embodiments of the present invention may be to provide a complete single unit that is flat and lightweight lacking the bulk created by attaching two or more elements together. In these embodiments, the thin weft may be created in a variety of densities, widths and lengths and may be able to hold the amount of hair strands equal to the density of several individual sewn wefts as provided by some current approaches. This may enable the user to add fewer thin wefts while evenly distributing the added hair throughout their entire head for a natural look.

Yet another aspect of some embodiments of the present invention may be to provide comfortable all day and overnight wear including, without limitation, wear during fitness activities. This may be achieved by creating a thin weft made of a mix of polymers that is lightweight and smooth and does not create friction with the user's natural hair, particularly near the roots. In these embodiments the user may typically only feel the clip attachment, and, if the clip attachment is small in size, any discomfort is typically minimal. However, if the material used to create the clip attachments is also polymer based or a plastic, the user may not feel any discomfort at all. It is believed that some current approaches of the invention may be configured to be worn overnight as the sewn wefts and/or micro beads may create friction near the natural hair roots of the user potentially causing hair damage.

In some embodiments of the present invention, the clips are sewn or otherwise attached to the ends of each thin weft to hold the thin weft flat against the user's head near the roots of the natural hair. This may help to prevent the wefts from being lifted accidently from the user's natural hair through daily combing, brushing, washing, and activities as may occur with some current approaches utilizing sewn wefts, micro beads, or adhesive tape. In these embodiments, the flat position of the thin weft may enable the numerous human hair strands on the front side of the thin weft to blend with the appearance and movement of the user's natural hair near the roots and appear like natural hairs growing from the user's scalp. It is believed that this may enable the wefts to be much less visible than many of the sewn wefts, clip-in extensions, or hair extension attached with micro beads provided in current hair extensions systems as these embodiments typically do not comprise the visible elements provided on such current approaches including, without limitation, visible top edges sewn with visible thread, micro beads, pressure rings, etc. Also, these embodiments comprise clips that are attached to the undersides of the wefts rather than the sides of the clips as may be the case in some currently available clip-in extensions. The hair strands attached to the front side of the thin wefts according to these embodiments of the present invention may be able to experience movement above the insertion point of the strands closely matching the appearance and movement of the user's natural hair near the roots as the strands are typically not constricted by binding thread, pressure rings, micro beads, adhesives, etc. As a result, the wefts may be practically imperceptible as the user's natural hair moves, even those with thin or short hair. Furthermore, it is typically not a problem to place clip-in hair extensions according to these embodiments near the crown, hairline or temples of the user's head as the invention is thin, lightweight and easily blends with the consumer's natural hair near the roots.

An aspect of some embodiments of the present invention is to provide a solution that may enable a user to create a wide range of hair styles and to not be limited to styles that may be created with the initial positioning of the hair extension or the directional configuration of the extension as may be the case in some currently available approaches. These embodiments typically may be easily removed and re-positioned in any direction chosen by the consumer as often as needed or desired to create a wide variety of hairstyles that require the consumer's natural hair and invention to be positioned in various directions. In some applications of these embodiments positions of the extensions may be changed and covered by the user's natural hair as needed. It is contemplated that these embodiments may be positioned to virtually any area of the user's natural hair including, without limitation, the back, nape, sides, temples, near the hairline and crown to create the desired, natural looking hairstyle.

Another aspect of some embodiments of the present invention is to avoid premature loosening or detachment of the extensions. In these embodiments, pressure sensitive hair clips may grip the user's natural hair safely and securely without adhesives. Typically, the hair clips are not affected if exposed to oil secreted from the consumer's scalp or oil ingredients found in some hair care and hair styling products unlike hair extension approaches that use adhesive as the point of attachment or as a supplemental securement means. It is believed that the use of the clips in these embodiments may also help to avoid the risk of hair and scalp damage since the clips may be removed regularly with or without the aid of a hairstylist thus allowing the user to apply hair products with oil ingredients to their natural hair and scalp and properly care for their hair and scalp easily and to style their hair as needed without concern of dryness and breakage due to the lack of hair maintenance that may be experienced by avoiding the use of products containing oils. In addition, the lightweight nature of the wefts and clips in these embodiments typically prevent the user's natural hair from being pulled and/or broken by the weight of a multitude of wefts and/or micro beads. Moreover, these embodiments may be attached directly to the user's natural hair near their hair roots without the need for a braided base as may be required in some currently available approaches. Therefore, the user typically does not need to be concerned about damage to their natural hair from a braided base that often does not allow the user to maintain their natural hair as effectively as when the natural hair is worn freely.

Currently available approaches that use adhesive as the point of attachment to the user's scalp may risk damage to both the scalp area and the roots of the hair by blocking the breathability of the scalp where the adhesive is applied. Often the user risks developing bald spots within the scalp area that has experienced exposure to adhesive after long term or repeated application of adhesive to the scalp. It is an aspect of some embodiments of the present invention to avoid damaging the user's scalp by not comprising means of attachment that may be attached directly to the scalp. Instead, these embodiments are attached to the user's natural hair near the roots and typically do not block the breathability of the user's scalp, which may help to maintain the health of the user's scalp.

Another aspect of some embodiments of the present invention may be to provide a temporary, do-it-yourself clip-in hair extension solution that is easy to install and remove without tools such as, but not limited to, sewing needles, crochet needles, clamping devices, temporary adhesive tape, glue guns etc. In typical use of these embodiments, the employment of a professional hairstylist is optional. These embodiments typically require no adhesive to be applied or aligned neither on the extension nor on the user's natural hair or scalp. Typically, if a part is created within the hair, the user can easily guide the installation of the extension into their natural hair near the roots even without a clear view of the area. And if the user does not correctly align the extension, it may be easily removed and reapplied quickly and easily. Additionally, these embodiments typically do not comprise moveable parts that may be included on some currently available approaches such as, but not limited to, wings with adhesive, tape, or liquid adhesive that can be distorted if not handled carefully, which may prevent a secure attachment to the consumer's natural hair. Other movable parts that may be presented in some current approaches include, without limitation, weaving bands, additional hair wefts, micro beads, etc. Additionally, in these embodiments the user also does not need to be concerned with detachable devices that utilize VELCRO® or adhesive which may not be secure for continuous wear, particularly if it is assembled by the user themselves, the final assembly may not be secure. For example, if the user were to layer multiple wefts onto a detachable device they would create a hand assembled unit that is bulky and easily visible by others when the user's natural hair is moved voluntarily. Hair extensions that utilize detachable parts involving VELCRO®, sliders, or adhesive designed to be assembled by the user at home may not be secure and may lead to an embarrassing situation of visibility by others if any part of the hand assembled unit were to move or fall out unintentionally. Embodiments of the present invention may not require the assembly or application of moveable parts. Therefore, the user of these embodiments typically may not need to be concerned about securing moveable parts during application of the extensions.

Yet another aspect of some embodiments of the present invention may be to provide easy removal of the extensions as opposed to the removal processes for some current approaches that may be messy and time consuming, for example, without limitation, removal process for approaches that use adhesive or micro beads as the point of attachment. Furthermore, these embodiments are typically reusable so the user may install, remove, and readjust the extensions easily and as often as they like, usually without the need for a hairstylist. The user may remove and reapply the extensions daily if they so choose, often without damaging their natural hair or scalp. The easy removal and reapplication of these embodiments may also enable the hair extension system to adjust to the growth of the user's natural hair since the user can apply the extensions near the roots with every installation. Thus the user typically does not need to hire a professional hairstylist to remove and re-install the extensions as their natural hair grows as they would if a currently available system that is more difficult to remove is used such as, but not limited to, systems that require adhesive or micro beads as the point of attachment.

Yet another aspect of some embodiments of the present invention is to help save users and hairstylists time and money. These embodiments are typically provided as premade and fully assembled extensions for immediate installation. There are usually no detachable parts or other hair extensions to be added prior to installation. Due to the ease of use, these embodiments typically require no time or money investment from users or hairstylists in the form of education to learn how to apply and remove the extensions. The user is typically not required to incur the expense of hiring a professional hairstylist to install or remove extensions according to these embodiments unless they choose to do so. For the user, if they choose to employ the services of a professional hairstylist, the extensions are usually quick to apply saving the user time and money at the salon. For a hairstylist that uses such embodiments on their clients, the quick installation and removal can save the hairstylist time and enable them to book more hair services during their day to maximize their time and income. The hairstylist is also not required to finance time consuming educational classes to learn how to install and remove the invention within their clients' hair.

It is contemplated that one experienced in the art may be able to adapt the embodiments described by way of example in the foregoing to provide hair extension systems comprising a combination of clips and a thin weft and human or synthetic hair that with a multiplicity of suitable configurations or features such as, but not limited to, child sized extensions, add in doll hair, braids, jewelry, hair wraps, dreadlocks, ribbons, headbands, extensions made to volumize or refresh wigs, etc.

In another embodiment of the invention, human or synthetic hairs of different sizes can be attached to the front side of a single or combination thin weft to create an enhanced layered effect with the add-on hairs.

Those skilled in the art will readily recognize, in light of and in accordance with the teachings of the present invention, that any of the foregoing steps may be suitably replaced, reordered, removed and additional steps may be inserted depending upon the needs of the particular application. Moreover, the prescribed method steps of the foregoing embodiments may be implemented using any physical and/or hardware system that those skilled in the art will readily know is suitable in light of the foregoing teachings. For any method steps described in the present application that can be carried out on a computing machine, a typical computer system can, when appropriately configured or designed, serve as a computer system in which those aspects of the invention may be embodied.

All the features disclosed in this specification, including any accompanying abstract and drawings, may be replaced by alternative features serving the same, equivalent or similar purpose, unless expressly stated otherwise. Thus, unless expressly stated otherwise, each feature disclosed is one example only of a generic series of equivalent or similar features.

It is noted that according to USA law 35 USC § 112 (1), all claims must be supported by sufficient disclosure in the present patent specification, and any material known to those skilled in the art need not be explicitly disclosed. However, 35 USC § 112 (6) requires that structures corresponding to functional limitations interpreted under 35 USC § 112 (6) must be explicitly disclosed in the patent specification. Moreover, the USPTO's Examination policy of initially treating and searching prior art under the broadest interpretation of a "mean for" claim limitation implies that the broadest initial search on 112(6) functional limitation would have to be conducted to support a legally valid Examination on that USPTO policy for broadest interpretation of "mean for" claims. Accordingly, the USPTO will have discovered a multiplicity of prior art documents including disclosure of specific structures and elements which are suitable to act as corresponding structures to satisfy all functional limitations in the below claims that are interpreted under 35 USC § 112 (6) when such corresponding structures are not explicitly disclosed in the foregoing patent specification. Therefore, for any invention element(s)/structure(s) corresponding to functional claim limitation(s), in the below claims interpreted under 35 USC § 112 (6), which is/are not explicitly disclosed in the foregoing patent specification, yet do exist in the patent and/or non-patent documents found during the course of USPTO searching, Applicant(s) incorporate all such functionally corresponding structures and related enabling material herein by reference for the purpose of providing explicit structures that implement the functional means claimed. Applicant(s) request(s) that fact finders during any claims construction proceedings and/or examination of patent allowability properly identify and incorporate only the portions of each of these documents discovered during the broadest interpretation search of 35 USC § 112 (6) limitation, which exist in at least one of the patent and/or non-patent documents found during the course of normal USPTO searching and or supplied to the USPTO during prosecution. Applicant(s) also incorporate by reference the bibliographic citation information to identify all such documents comprising functionally corresponding structures and related enabling material as listed in any PTO Form-892 or likewise any information disclosure statements (IDS) entered into the present patent application by the USPTO or Applicant(s) or any 3rd parties. Applicant(s) also reserve its right to later amend the present application to explicitly include citations to such documents and/or explicitly include the functionally corresponding structures which were incorporate by reference above.

Thus, for any invention element(s)/structure(s) corresponding to functional claim limitation(s), in the below claims, that are interpreted under 35 USC § 112 (6), which is/are not explicitly disclosed in the foregoing patent specification, Applicant(s) have explicitly prescribed which documents and material to include the otherwise missing disclosure, and have prescribed exactly which portions of such patent and/or non-patent documents should be incorporated by such reference for the purpose of satisfying the disclosure requirements of 35 USC § 112 (6). Applicant(s) note that all the identified documents above which are incorporated by reference to satisfy 35 USC § 112 (6) necessarily have a filing and/or publication date prior to that of the instant application, and thus are valid prior documents to incorporated by reference in the instant application.

Having fully described at least one embodiment of the present invention, other equivalent or alternative methods of implementing a temporary, clip-in hair extension system according to the present invention will be apparent to those skilled in the art. Various aspects of the invention have been described above by way of illustration, and the specific embodiments disclosed are not intended to limit the invention to the particular forms disclosed. The particular implementation of the temporary, clip-in hair extension system may vary depending upon the particular context or application. By way of example, and not limitation, the temporary, clip-in hair extension systems temporary, clip-in hair extension system described in the foregoing were principally directed to implementations with rectangular wefts; however, similar techniques may instead be applied to extensions with wefts of various different shapes including, without limitation, curved wefts, circular wefts, or triangular wefts, which implementations of the present invention are contemplated as within the scope of the present invention. The invention is thus to cover all modifications, equivalents, and alternatives falling within the spirit and scope of the following claims. It is to be further understood that not all of the disclosed embodiments in the foregoing specification will necessarily satisfy or achieve each of the objects, advantages, or improvements described in the foregoing specification.

Claim elements and steps herein may have been numbered and/or lettered solely as an aid in readability and understanding. Any such numbering and lettering in itself is not intended to and should not be taken to indicate the ordering of elements and/or steps in the claims.

The corresponding structures, materials, acts, and equivalents of all means or step plus function elements in the claims below are intended to include any structure, material, or act for performing the function in combination with other claimed elements as specifically claimed.

The corresponding structures, materials, acts, and equivalents of all means or step plus function elements in the claims below are intended to include any structure, material, or act for performing the function in combination with other claimed elements as specifically claimed. The description of the present invention has been presented for purposes of illustration and description, but is not intended to be exhaustive or limited to the invention in the form disclosed. Many modifications and variations will be apparent to those of ordinary skill in the art without departing from the scope and spirit of the invention. The embodiment was chosen and described in order to best explain the principles of the invention and the practical application, and to enable others of ordinary skill in the art to understand the invention for various embodiments with various modifications as are suited to the particular use contemplated.

The Abstract is provided to comply with 37 C.F.R. Section 1.72(b) requiring an abstract that will allow the reader to ascertain the nature and gist of the technical disclosure. It is submitted with the understanding that it will not be used to limit or interpret the scope or meaning of the claims. The following claims are hereby incorporated into the detailed description, with each claim standing on its own as a separate embodiment.

What is claimed is:

1. An apparatus comprising:

a weft implement, in which said weft implement comprises a single strip of a polymer material having a front side section and a back side section, wherein said weft implement front side section is configured to hold hair strands;

said polymer material comprises at least one of, silicone, nylon, synthetic or organic rubber, polyurethane, synthetic or organic polymer, synthetic or organic plastic material, copolymers, thermoplastic polyurethane, thermosetting polymer, and elastic polymer;

a plurality of hair strands, wherein said plurality of hair strands are configured to being inserted or injected into said weft implement front side section;

at least one hair clip implement being configured to engage to said back side section of said weft implement, wherein said at least one hair clip implement being further configured to removably attach to a user's natural hair;

said at least one hair clip implement comprises at least one pressure sensitive clip;

a plurality of teeth having an open and a closed position, said plurality of teeth being configured to enable an installation or a removal of said weft implement, said at least one hair clip implement being coated with a polymer material for mitigating damage to the user's normal hair;

a base portion that is disposed proximate said row of teeth, wherein said row of teeth is further configured to pop up away from said base portion in said open position or snap back towards said base portion in said closed position to enable said installation or removal of said weft implement;

a base portion polymer material, wherein said base portion polymer material is disposed to cover said base portion, and wherein said base portion polymer material is configured to enhance a grip of said hair clip implement on said user's natural hair;

said base portion is covered with a polymer material that is configured to enhance a grip of said weft implement on said user's natural hair;

a plurality of hole sections, wherein said at least one pressure clip is engaged with said back side of said weft implement, and wherein said engagement including at least one of sewing with thread, elastic thread, monofilament or cord or attaching with a rivet or an eyelet said at least one pressure clip to said back side of said weft implement through said plurality of hole sections;

a middle section between said row of teeth, wherein said middle section is configured to fasten to a portion of said back side section of said weft implement, in which said fastening comprises at least one of, sewing or stitching; and a linking material, wherein said linking material is configured to engage said weft implement to an additional strip of a polymer material having at least inserted hair strands, and wherein said linking material is configured to engage said weft implement to said additional strip of a polymer material in a triangular or circular configuration.

2. The apparatus as recited in claim 1, further comprising a second linking material and a second additional polymer material strip, wherein said second linking material is configured to be operable for engaging said weft implement to said second additional polymer material strip, said second additional polymer material strip having at least inserted hair strands.

3. The apparatus as recited in claim 2, in which said linking material comprises at least one of, a stretch lace, elastic mesh, silk, cotton, polyester and nylon.

4. The apparatus as recited in claim 2, in which said linking material is further configured to engage said second additional polymer material strip in an overlapping configuration.

5. The apparatus as recited in claim 1, in which said plurality of hole sections comprises at least six hole sections configured to be operable for sewing to said back side section.

6. The apparatus as recited in claim 5, in which said at least one hair clip implement further comprises at least six rivets or eyelets, wherein each of said six rivets or eyelets is configured to insert through each of said six hole sections.

7. The apparatus as recited in claim 1, further comprising a cap structure being joined to said polymer material strip for forming a wig, a hairpiece, or a fall.

8. The apparatus as recited in claim 1, in which said at least one pressure sensitive clip is configured to engage to said back side section of said weft implement with a rivet or eyelet.

9. The apparatus as recited in claim 8, in which said plurality of teeth is configured to open by applying pressure to a side segment of said hair clip implement.

10. The apparatus as recited in claim 1, in which said rivet or eyelet comprises a jewel in a proximate center of a head of said rivet or eyelet.

11. The apparatus as recited in claim 1, in which said back side further comprises an indicia surface section, wherein said indicia surface section is configured to be operable for including indicia that showcase an inscribed label or logo.

12. The apparatus as recited in claim 1, in which said polymer material strip further comprises a circular or rectangular shape, wherein said polymer material is configured to adhere to said inserted or injected hair strands without adhesive.

13. The apparatus as recited in claim 1, in which said at least one hair clip comprises at least one of, a metal, a plastic, a silicone, a polymer, and a nylon that is configured to be operable for removably attaching to a user's normal hair near roots of the user's normal hair.

14. The apparatus as recited in claim 1, in which said plurality of hair strands comprise at least one of a synthetic material and natural hair.

15. An apparatus consisting of:

means for securing a plurality of hair strands;

means for removably attaching said securing means to a user's natural hair;

means for enabling an installation or a removal of said securing means;

means for mitigating damage to the user's natural hair;

means for enhancing a grip of said securing means on said user's natural hair;

means for opening or closing said means for removably attaching said securing means;

means for showcasing an inscribed label or logo;

means for additionally securing a plurality of hair strands;

means for joining said securing means to said additional securing means;

means for joining said attaching means to said securing means; and means for forming at least one of, a wig, a hairpiece, and a fall.

16. An apparatus consisting of:

a single strip of a polymer material having a front side section and a back side section, wherein said single strip of a polymer material is a weft implement that is configured to hold hair strands into said front side section;

said polymer material is at least one of, silicone, nylon, synthetic or organic rubber, polyurethane, synthetic or organic polymer, synthetic or organic plastic material, copolymers, thermoplastic polyurethane, thermosetting polymer, and elastic polymer;

a plurality of hair strands, wherein said plurality of hair strands are configured to insert into said front side section, where said polymer material is configured to be cured around said hair strands;

a plurality of hair clips having pressure sensitive clips being configured to removably attach to a user's natural hair;

a plurality of teeth having an open and a closed position being configured to enable an installation or a removal of said weft implement, said hair clips being coated with a polymer material for mitigating damage to the user's normal hair;

a base portion disposed beneath said plurality of teeth, wherein said plurality of teeth is further configured to pop up away from said base portion in said open position or snap back towards said base portion in said closed position, enabling said installation or removal of said weft implement to said user's normal hair;

said base portion is covered with a polymer material that is configured to enhance a grip of said weft implement on said user's natural hair;

means for securing said plurality of hair clips to said back side section;

said securing means having at least six hole sections, wherein each of said six hole sections is configured to engage said at least one weft implement to said back side section of said weft implement by rivets or eyelets;

said securing means further having a middle section of said row of teeth, wherein said middle section is configured to fasten to a portion of said back side section of said weft implement, in which said fastening having at least one of, sewing or stitching; and a linking material, wherein said linking material is configured to engage said weft implement to an additional strip of a polymer material having at least inserted hair strands.

* * * * *